US011286087B2

(12) United States Patent
Goldfarb et al.

(10) Patent No.: US 11,286,087 B2
(45) **Date of Patent: *Mar. 29, 2022**

(54) CHILD SAFETY COVERS FOR USE WITH VARIOUS PACKAGING OR CONTAINERS INCLUDING WITHOUT LIMITATION PACKAGING AND CONTAINERS SHAPED TO CORRESPOND TO A CHARACTERISTIC OF THE CONTENTS CONTAINED THEREIN

(71) Applicant: BURST OUT INNOVATIONS, INC., Boca Raton, FL (US)

(72) Inventors: Gary K Goldfarb, Boca Raton, FL (US); Werner Blumenthal, Miami, FL (US); Alexander Zuleta, Miami, FL (US)

(73) Assignee: BURST OUT INNOVATIONS, INC., Boca Raton, FL (US)

( * ) Notice: Subject to any disclaimer, the term of this patent is extended or adjusted under 35 U.S.C. 154(b) by 28 days.

This patent is subject to a terminal disclaimer.

(21) Appl. No.: 16/195,714

(22) Filed: Nov. 19, 2018

(65) Prior Publication Data

US 2019/0161249 A1 May 30, 2019

Related U.S. Application Data

(63) Continuation-in-part of application No. 15/813,092, filed on Nov. 14, 2017, now Pat. No. 10,131,476, (Continued)

(51) Int. Cl.
*B65D 43/02* (2006.01)
*B65D 50/04* (2006.01)
(Continued)

(52) U.S. Cl.
CPC ..... *B65D 43/022* (2013.01); *B65D 43/0229* (2013.01); *B65D 50/046* (2013.01); *B65D 81/365* (2013.01); *B65D 85/60* (2013.01); *B65D 2543/00092* (2013.01); *B65D 2543/00231* (2013.01); *B65D 2543/00574* (2013.01); *B65D 2543/00583* (2013.01)

(58) Field of Classification Search
CPC ..... B65D 50/046; B65D 2251/0015; B65D 43/0202; B65D 81/365; B65D 50/06; B65D 51/10
USPC ..... 220/302
See application file for complete search history.

(56) References Cited

U.S. PATENT DOCUMENTS 4,011,829 A * 3/1977 Wachsmann ..... A61J 7/04 116/308
10,131,476 B2 * 11/2018 Goldfarb ..... B65D 50/046
(Continued)

*Primary Examiner* — Shawn M Braden
(74) *Attorney, Agent, or Firm* — Daniel S. Polley, P.A.

(57) ABSTRACT

Child safety lid/cover is provided and used to close the opening of content containers including rigid containers. The cover requires a multiple step process in order to be removed and helps to prevent inadvertent or accidental openings of the container. An embodiment for flexible bags includes the cover and adds a ring member that contains the locking section that the cover/lid is secured to. The flexible bag is secured to the ring member. The disclosed lid/cover can also be incorporated into lids of larger containers, such as, without limitation, relatively large tubs and pails.

19 Claims, 61 Drawing Sheets

Related U.S. Application Data which is a continuation-in-part of application No. 15/707,280, filed on Sep. 18, 2017, now abandoned, which is a continuation of application No. 15/647,401, filed on Jul. 12, 2017, now abandoned, which is a continuation of application No. 15/586,787, filed on May 4, 2017, now abandoned.

(60) Provisional application No. 62/331,714, filed on May 4, 2016.

(51) Int. Cl.
*B65D 81/36* (2006.01)
*B65D 85/60* (2006.01)

(56) References Cited

U.S. PATENT DOCUMENTS

| | | | | |
|---|---|---|---|---|
| 2011/0180541 | A1* | 7/2011 | Becklin | H05K 7/202<br>220/324 |
| 2014/0021158 | A1* | 1/2014 | Barron | B65D 50/06<br>215/253 |
| 2016/0280429 | A1* | 9/2016 | Piscopo | B65D 50/046 |
| 2017/0349341 | A1* | 12/2017 | Girardot | D06F 39/024 |

* cited by examiner

CHILD SAFETY COVERS FOR USE WITH VARIOUS PACKAGING OR CONTAINERS INCLUDING WITHOUT LIMITATION PACKAGING AND CONTAINERS SHAPED TO CORRESPOND TO A CHARACTERISTIC OF THE CONTENTS CONTAINED THEREIN

This application is a continuation-in-part of U.S. application Ser. No. 15/813,092, filed Nov. 14, 2017, which is a continuation-in-part of application Ser. No. 15/707,280, filed Sep. 18, 2017, which is a continuation of U.S. application Ser. No. 15/647,401, filed Jul. 12, 2017, which is a continuation of U.S. application Ser. No. 15/586,787, filed May 4, 2017, which claims the benefit of and priority to U.S. Provisional Patent Application Ser. No. 62/331,714, filed May 4, 2016 and claims the benefit and priority to U.S. Provisional Patent Application No. 62/422,416, filed Nov. 15, 2016. All of the above applications are incorporated by reference in their entireties for all purposes.

FIELD OF THE DISCLOSURE

The disclosure generally relates to content contents packaging containers and particularly to a packaging container specifically shaped to correspond to the contents contained within the container and/or also providing containers with child proof lids.

BACKGROUND

The current candied and flavored markets, which include gift baskets containing such contents, lack creativity and a unique presentation with respect to the packaging or bottling.

Furthermore, there are an ever increasing amount accidental deaths and overdoses involving children with prescription and non-prescription drugs. Even where there the drugs are initially provided or sold in a container, bottle, package, packaging etc. (collectively "Container" or "Containers") having a child safety cover or packaging, the child safety cover or packaging features are only for initially opening the Containers or package. Thus, once the Containers have been opened, the child safety qualities of the lid, cover, package, etc. are eliminated. Where the contents of the Containers is not fully consumed at the time of opening, the Container storing the remaining content typically no longer possesses its original child safety characteristics and is thus subject to being opened by a child. This often leads to the unfortunate consequences of the child having easy access to the remaining content and consuming some or all of the remaining content resulting in serious harm and sometimes death of the child.

The present Containers and child safety covers disclosed herein are directed to overcoming the drawback with current Containers and current lids and covers therefor and provides for improvements to Containers and improvements to child safety opening devices.

SUMMARY OF THE INVENTION

The disclosure generally provides for a novel child safety cover, cap or lid (collectively "Cover" or "Covers") for a Container. Contrary to current prior child safety covers, after initial opening the disclosed novel Cover is reusable and retains it child safety qualities with each subsequent use after initial opening. The Cover can be used various types of Containers.

In one non-limiting embodiment for the Cover can comprise a semi pliable layer which prevents removal by a simple twist of the Cover. The pliable layer can be preferably compressed to release a locking mechanism. To the further secure the contents within the Container, the user preferably pinches two centrally located tabs prior to initiating a push and twist action to remove the Cover from the Container. Accordingly, in one non-limiting use, the following actions can be performed to remove the Cover from the Container: (1) the user pinches two tabs inward, preferably centrally located on the top of the Cover, which causes a dynamic deadbolt style mechanism serving as the primary lock to release preferably by retraction of the deadbolt style mechanism. With the deadbolt style mechanism retracted/released, a second lock, which can be a static peg, can be deactivated; (2) Preferably to disengage the static peg, the user can push down on the cover, while preferably still pinching the two tabs to compress a semi pliable seal. This action allows the static peg to slide underneath a locking geometry on the interior walls of the Container; (3) While the user is preferably still pinching and pushing, the user then twist the Cover; and (4) after the Cover is twisted out of position with respect to the Container and the locking geometry of the Container the Cover can then be pulled up by the user and removed to provide access to the Container or the contents of the Container.

Also disclosed are novel Containers, which in addition to having their novel characteristics that will be described below, can also be used with the above and below described novel Cover. In one non-limiting embodiment the Containers preferably can be clear or tinted fruit shaped containers/packaging that corresponds to the color and flavor of the contents contained within the container. As one non-limiting example, for banana-flavored popcorn the Container can be shaped to resemble a banana or group of bananas. Though preferably clear, the banana shaped Container can also be tinted yellow. Having the Container shaped to match the flavoring helps to inform consumers and allows them to immediately recognize that the popcorn sold within the Container is banana-flavored, without such information having to be printed on a label or other printed matter associated with the product. The disclosed Container allows the user to brand fruit shape, coloring, and flavors that reflect the product or content contained within the Container.

Additionally, the openings for removing the contents from within the Container can be located at the bottom of the Container or alternatively at the top or another location of the Container. Preferably where the disclosed novel child safety Cover is not used, a cap, spout or other attachment can be secured at the opening (i.e. by threaded relationship) to keep the contents within the Container until the user is ready to open the Container to access the contents. The type of attachment depends on the nature of the Contents (e.g. solid, liquid, etc.) With the openings preferably at the bottom in certain embodiments, when the Containers are used as part of gift basket or gift box, the bottom opening and attachment (i.e. cap, spout, etc.) can be hidden from view so as not to distract from the aesthetics of the Container.

Furthermore, as mentioned above, the disclosed novel child safety Cover helps to prevent a child from easily removing the Containers cover and having access to the content contained within the Container. Where such content is a drug, the use of the novel child safety Cover may serve as a critical barrier to prevent a child from consuming the drugs within the Container.

BRIEF DESCRIPTION OF THE DRAWINGS

FIGS. 88 through 96 illustrate several views of another embodiment for the novel Cover preferably with use with flexible bags in accordance with the present disclosure.

DETAILED DESCRIPTION

Figure 1:
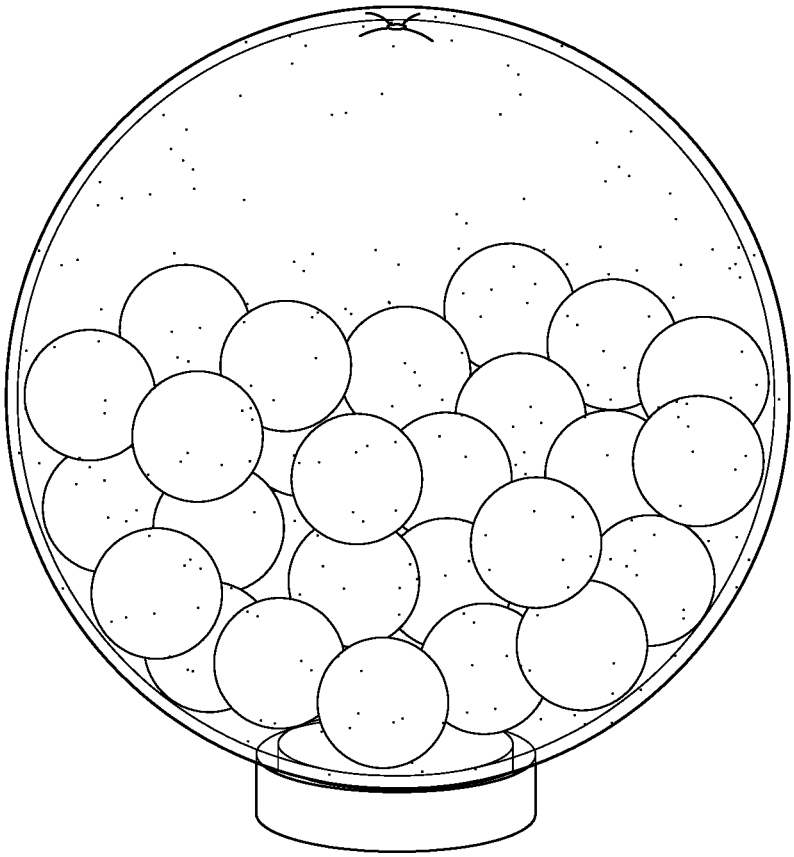
FIG. 1 is a perspective view of a first non-limiting embodiment for the novel packaging/container in accordance with the present disclosure and illustrating an orange shape for the container.

FIGS. 1 through 29 illustrate various non-limiting novel Containers. In certain non-limiting embodiments, a clear or tinted fruit shaped Containers can be provided that corresponds to the color and flavor of the contents contained within the Container. As one of many non-limiting examples, for a banana-flavored popcorn, the Container can be shaped to resemble a banana or group of bananas. Though preferably clear, the banana shaped Container can also be tinted yellow. Having the Container shaped to match the flavoring helps to inform consumers and allows them to immediately recognize that the popcorn sold within the Container is banana-flavored, without such information having to be printed on a label or other printed matter associated with the product.

The Containers described herein and shown in the drawings allow the user to brand fruit shape, coloring, content and/or flavors that reflect the product contained within the container. Non-limiting examples of the types of content can include popcorn, dried fruit, candy, jelly beans, medications, nuts, desserts, cookies, etc.

Additionally, the openings for removing the contents from within the Container can be located at the bottom of the Container, as well at the top of the Container or any other area of the Container. In certain embodiments, a cap, spout or other attachment can be conventionally is secured at the opening (i.e. by threaded relationship) to keep the contents within the Container until the user is ready to open the Container to access the contents. The type of attachment at the Container opening depends on the nature of the contents (e.g. solid, liquid, etc.) With the openings preferably at the bottom in certain uses (and the bottom location not considered limiting), when the Containers are used as part of gift basket or gift box, the bottom opening and attachment (i.e. cap, spout, etc.) can be hidden from view so as not to distract from the aesthetics of the fruit-shaped packaging.

Figure 29:
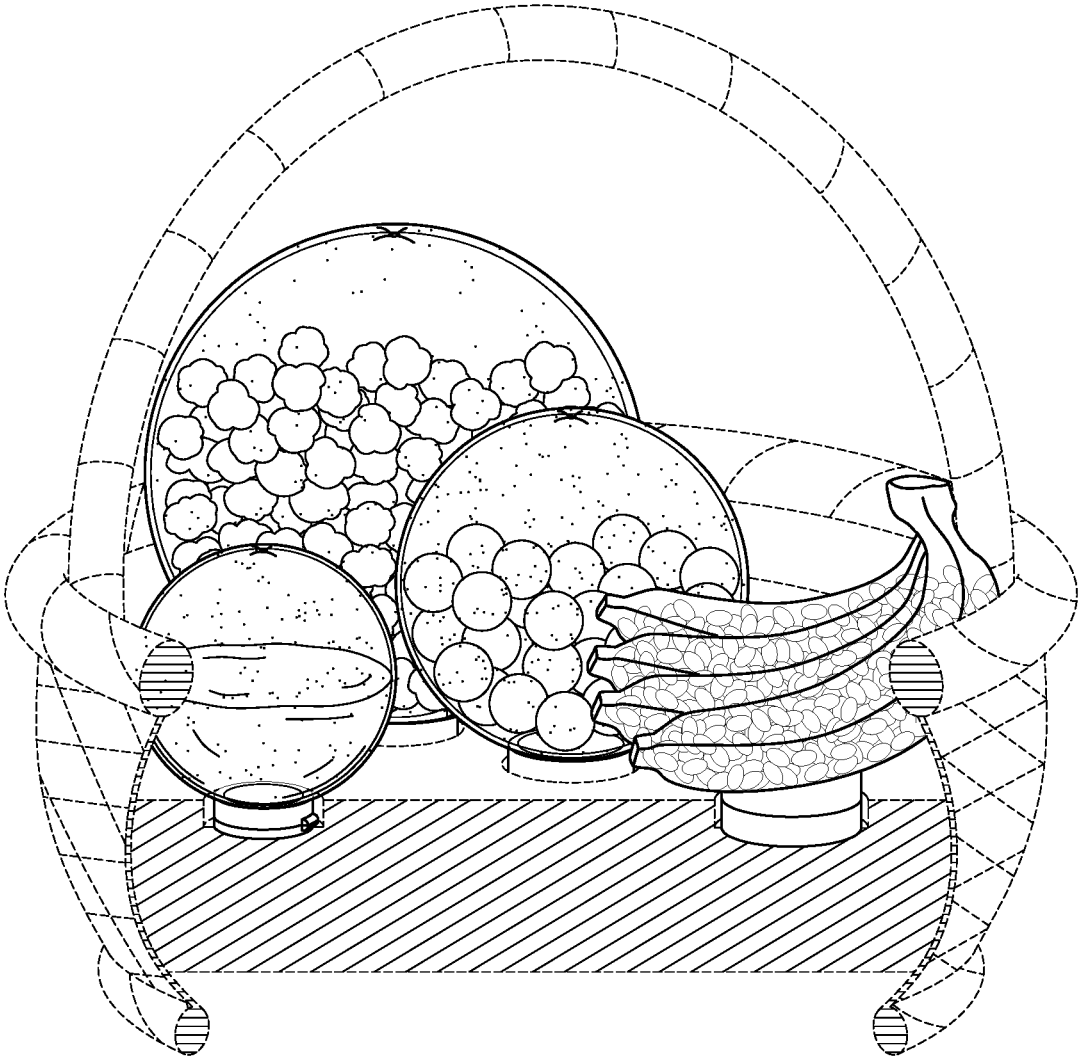
FIG. 29 is a front perspective sectional view showing of a gift basket containing some of the novel containers described and/or shown herein.
Figure 30:
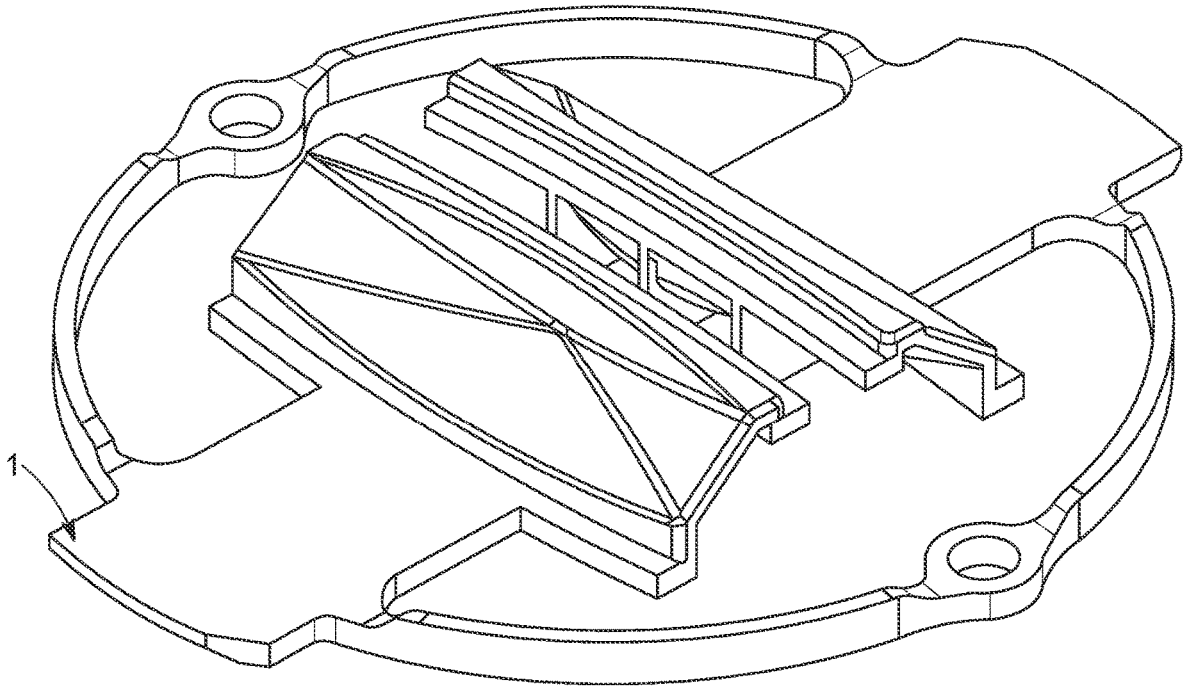
FIG. 30 is a perspective view of a preferred deadbolt component of the novel child safety Cover for use with one or more of the novel Containers disclosed herein or shown in the drawings or with other Containers.
Figure 31:
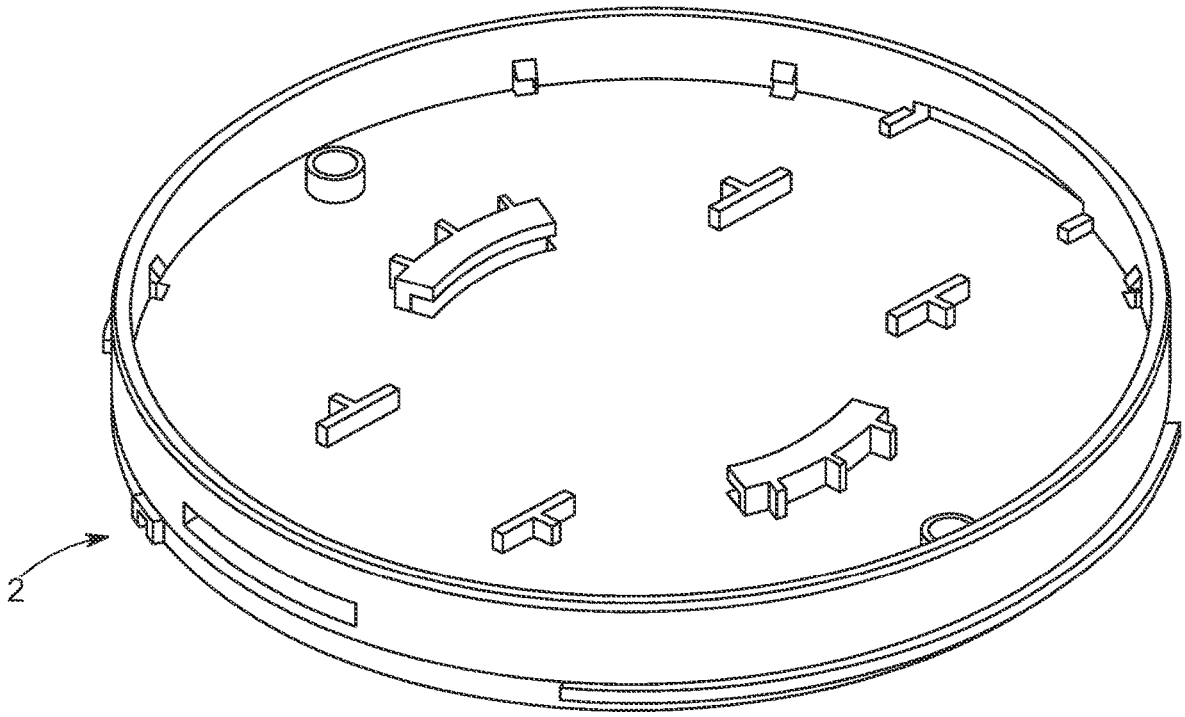
FIG. 31 is a perspective view of a preferred bottom member with static pin component of the novel child safety Cover for use with one or more of the novel Containers disclosed herein or shown in the drawings or with other Containers.
Figure 32:
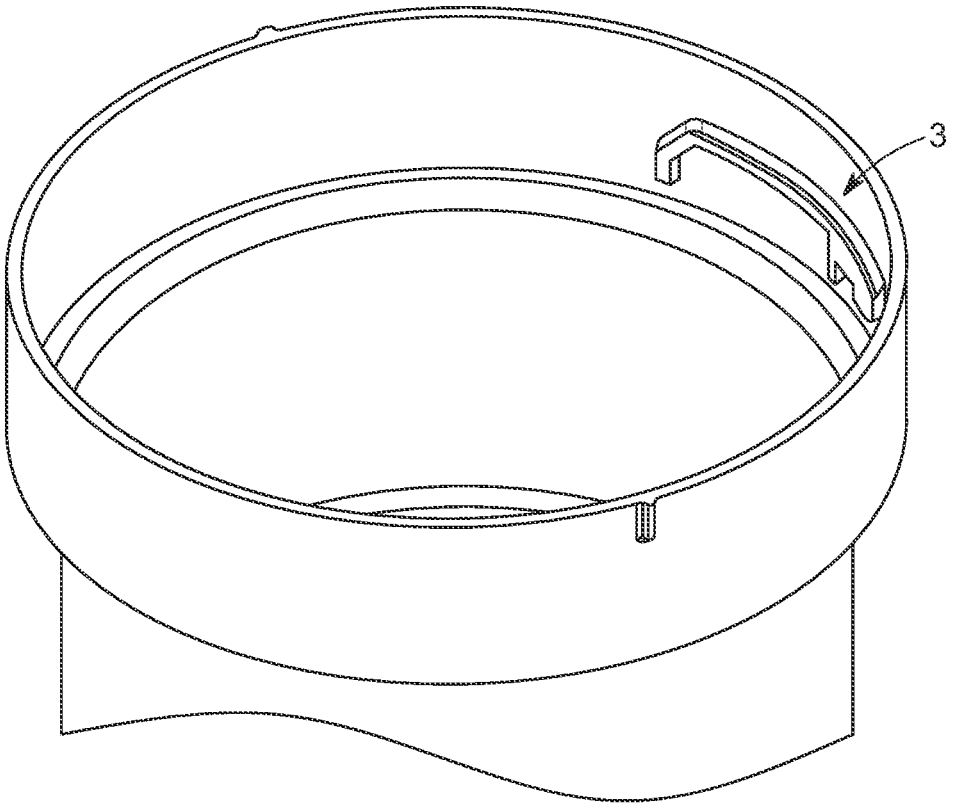
FIG. 32 is a perspective view of a preferred locking geometry/locking section component of the novel child safety Cover for use with one or more of the novel Containers disclosed herein or shown in the drawings or with other Containers.
Figure 33:
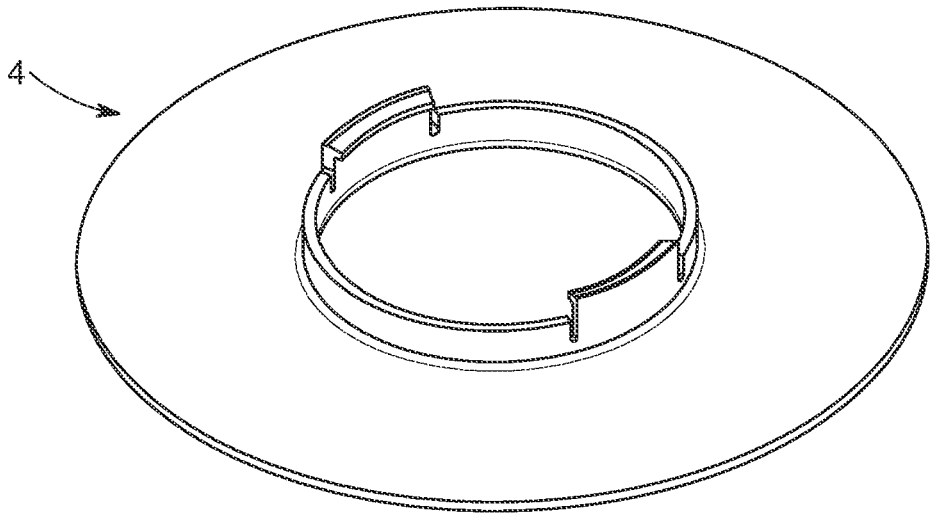
FIG. 33 is a perspective view of a preferred pliable seal component of the novel child safety Cover for use with one or more of the novel Containers disclosed herein or shown in the drawings or with other Containers.
Figure 34:
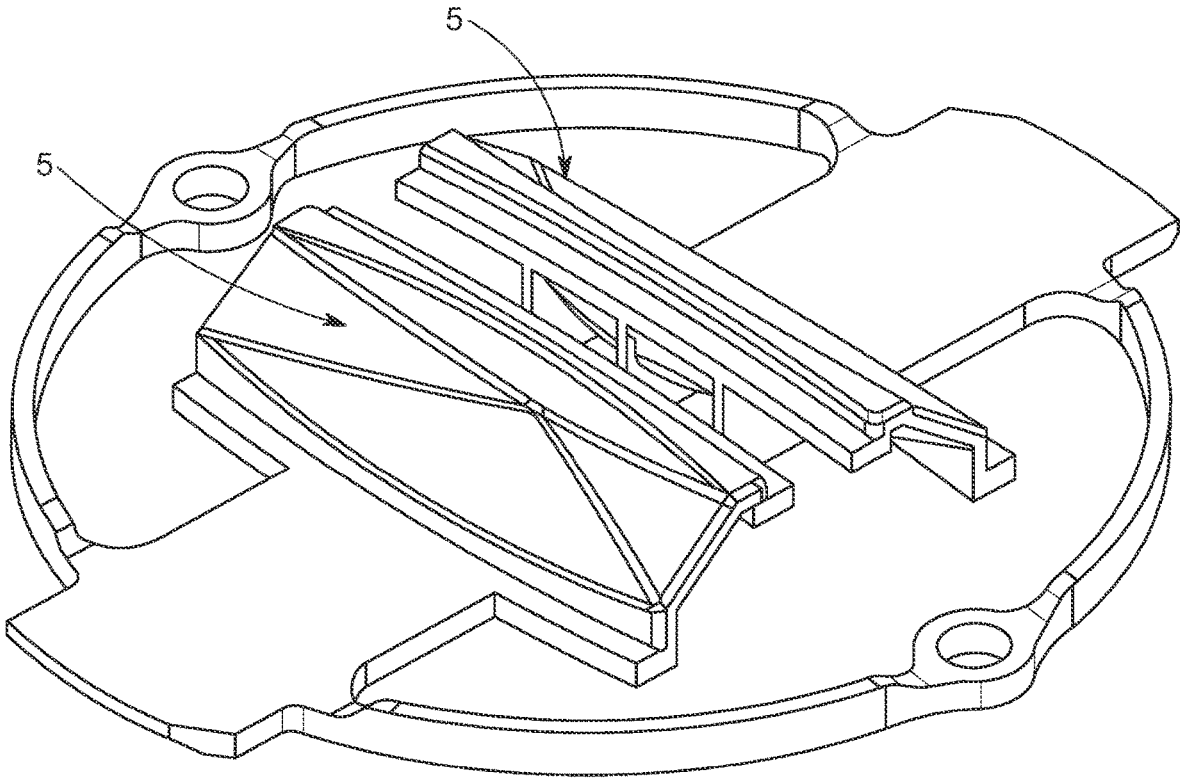
FIG. 34 is a perspective view of the locking member with pinch tabs component of the novel child safety Cover for use with one or more of the novel Containers disclosed herein or shown in the drawings or with other Containers.
Figure 35:
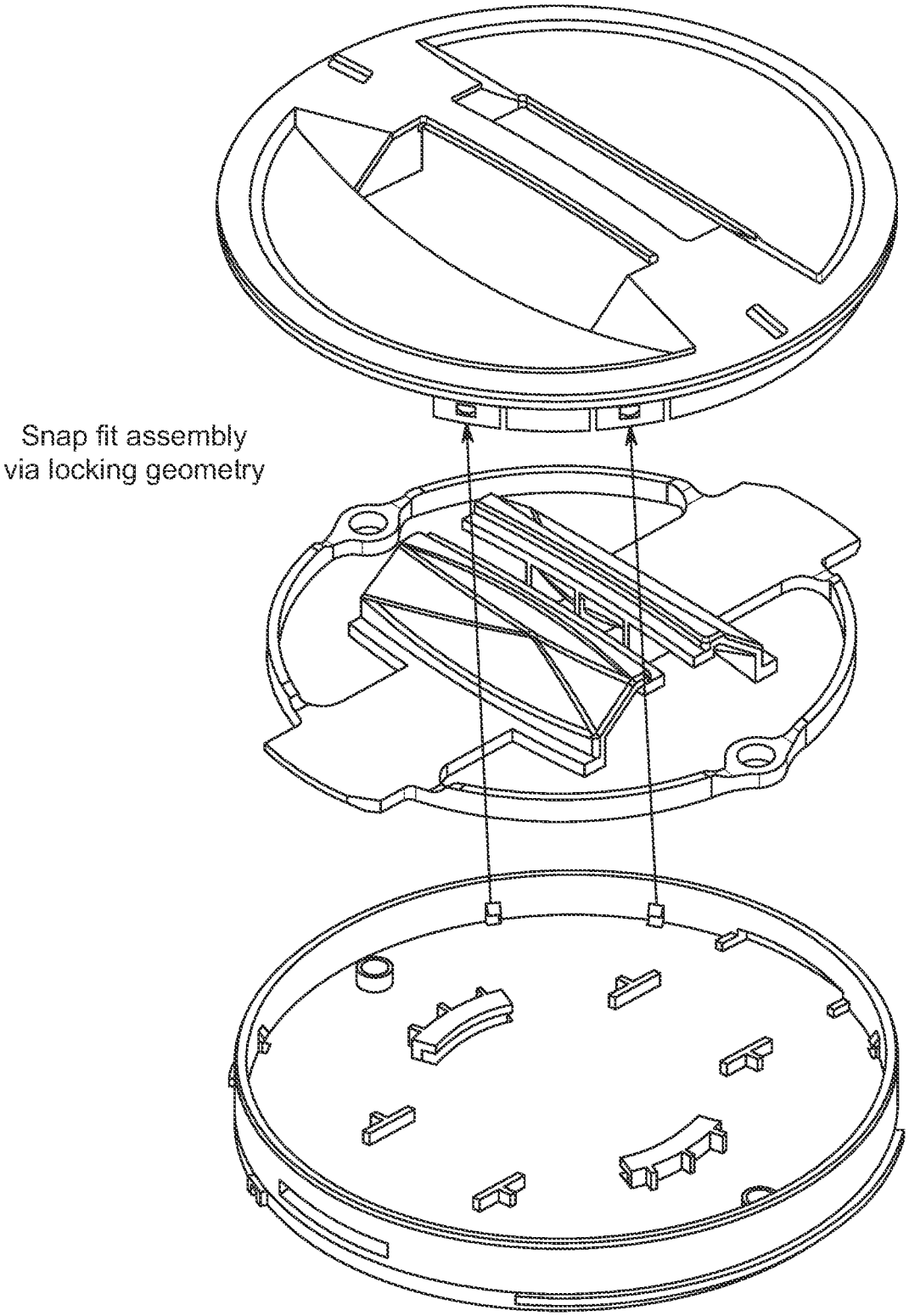
FIG. 35 is a perspective view of a preferred attachment points (snap fit) between the top member, locking member/deadbolt component and bottom member/static pin components as part of the assembly for the novel child safety Cover in accordance with the present disclosure.
Figure 36:
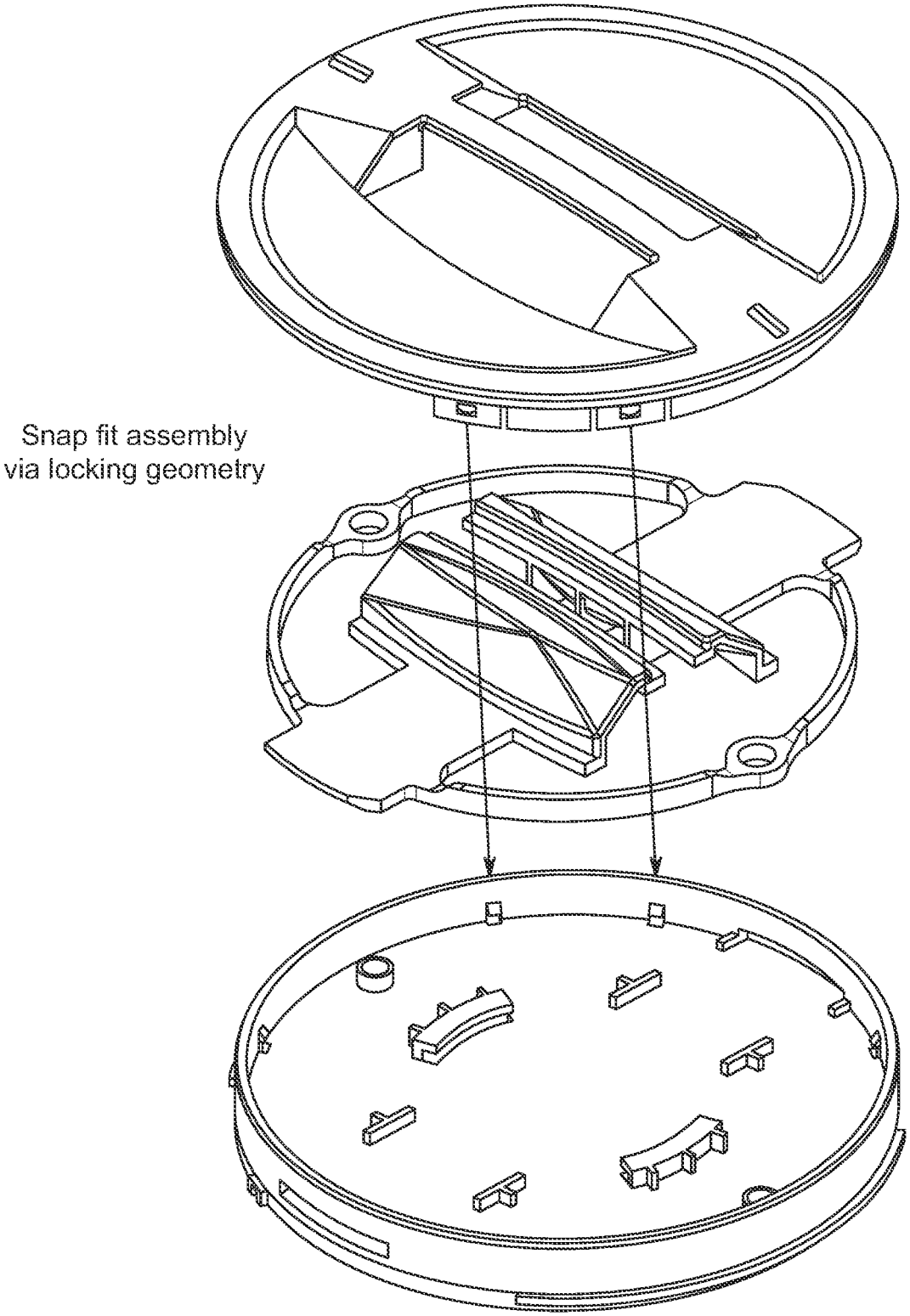
FIG. 36 is another perspective view of a preferred attachment points (snap fit) between the top member, locking member/deadbolt component and bottom member/static pin components as part of the assembly for the novel child safety Cover in accordance with the present disclosure.
Figure 37:
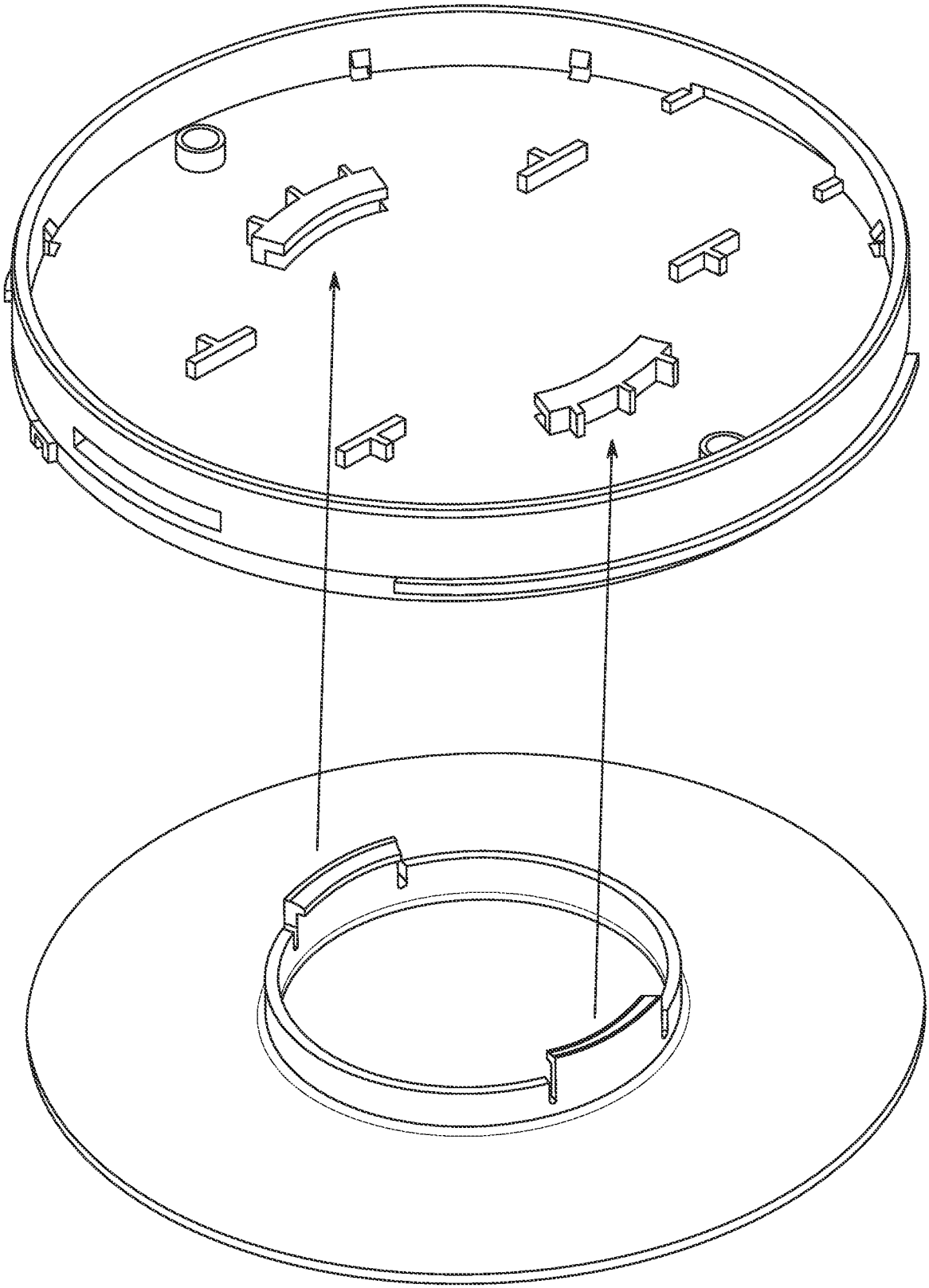
FIG. 37 is a perspective view illustrating the preferred attachment points between the static or fixed pin/peg component and the pliable seal component as part of the assembly for the novel child safety Cover in accordance with the present disclosure.
Figure 38:
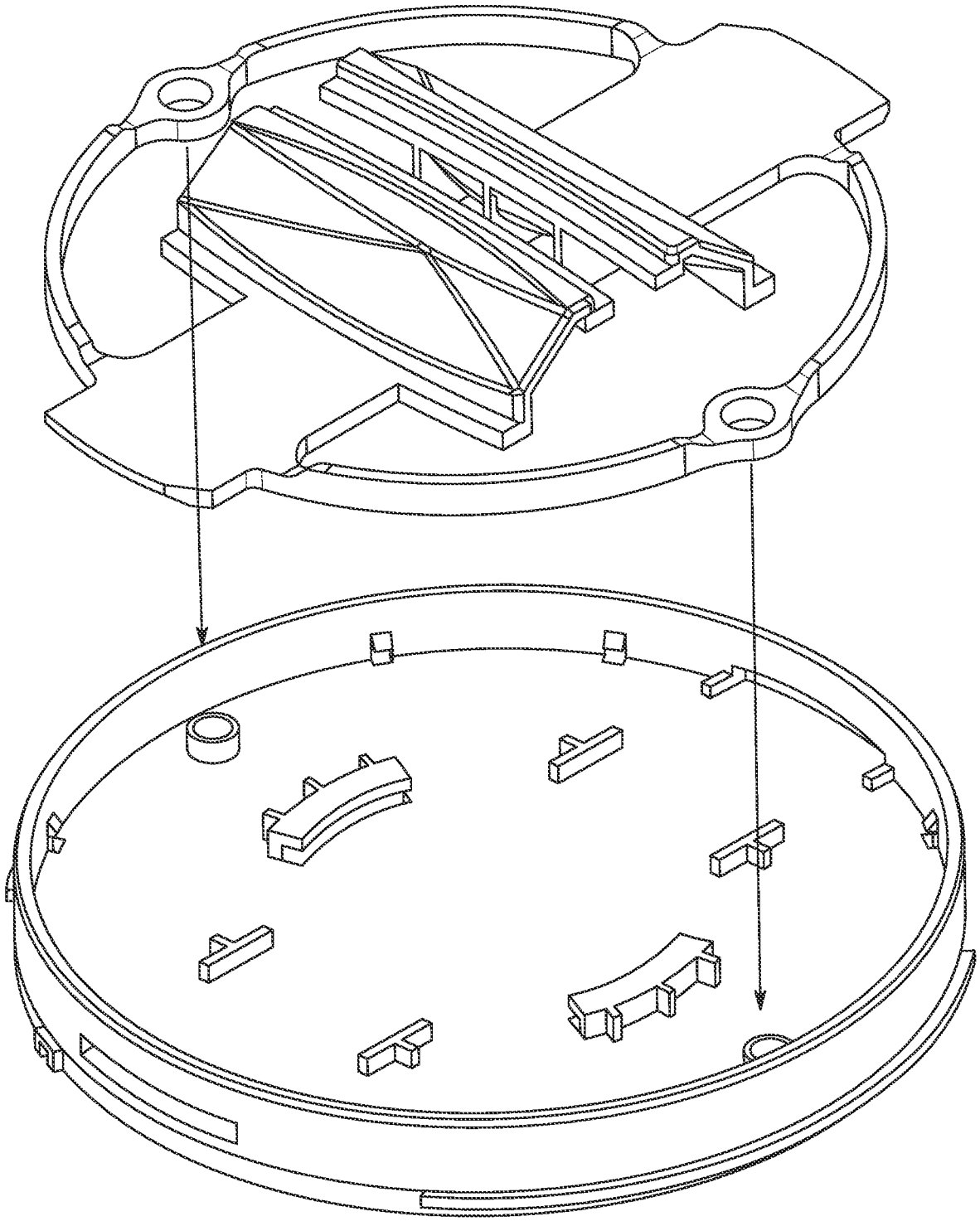
FIG. 38 is a perspective view illustrating the preferred attachment points between the static pin and the deadbolt/locking member components as part of the assembly for the novel child safety Cover in accordance with the present disclosure.
Figure 81:
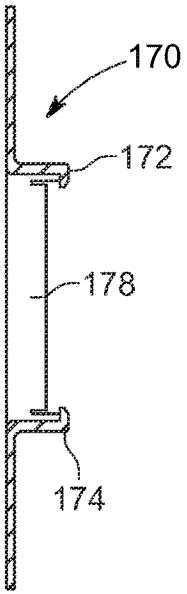

For other uses, especially where medications, drugs, prescriptions, etc. are part of the intended content for the Container, a child safety Cover can be provided at opening, including, without limitation, the novel child safety Cover disclosed in detail herein and shown in drawings FIGS. 30 through 81. It is also within the scope of the present disclosure that the novel Cover showing described herein and shown in drawings FIGS. 30 through 81 can be used with all various types of Containers and is not considered limited to use with just the Containers showing in drawing FIGS. 1 through 29.

In certain embodiments, the attachments when in a closed position, can provide a planar or flat surface of sufficient width, such that an individual Container can be freestanding on its own.

The matching concepts of the shape of the Container with the contents contained within the Container is not considered limited to fruit and/or fruit flavors. Rather, these same concepts can also be applied to other non-fruit flavored and non-fruit shaped products and Containers. As one non-limiting example, the Container could be shaped to represent a country or part of the world where the contents (ingredients, spices, sauces, flavors, herbs, liquids, etc., though such is not considered limiting) are grown or known to come from.

Accordingly, the disclosed Container, while providing for an aesthetically pleasing Container, particularly when compared to past Containers, also immediately informs the potential consumer of the flavor of the contents and provides for a match between the Container and content flavoring and in some cases also content coloring.

Figure 2:
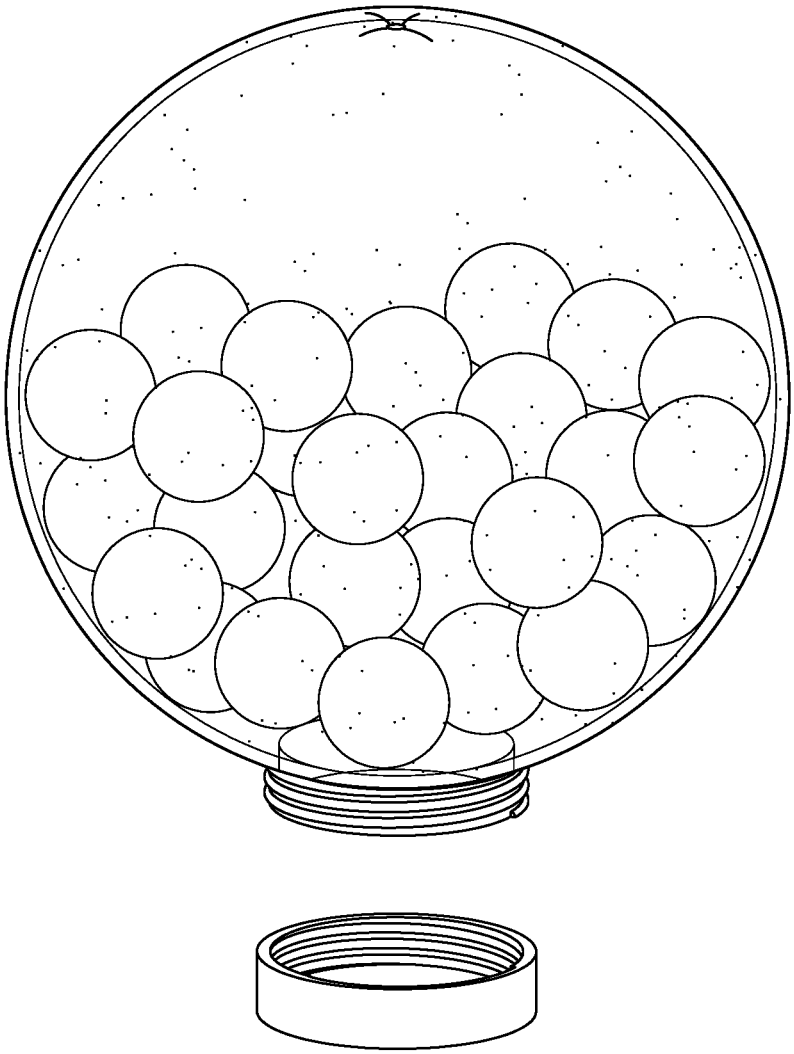
FIG. 2 is an exploded perspective view of the orange shaped container of FIG. 1.
Figure 3:
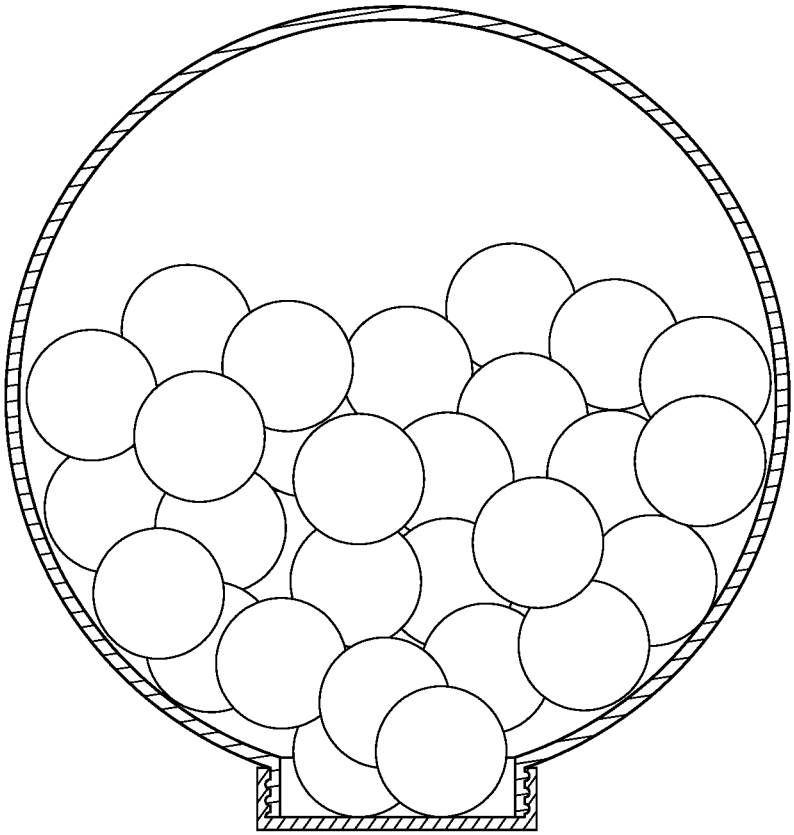
FIG. 3 is a sectional view of the orange shaped container of FIG. 1.

With respect to FIGS. 1-3 the non-limiting shape selected for the Container is the shape of an orange fruit. Preferably the Container can be constructed from a clear, tinted, transparent and/or translucent material, though such is not considered limiting and the Container and also be constructed from a opaque material (clear, transparent, translucent, opaque materials can also be used with any of the Containers described herein and/or shown in the drawings and with any Container that the novel child safety Cover of FIGS. 30 through 81 is used with). Preferably, the contents (which as shown can be a candy—though not considered limiting) contained within the container are orange-flavored and/or orange in color, such that the shape of the Container matches or otherwise corresponds to the flavor and/or color of the contents contained within the Container, and an opening can be provided at the bottom (or another location on the Container) of the orange Container which can possesses threads or a threaded member for securing a threaded cap in order to close the opening. The novel child safety Cover shown in FIGS. 30 through 81 can also be used with this Container, as well as any other Container shown in FIGS. 1 through 29. When a person wishes to remove a piece of candy, the cap is unscrewed and access to the candy is provided. Since the color and flavor of the candy matches the shape of the Container, the person upon seeing the Container is immediately informed of the flavor candy contained in the Container. Other threaded and non-threaded caps, lids, covers, etc. can be provided and secured to the Container. The Container is not considered limited to any particular type of cap, spout, cover, etc. and all are considered within the scope of the disclosure, as well as the way they are attached to the container. Also, the opening and cover are preferably located at the bottom of the container. Additionally, the outer surface of the cap/cover can be planar or flat and of sufficient size such that it provides a stable surface for standing the container up on its own.

Figure 4:
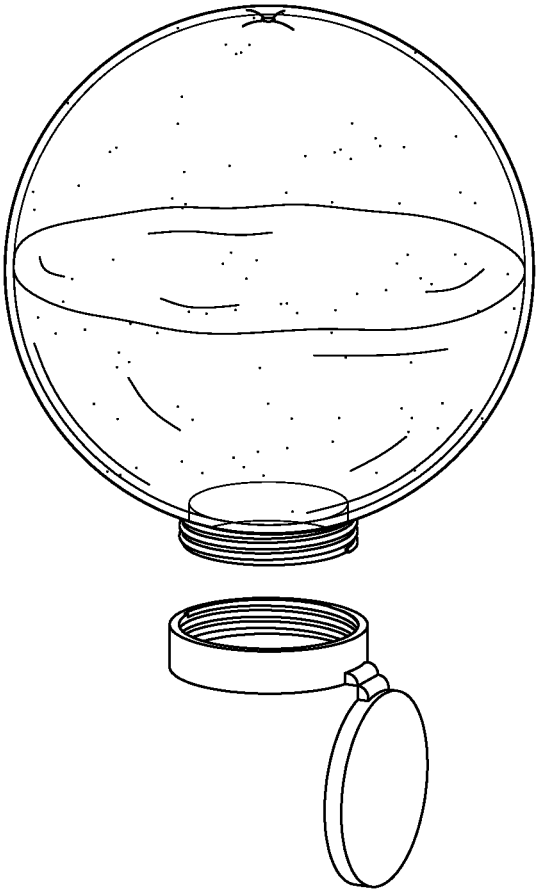
FIG. 4 is an exploded perspective view of the orange shaped container of FIG. 1 showing a different content contained within, as compared to the content contained within the container in FIG. 1.
Figure 5:
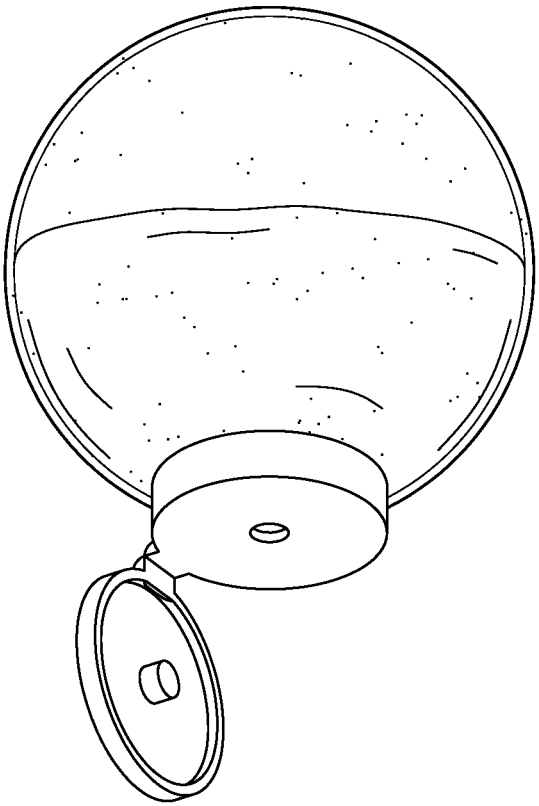
FIG. 5 is a bottom perspective view of the orange shaped container of FIG. 4.

FIGS. 4-5 shown the orange shaped Container housing a fluid and provided with a different non-limiting type of cap as compared to the cover/lid shown in FIGS. 1-3.

Figure 6:
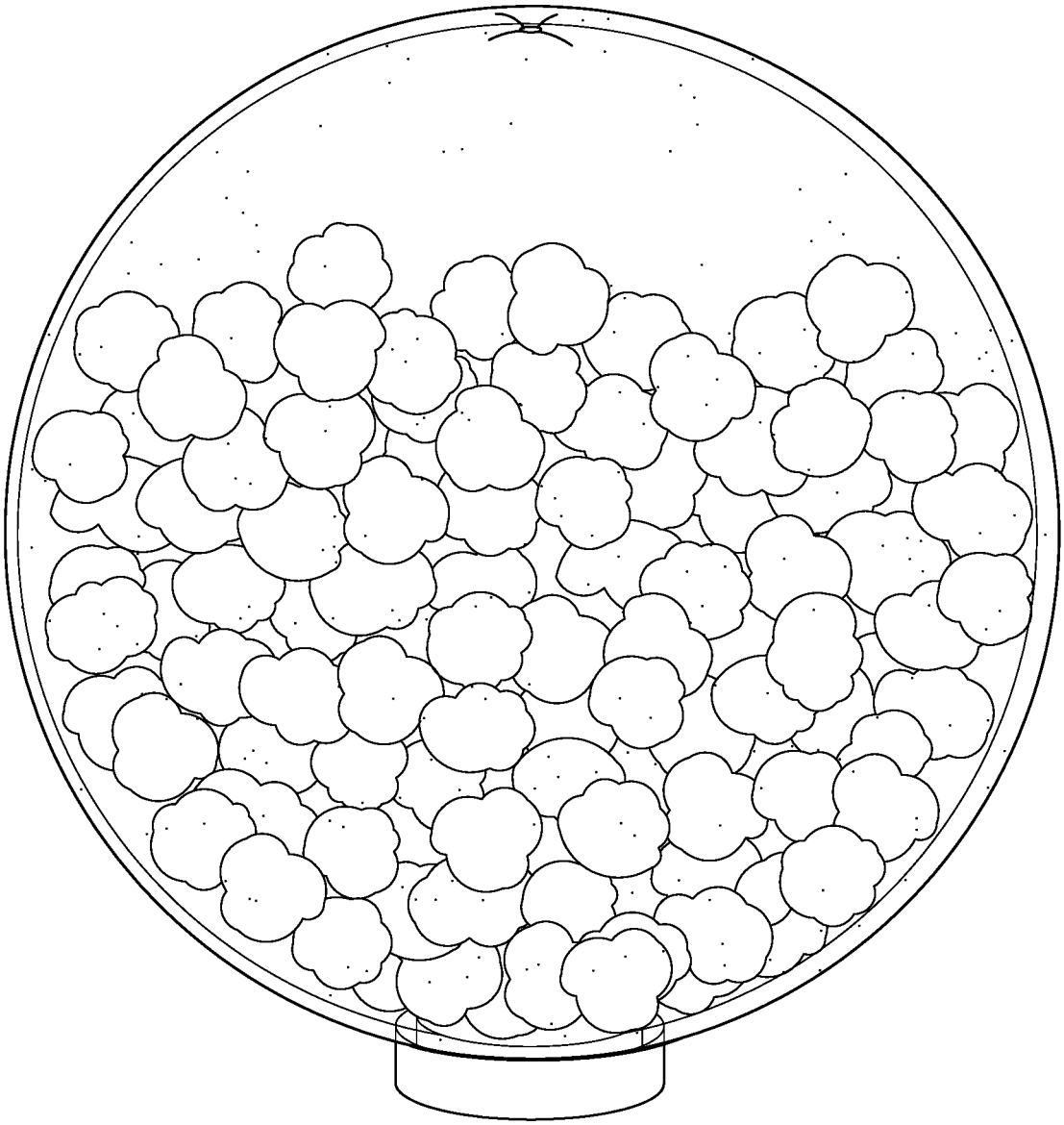
FIG. 6 is a perspective view of the orange shaped container of FIG. 1 housing a different content than the content housed by the container in FIG. 1.

FIG. 6 shows the orange shaped Container housing popcorn which preferably can be orange flavored and/or orange in color.

Figure 7:
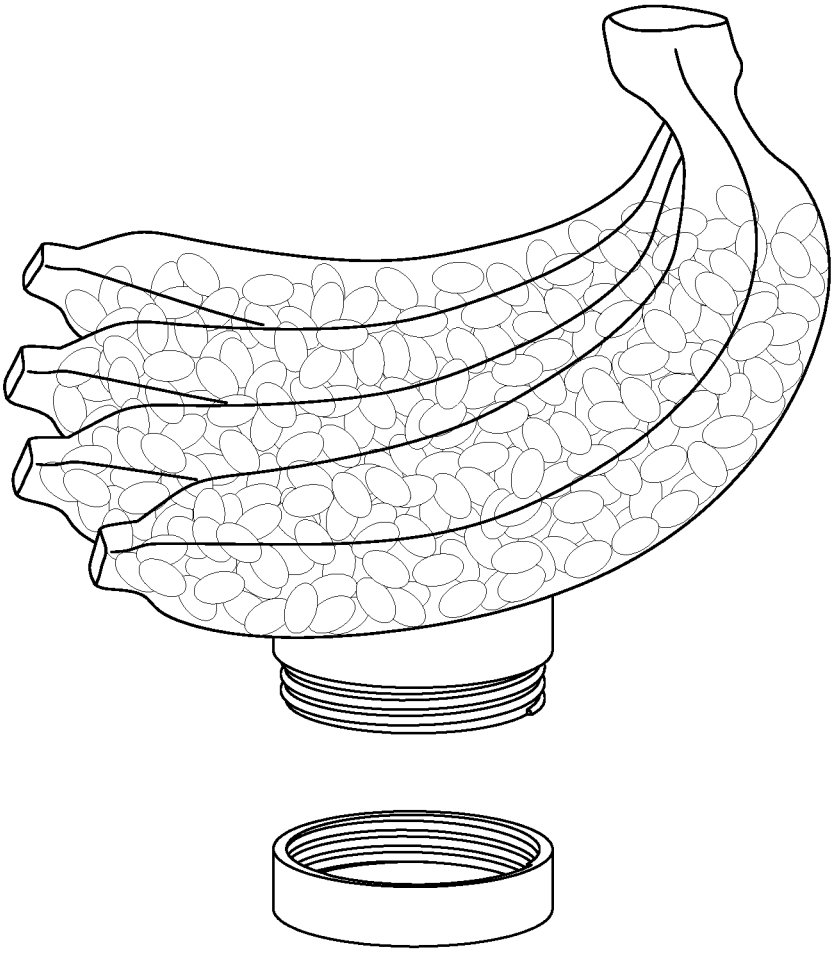
FIG. 7 is an exploded perspective view of a second non-limiting embodiment for the novel packaging/container in accordance with the present disclosure and illustrating a group of bananas shape for the container.
Figure 8:
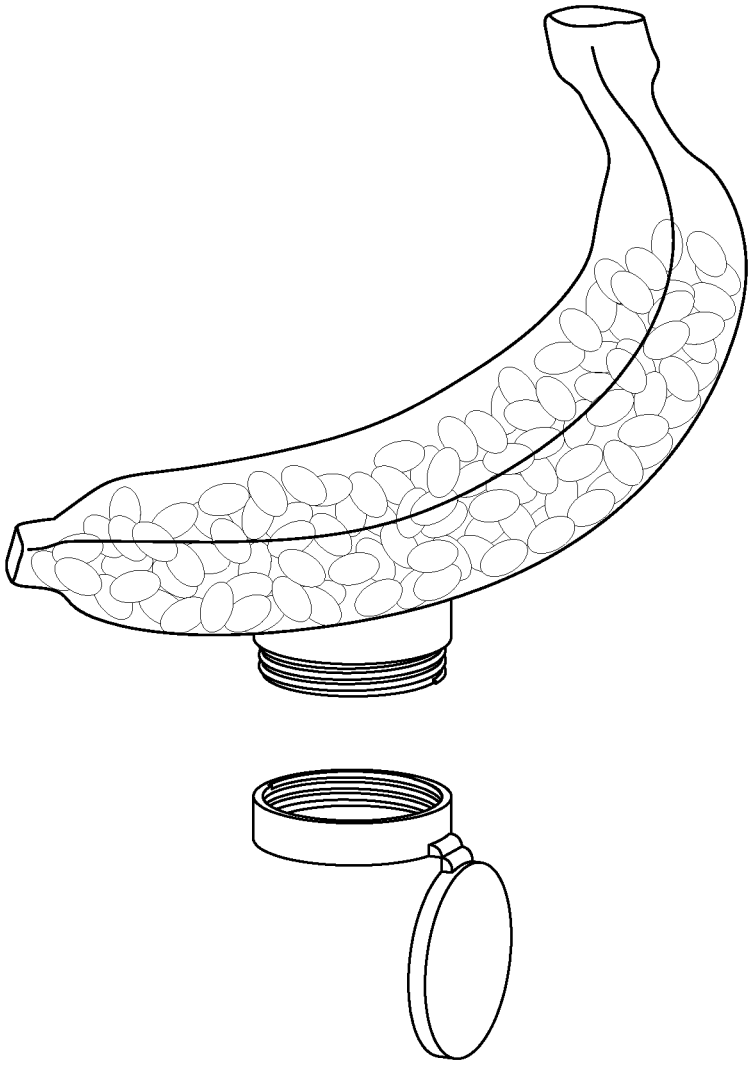
FIG. 8 is an exploded perspective view of a third non-limiting embodiment for the novel packaging/container in accordance with the present disclosure and illustrating a banana shape for the container.

FIG. 7 shows the Container shaped like a group of bananas and housing a preferably banana flavor and/or yellow candy or jelly beans. Similarly, FIG. 8 shows the Container having the shape of a single banana and housing the same contents as the group of bananas shaped Container of FIG. 7.

Figure 9:
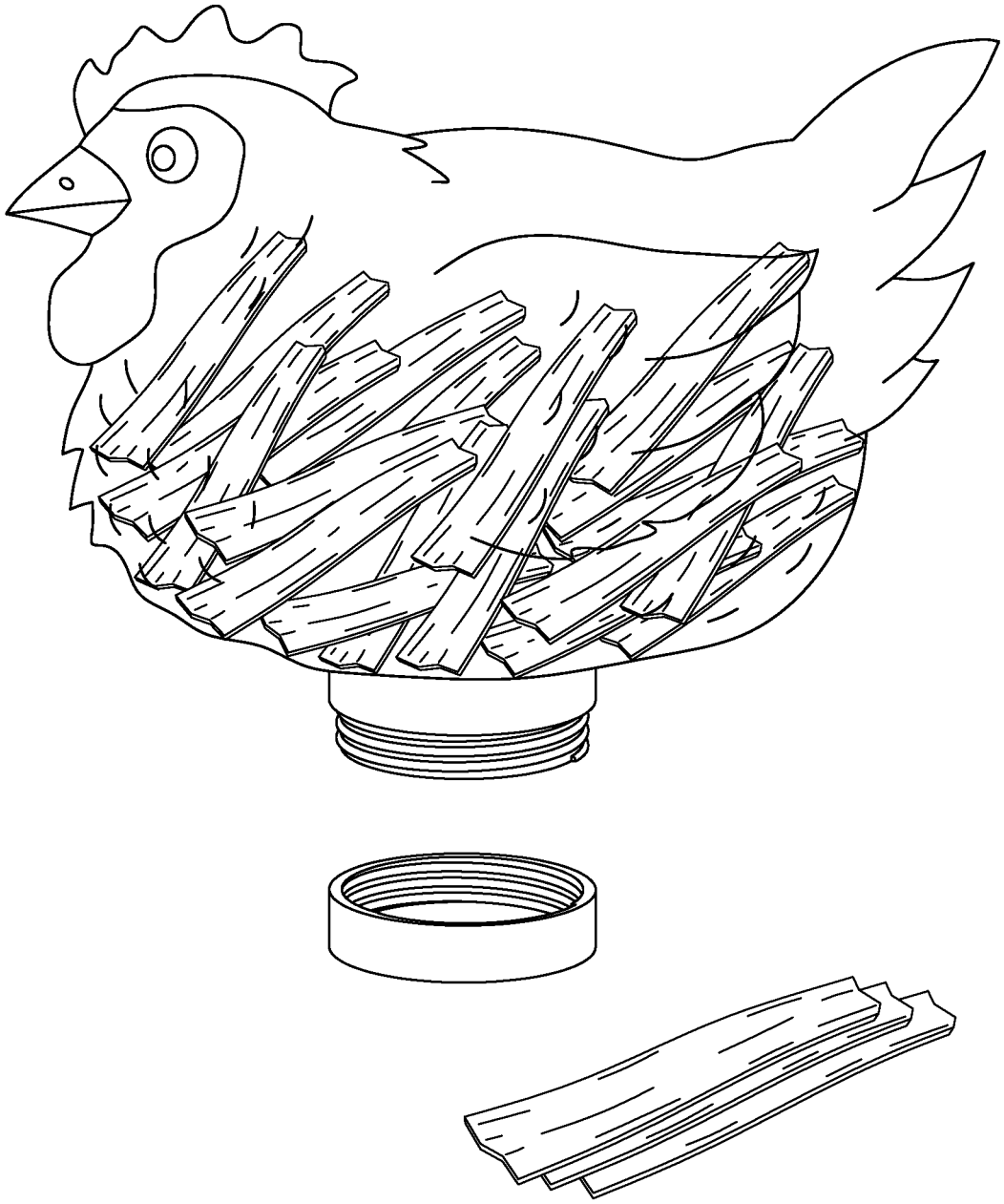
FIG. 9 is an exploded perspective view of a fourth non-limiting embodiment for the novel packaging/container in accordance with the present disclosure and illustrating a chicken shape for the container
Figure 10:
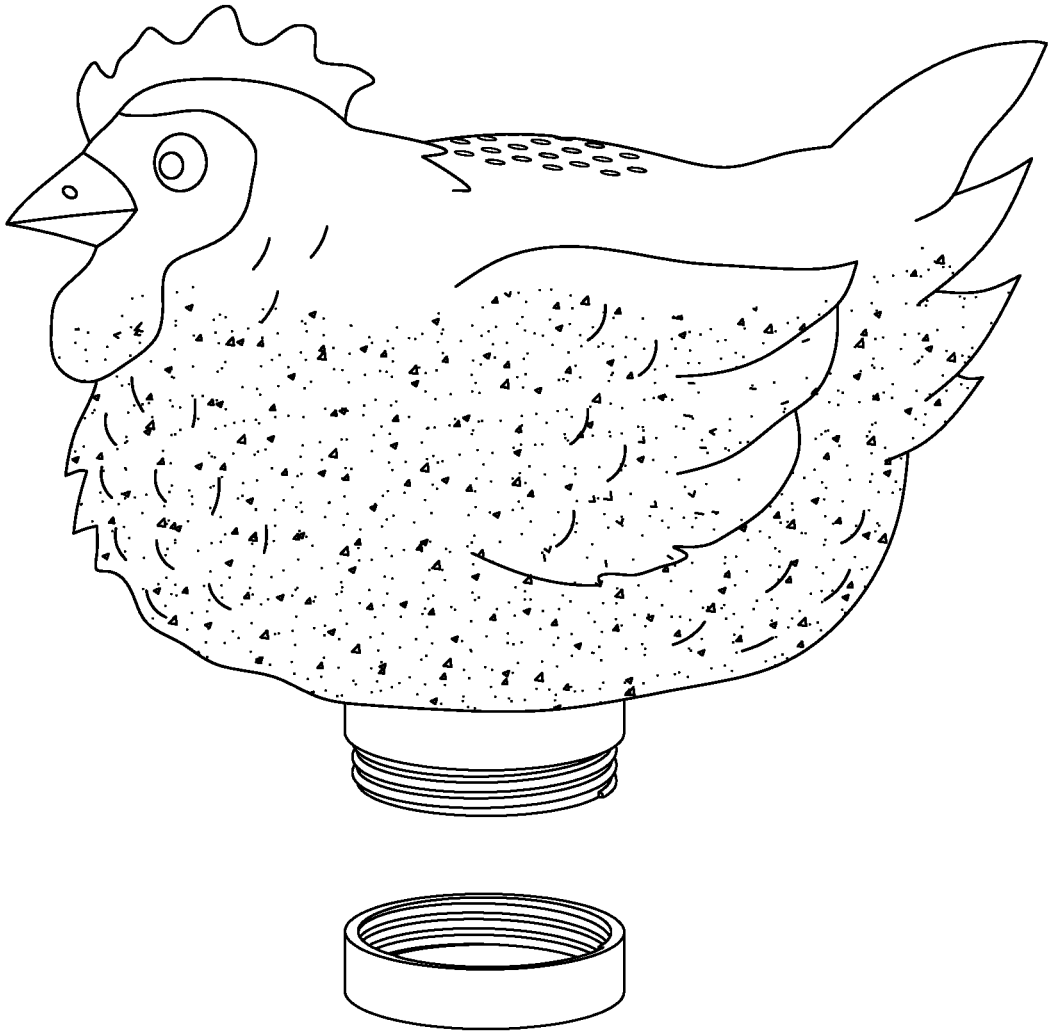
FIG. 10 is an exploded view of the chicken shaped container of FIG. 9 showing a different content contained within container as compared to the content contained in the container of FIG. 9.
Figure 11:
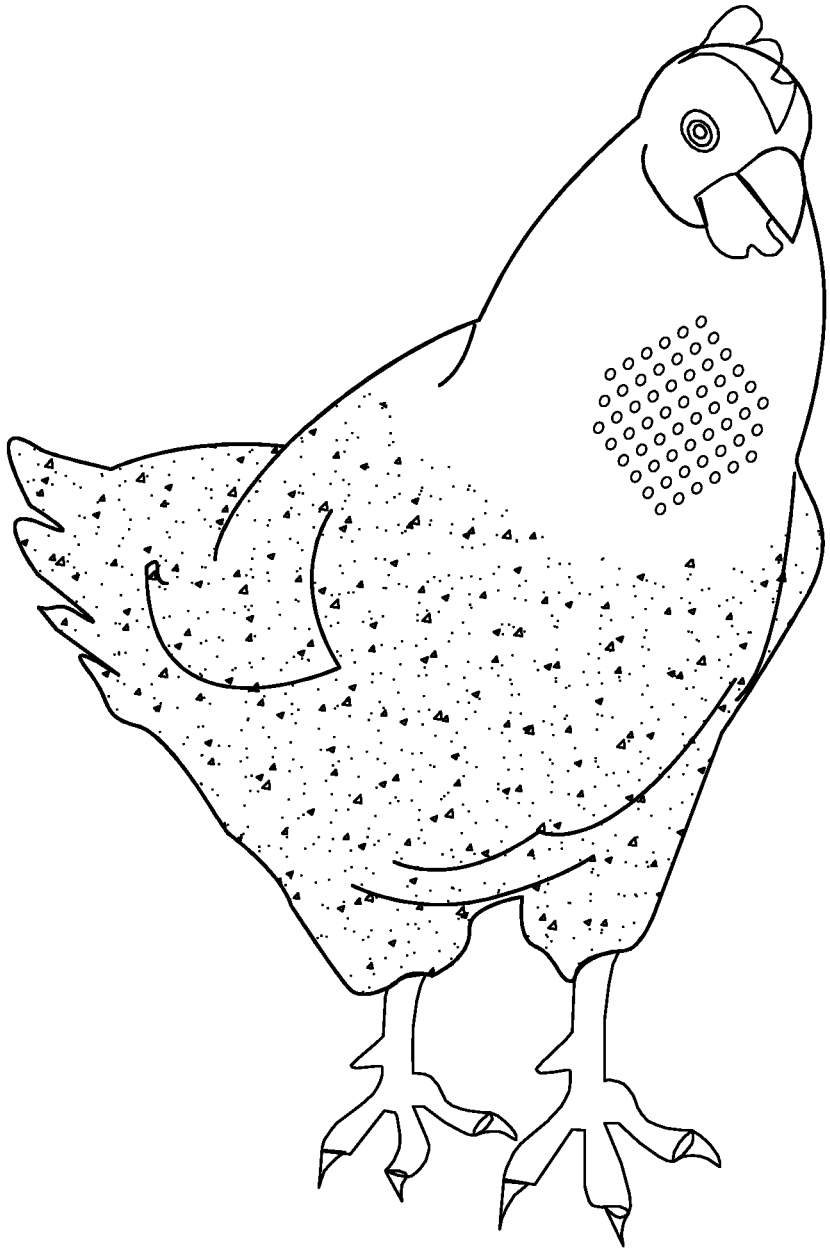
FIG. 11 is a front perspective view of a fifth non-limiting embodiment for the novel packaging/container in accordance with the present disclosure and illustrating a second chicken shape for the container.

FIG. 9 shows a chicken-shaped Container housing chicken-flavored jerky. FIG. 10 shows the chicken-shaped Container used for a seasoning or spice used with chicken dishes. FIG. 11 also shows a chicken-shaped Container and uses the legs of the chicken as stands for the Container in lieu of a bottom located cap surface as described above.

Figure 12:
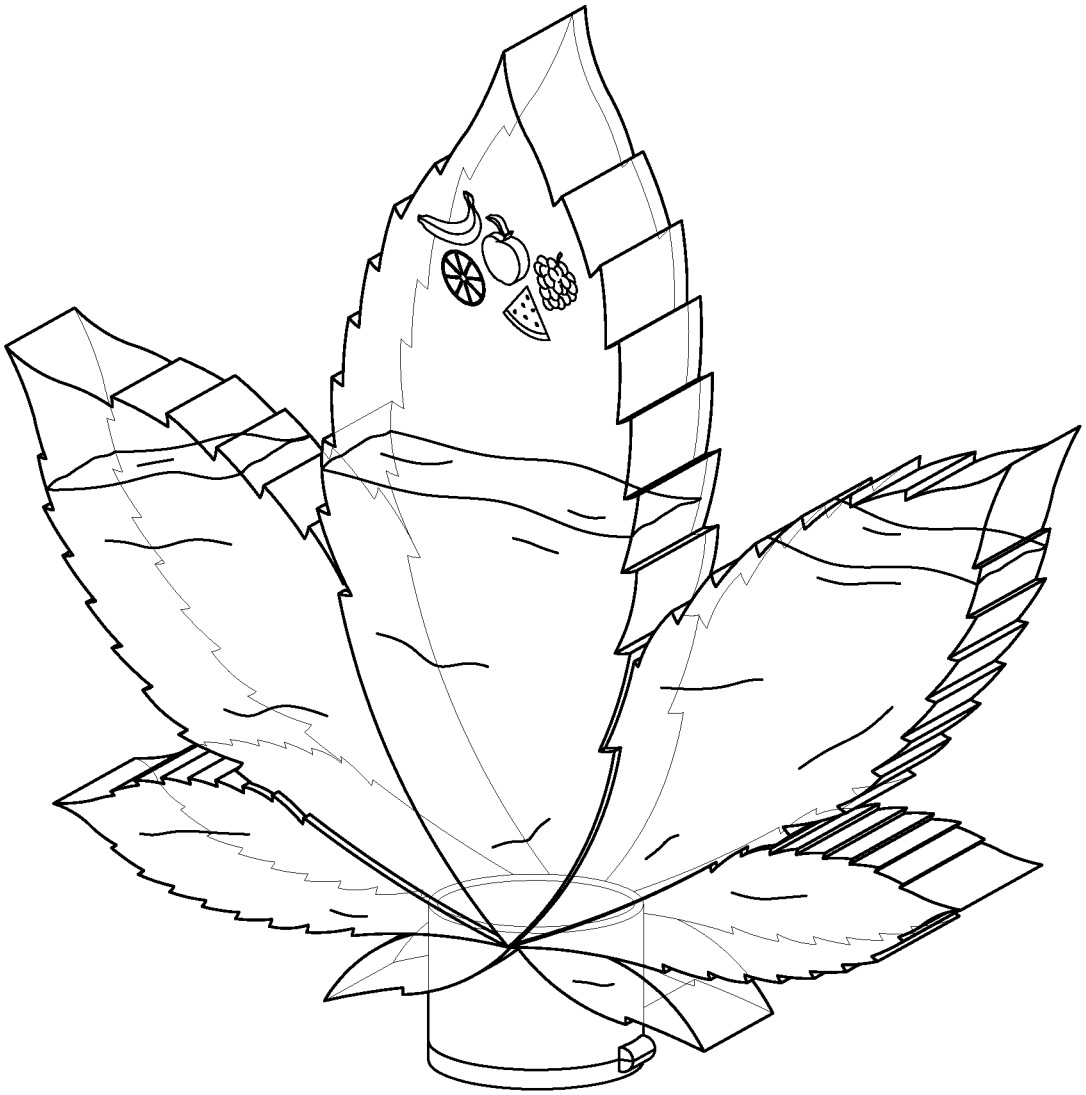
FIG. 12 is a front perspective view of a sixth non-limiting embodiment for the novel packaging/container in accordance with the present disclosure and illustrating a leaf design for the container.
Figure 13:
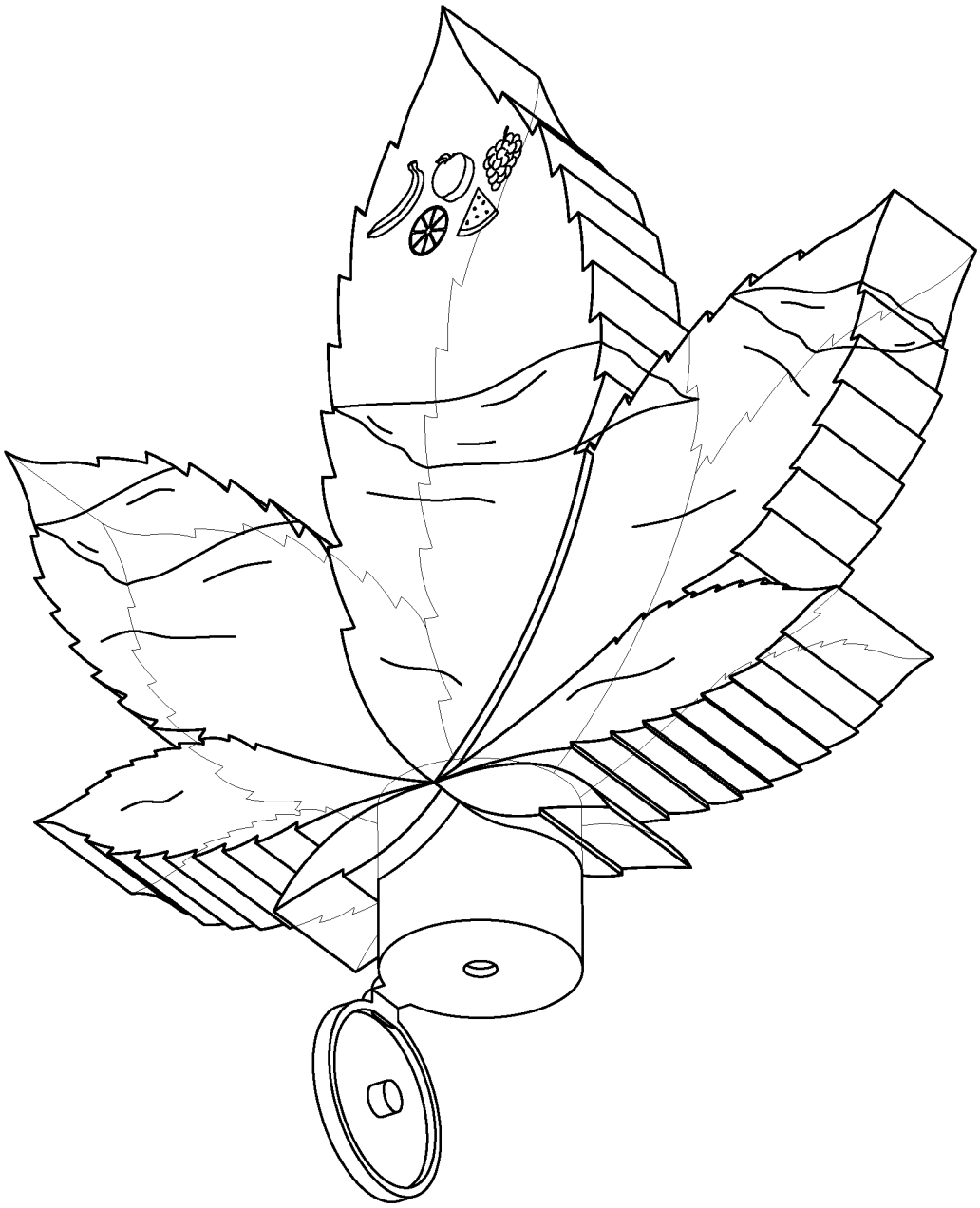
FIG. 13 is another perspective view of the leaf shaped container of FIG. 12.
Figure 14:
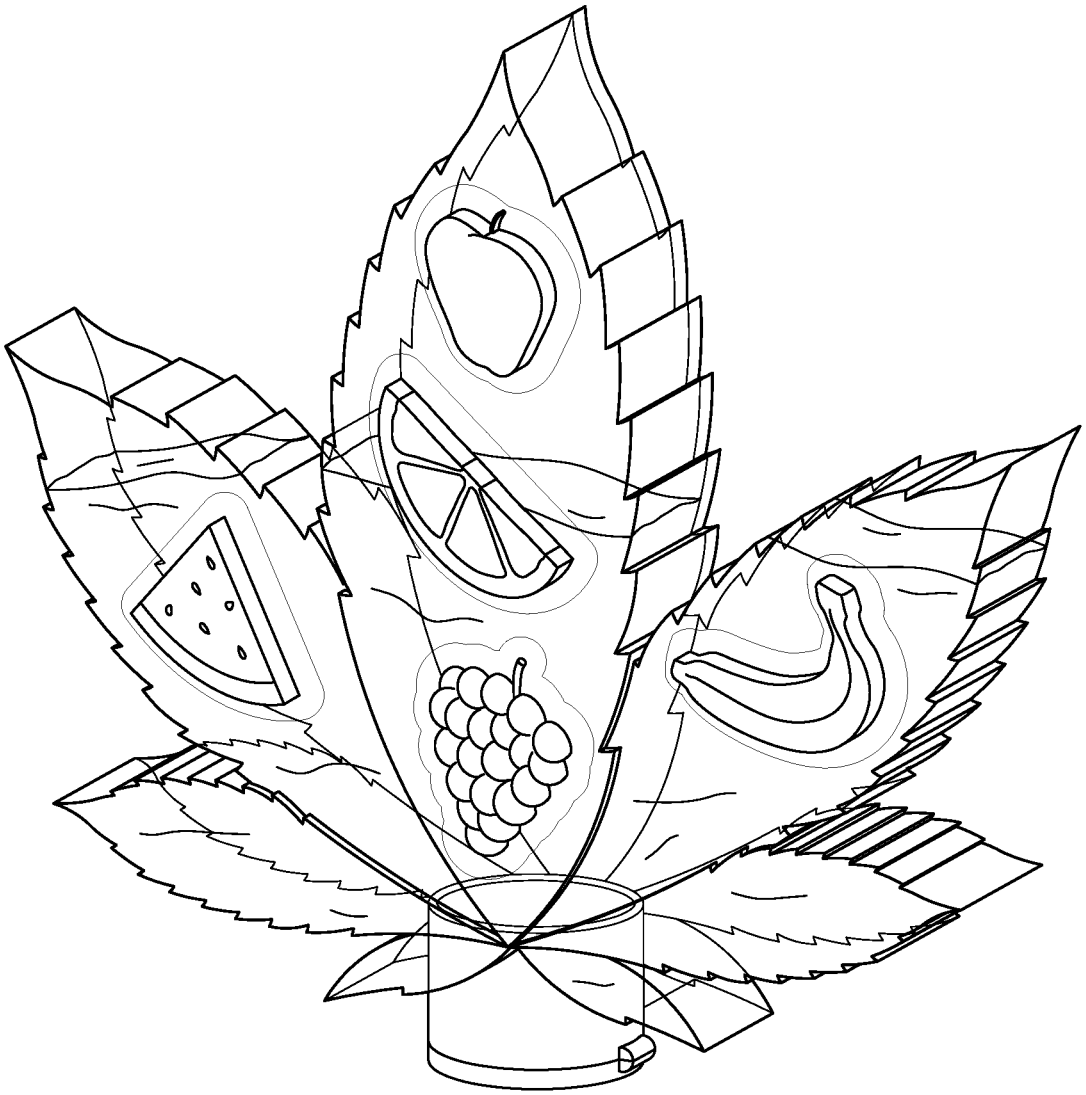
FIG. 14 is a front perspective view of a seventh non-limiting embodiment for the novel packaging/container in accordance with the present disclosure and illustrating another leaf design for the container.
Figure 15:
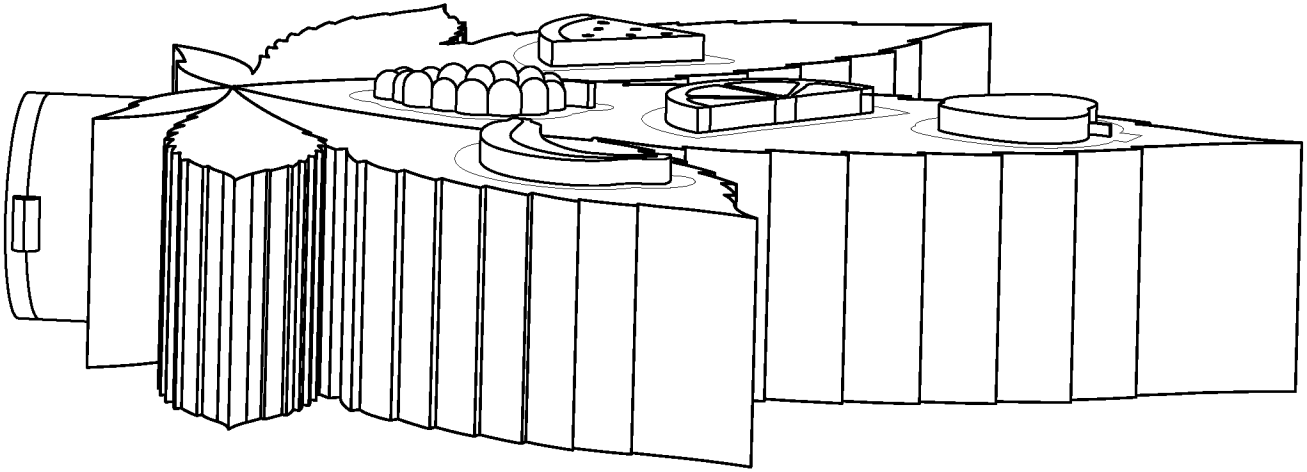
FIG. 15 is a side perspective view of the leaf shaped container of FIG. 14.

FIGS. 12 and 13 show a first embodiment for a leaf-shaped Container. The liquid or other content contained within the Container can be chosen from one of several fruit flavors. For this embodiment, the fruit flavor choices are represented as two dimensional labels, stickers, artwork, etc. preferably disposed at the top of the center leaf (though such is not considered limiting). FIGS. 14 and 15 illustrate another embodiment for the leaf-shaped Container. In this embodiment, the fruit selections are formed as fruit-shaped protrusions extending out of surface of the Container. The protrusions can be formed by any now known or later-developed technology. The five fruits represented and seen in FIG. 12 through 15 are only shown by way of example and any fruit capable of being used for the flavor of the contents can be used and shown in two-dimensional form (FIGS. 12 and 13) or three-dimensional form (FIGS. 14 and 15).

Figure 16:
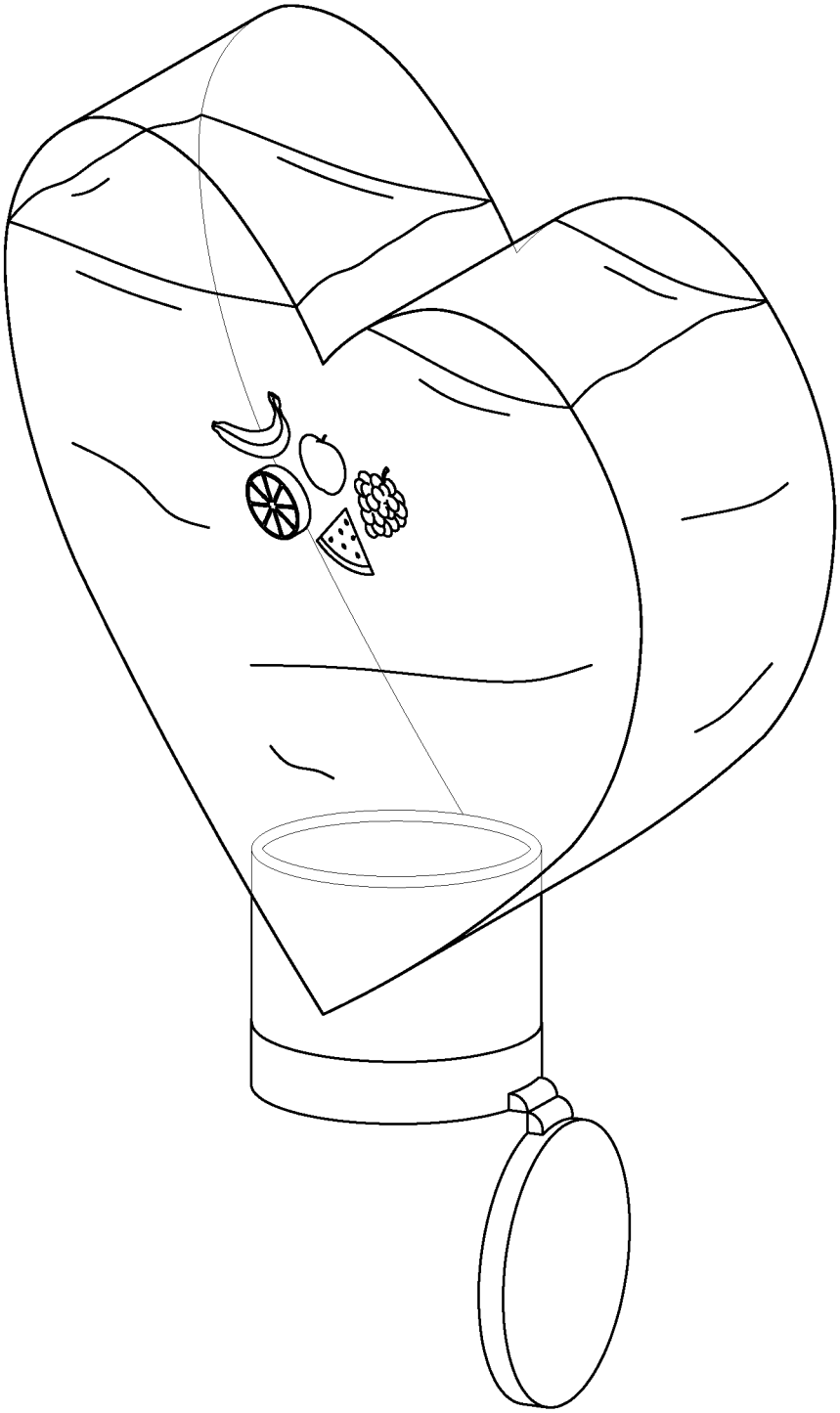
FIG. 16 is a front perspective view of an eighth non-limiting embodiment for the novel packaging/container in accordance with the present disclosure and illustrating a heart shape design for the container.
Figure 17:
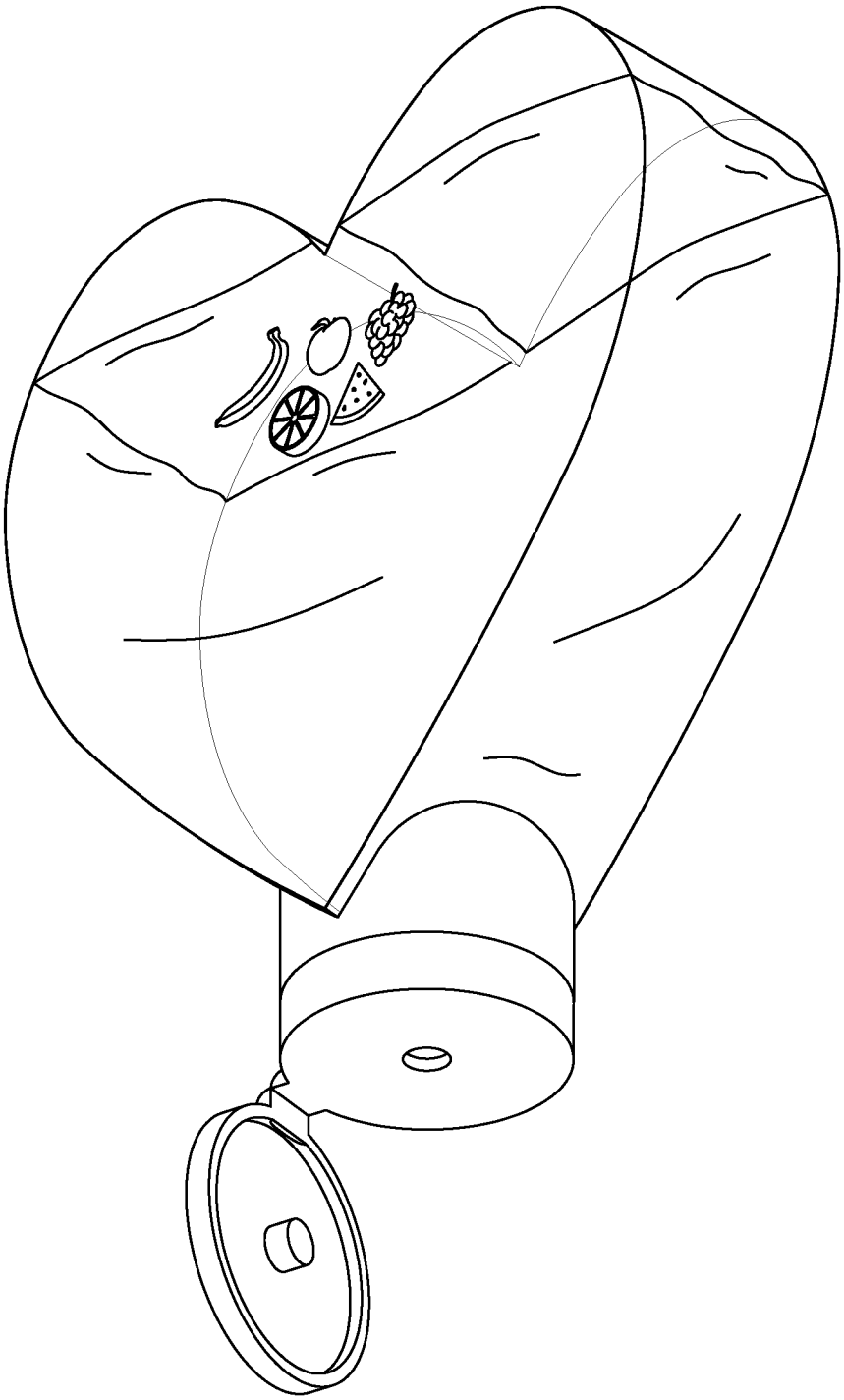
FIG. 17 is another perspective view of the heart shaped container of FIG. 16.
Figure 18:
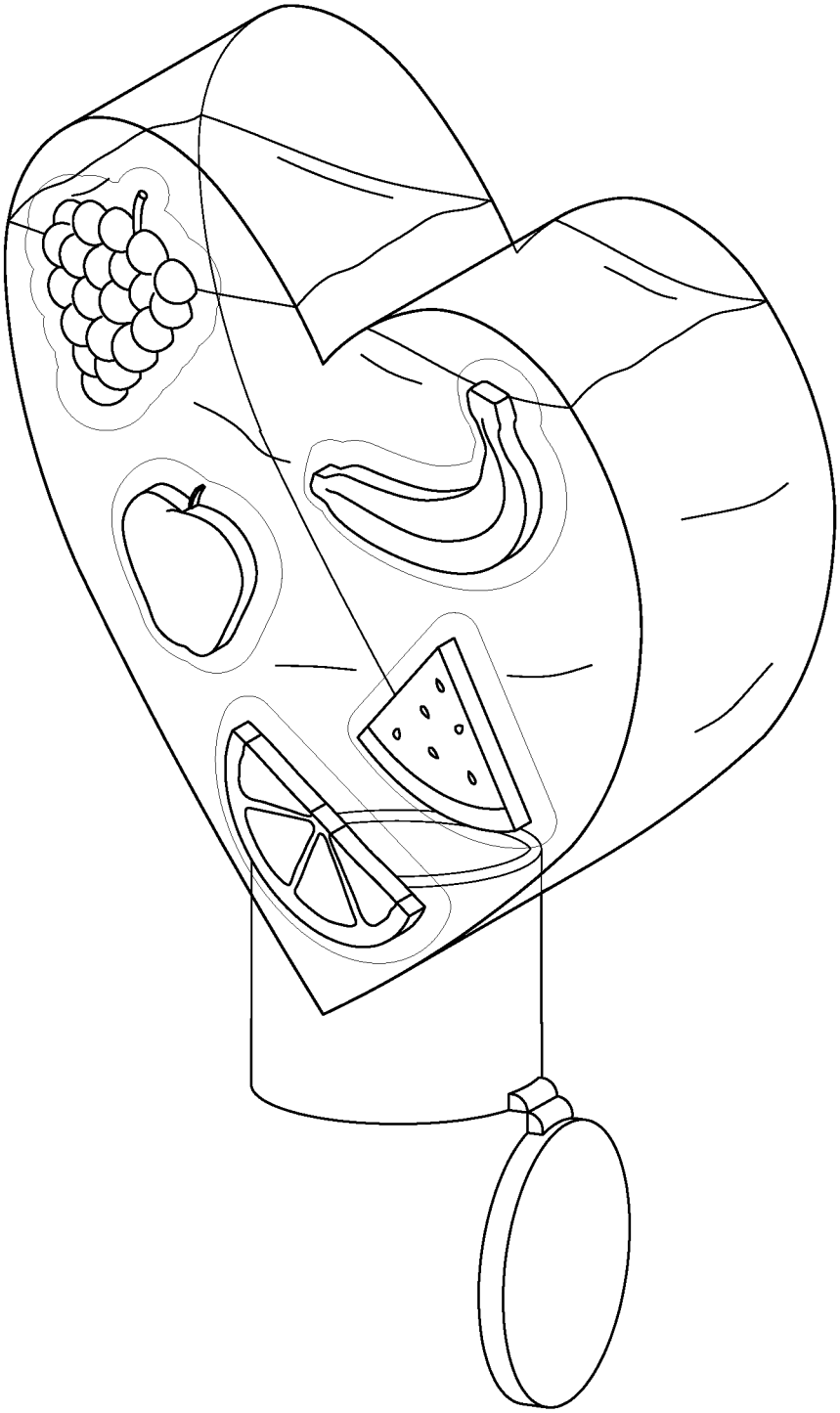
FIG. 18 is a front perspective of a tenth non-limiting embodiment for the novel packaging/container in accordance with the present disclosure and illustrating a further heart shape design for the container.
Figure 19:
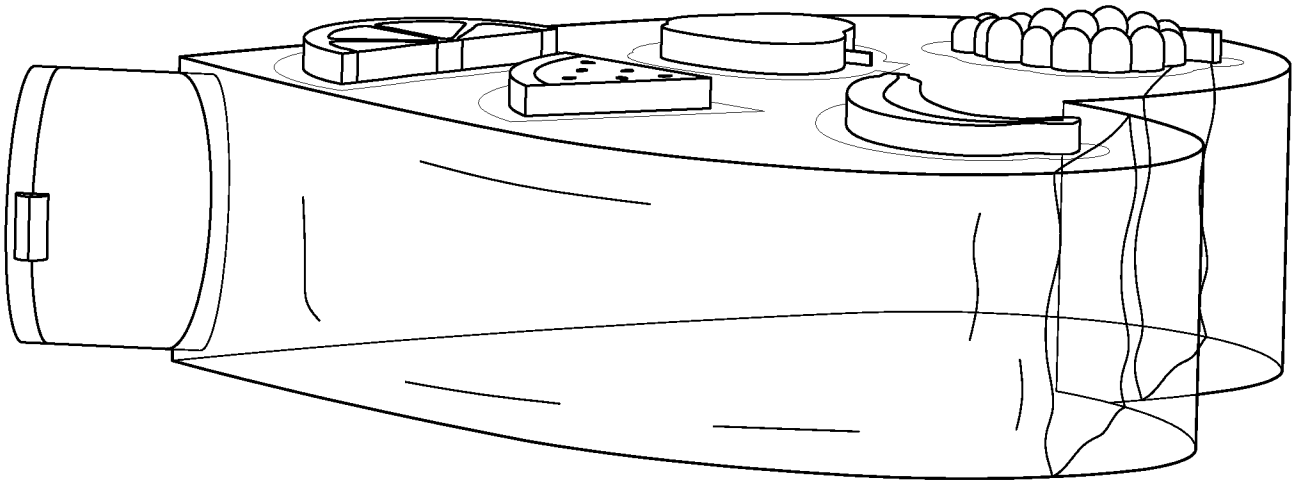
FIG. 19 is a side perspective view of the heart shaped container of FIG. 18.
Figure 20:
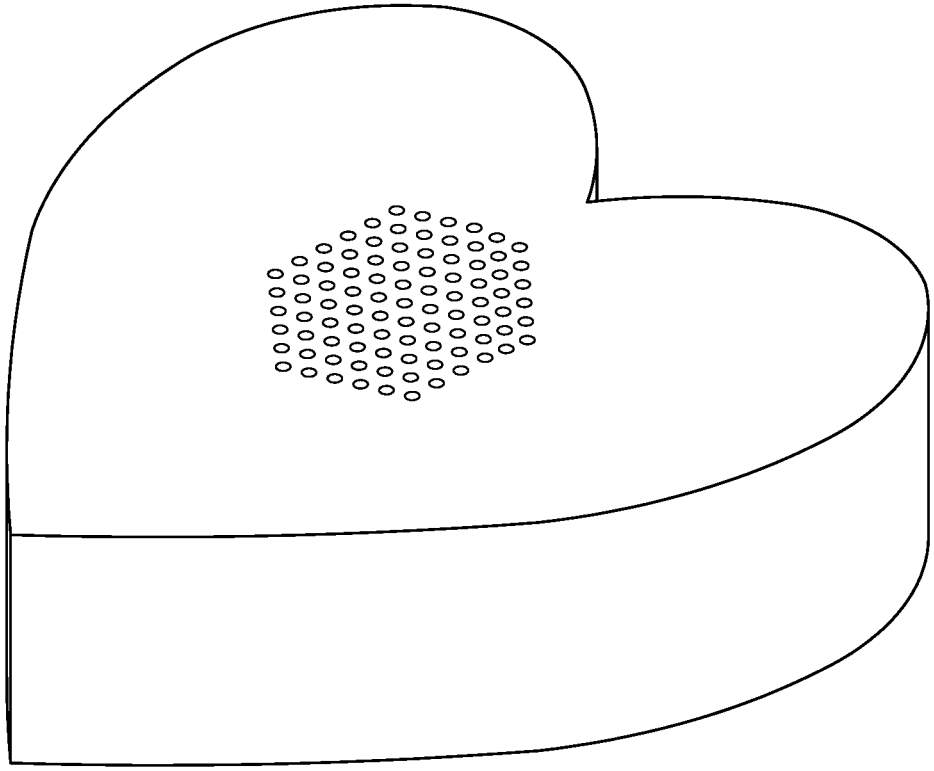
FIG. 20 is a front perspective of a ninth non-limiting embodiment for the novel packaging/container in accordance with the present disclosure and illustrating another heart shape design for the container.

FIGS. 16 and 17 show a first embodiment for a heart shaped Container. The liquid or other content contained within the Container can be chosen from one of several fruit flavors. For this embodiment, the fruit flavor choices are represented as two dimensional labels, stickers, artwork, etc. FIGS. 18 and 19 illustrate another embodiment for the heart-shaped Container. In this embodiment, the fruit selections are formed as fruit-shaped protrusions extending out of surface of the Container. The protrusions can be formed by any now known or later developed technology. The five fruits represented and seen in FIG. 16 through 19 are only shown by way of example and any fruit capable of being used for the flavor of the contents can be used and shown in two-dimensional form (FIGS. 16 and 17) or three-dimensional form (FIGS. 18 and 19). FIG. 20 shows the heart shaped Container used in connection with a spice, seasoning, etc. and provided with small apertures commonly used for dispensing spices, seasonings from bottles.

Figure 21:
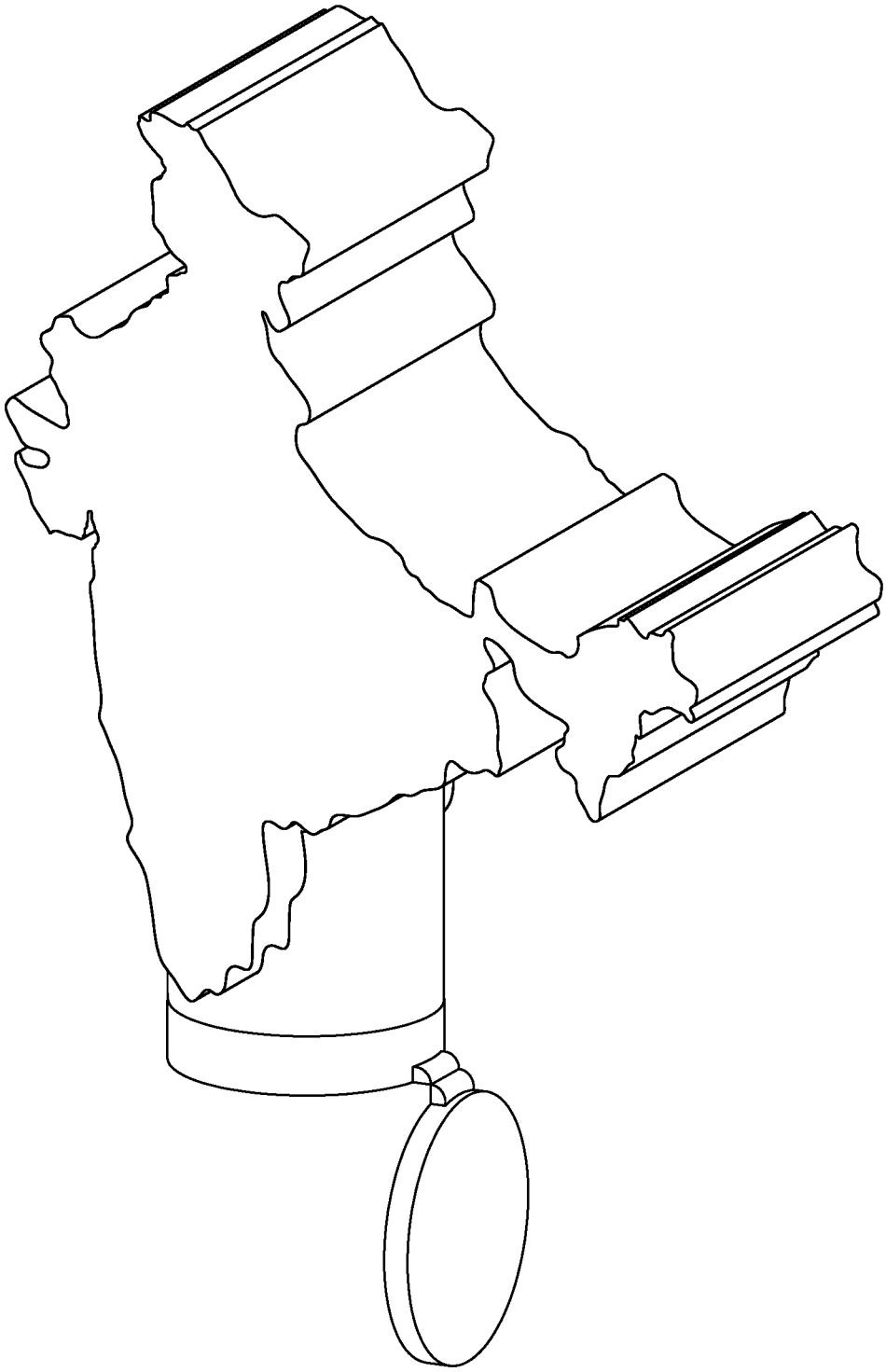
FIG. 21 is a front perspective of an eleventh non-limiting embodiment for the novel packaging/container in accordance with the present disclosure and illustrating the shape of the country India for the container shape design.
Figure 22:
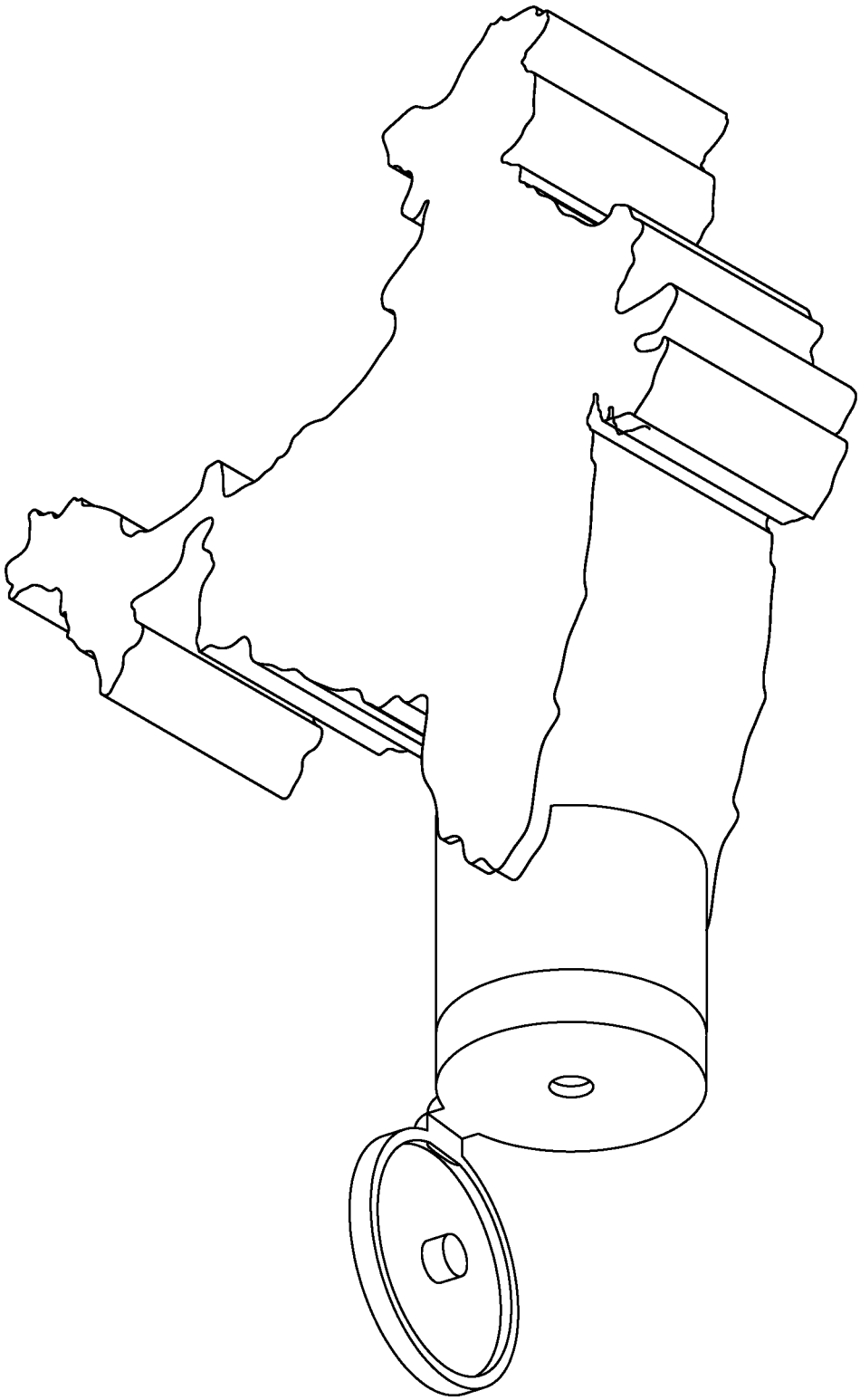
FIG. 22 is another perspective view of the country of India shaped container of FIG. 21.
Figure 23:
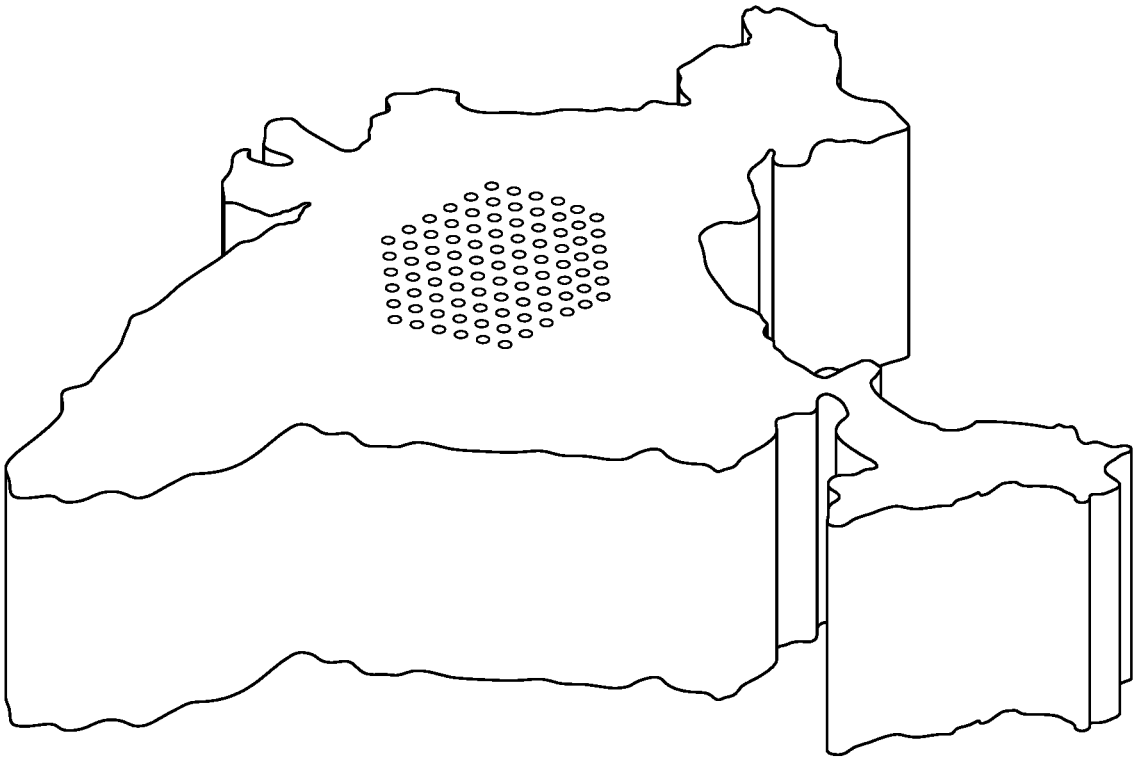
FIG. 23 is a twelfth non-limiting embodiment for the novel packaging/container in accordance with the present disclosure and illustrating another country of India shape design for the container.

FIGS. 21 and 22 show a country shaped Container. Other geographical shapes besides a country can also be used and are considered within the scope of the disclosure. As a non-limiting example, the country selected is India and in a non-limiting embodiment the contents can be a spice that originates in India such that there is a corresponding/match connection between the Container shape and the contents stored/housed in the Container. FIG. 23 shows the country-shaped Container used in connection with a spice, seasoning, etc. and provided with small apertures commonly used for dispensing spices and/or seasonings from bottles.

Figure 24:
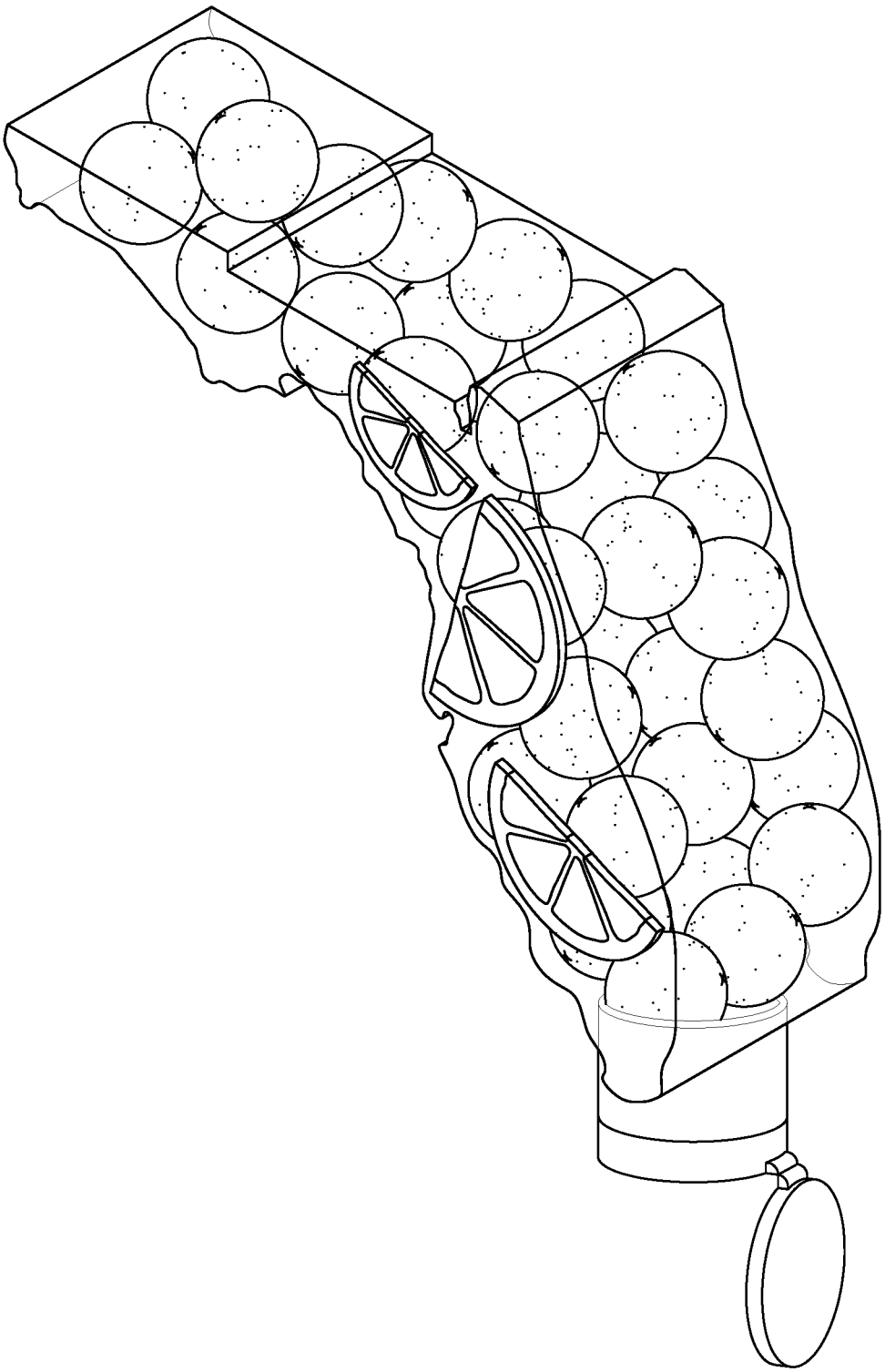
FIG. 24 is a front perspective of a thirteenth non-limiting embodiment for the novel packaging/container in accordance with the present disclosure and illustrating the State of Florida for the container shape design.
Figure 25:
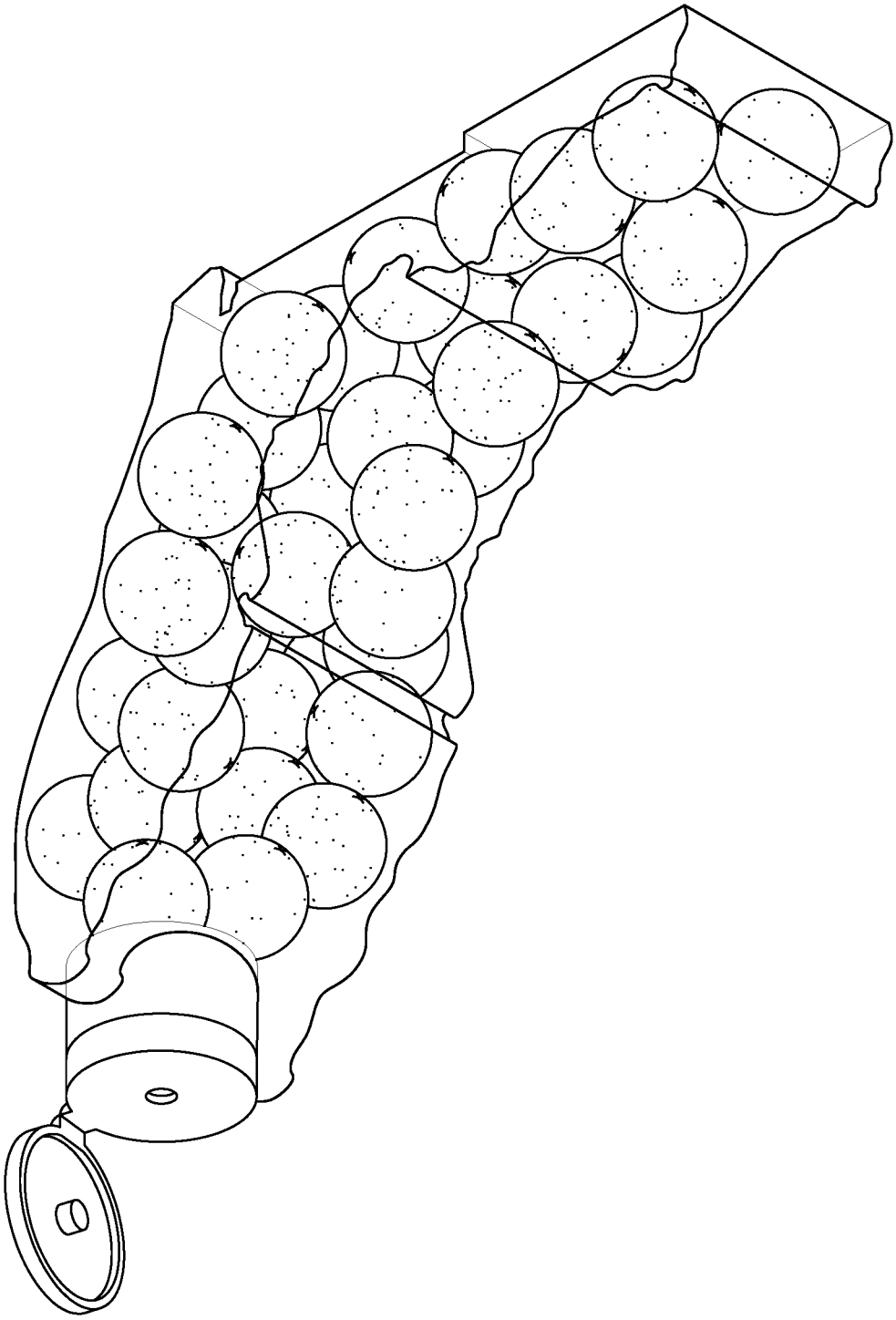
FIG. 25 is another perspective view of the State of Florida shaped container of FIG. 24.

FIGS. 24 and 25 show a state of the United States used for the Container shape and in this non-limiting embodiment, the state of Florida is selected. A front surface of the Container is shown having a plurality of orange fruit slices protruding outward similarly to the fruit in FIGS. 18 and 19. The orange fruit is selected given that Florida is known for oranges and corresponds to the orange flavor content contained within the Container.

Though the Containers are shown with the fruit (two-dimensional or three-dimensional) appearing on one of the surfaces of the Container, such is not considered limiting. Thus, the fruit images can appear on all of the surfaces or some of the surfaces of the Container and all configurations and surface combinations are considered within the scope of the disclosure. Additionally, the types of fruits selected are not considered limiting and the size of the fruit with respect to the size of the Container is not considered limiting and various types of fruit and various sizes for the fruit can be selected and all are considered within the scope of the disclosure. Furthermore, the fruits contained on a single Container can be of varying size and all do not have to be the same size.

Figure 26:
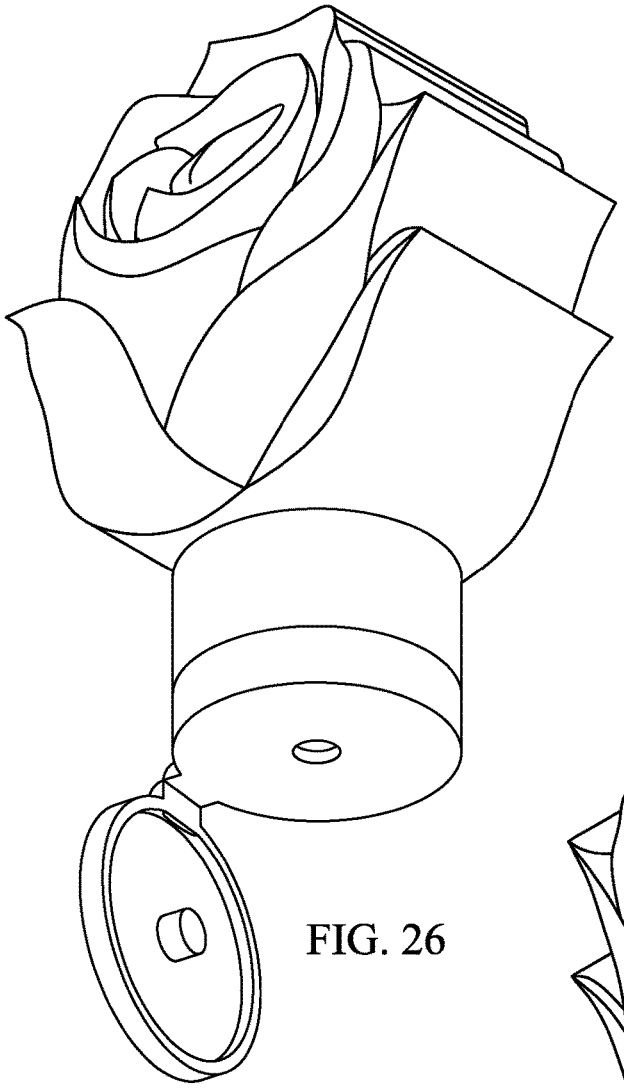
FIG. 26 is a front perspective of a fourteenth non-limiting embodiment for the novel packaging/container in accordance with the present disclosure and illustrating a flower/rose shape for the container.
Figure 27:
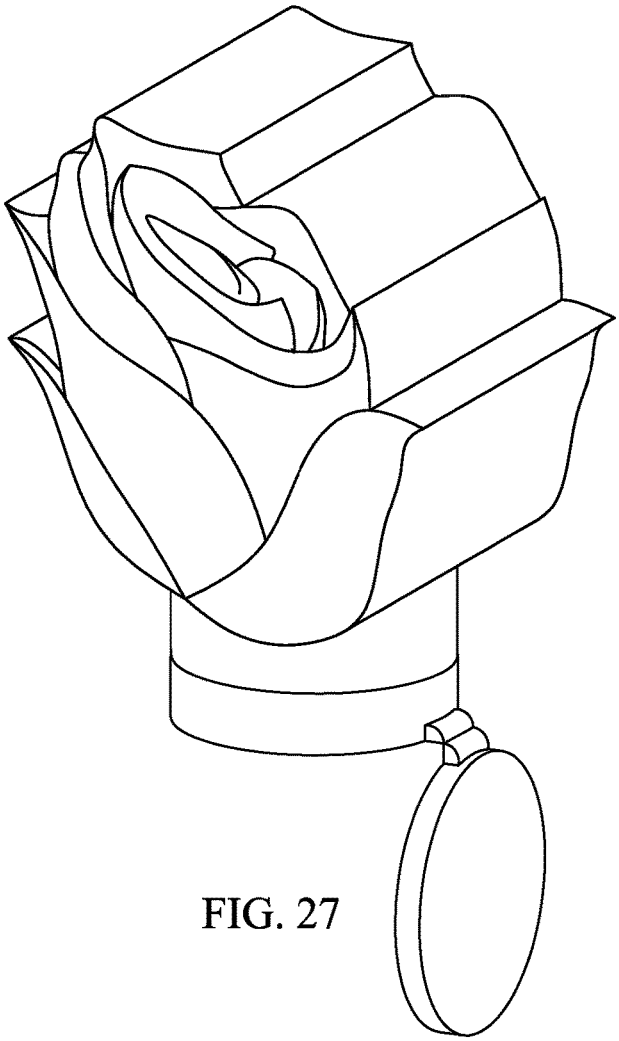
FIG. 27 is another perspective view of the flower/rose shaped container of FIG. 26.
Figure 28:
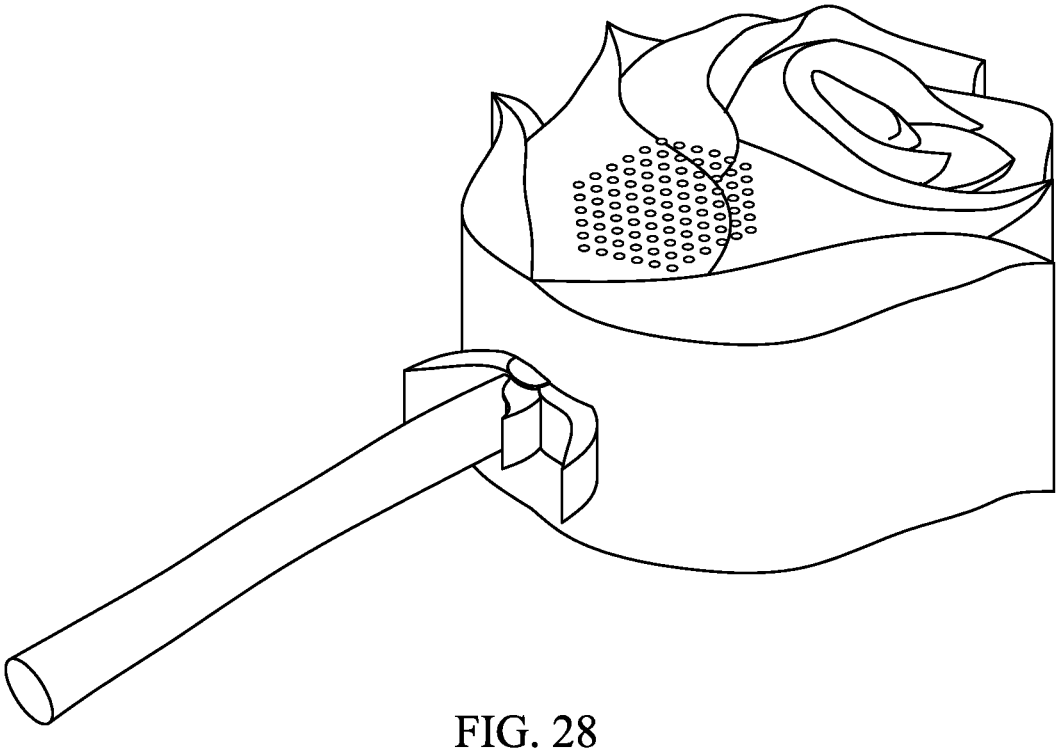
FIG. 28 is a fifteenth non-limiting embodiment for the novel packaging/container in accordance with the present disclosure and illustrating another flower/rose shape design for the container.

FIGS. 26 and 27 show a flower-shaped Container, such as a rose-shaped Container, though such flower is not considered limiting and other types of flowers can be chosen for the Container shape and are considered within the scope of the disclosure. The Container is shown without a stem. FIG. 28 shows the flower-shaped Container with a stem.

FIG. 29 is a front perspective sectional view showing of a gift basket containing some of the novel Containers described and/or shown herein. Other Containers can also be used for the gift basket and are considered within the scope of the disclosure. When the Containers are within the basket have bottom openings, preferably the bottom openings are hidden from view (i.e. hidden with filler material placed within the basket) so that they do not distract or otherwise affect the aesthetic appearance(s) of the custom-shaped Containers.

The disclosure is not considered limited to any particular content. Additionally, features shown on one Container embodiment can also be used for another Container embodiment (i.e. caps, spout, fruit design on surface, etc.).

The contents contained within the Container are not considered limited to food or edible products and can also include other non-food products. For example, fruit-scented wipes (i.e. orange scent) can be housed in an orange-shaped Container and can be provided within a different dispenser commonly found with other packaging used for dispensing wipes.

FIGS. 30 through 81 illustrate a preferred non-limiting embodiment for a novel child safety Cover in accordance with the present disclosure which can be used with any of the Containers shown in FIGS. 1 through 29, as well as other Containers. The cover 100 can comprise a top member 110, a locking member 130, a bottom member 150, a seal member 170 and a locking base 190 formed at the opening of container 250. Container 250 will be referenced to include all types of Containers and not just the container shown in the drawing figures.

Top member 110 can be provided with a first aperture/opening 112 and a second aperture/opening 114 on its top surface which be used for receipt of the tab members 136 and 138 when cover 100 is assembled. The apertures 112 and 114 are large enough to allow movement of tab members 136 and 138 when the tab members are pinched inward by a user during operation of removing the cover 100 from its securement to container 250. One or more pairs of assembly tab 116 and 118 having receiving apertures therein can be provided for connecting to member 110 to bottom member 150 during assembly of the cover 100. Male assembly protrusions 152 and 154 can be received within the apertures of each pair of assembly tabs 116 and 118 for securing bottom member 150 to top member 110. As will be discussed below, prior to securing bottom member 150 to top member 110, locking member 130 is disposed therebetween and separately secured to bottom member 150, such that tab member 136 and 138 are positioned within apertures 112 and 114 of top member 110 and accessible to a user. Top member 110 can also be provided with markings or indicia on its upper surface which can be used for aligning top member 110 (and cover 100) with marking or indicia at opening 252 of container 250 for certain steps in releasing or securing cover 100 at opening 252 of container 250.

Locking member 130 preferably includes a first male locking portion 132 having an outer end which preferably extends beyond the border/periphery 131 of locking member 130 (in an extended orientation) and an opposite end secured to tab 136 and a second male locking portion 134 having an outer end which also extends beyond border/periphery 131 (in an extended orientation) and an opposite end secured to tab 138. A first aperture 140 is provided along periphery 131 and a second aperture 142 is provided along periphery 131 which mate with upward extending protrusions or posts 151 and 153 of bottom member 150 for securing locking member 130 to bottom member 150. Bottom member 150 also includes a sidewall 155 extending along its outer periphery having a first slot or groove opening 156 and a second slot or groove opening 158. When locking member 130 is secured to bottom member 150, the outer end of first male locking portion 132 is inserted through opening 156 or 158 and the outer end of second male locking portion 134 is inserted through the other opening 158 or 156. Outer nubs on the locking portions can act as stop members when they come into contact with sidewall 155. By squeezing or pinching tabs 136 and 138 inward locking portions 132 and 134 are retracted and with enough squeezing/pinching force by the user, the locking portions can be retracted to release their locking configuration. The diameter of locking member 130 can be slightly less than the diameter of sidewall 155 to allow locking member 130 to be disposed within sidewall (with the tabs 136 and 138 squeezed inward so as to retract the locking portions 132 and 134). Preferably, by aligning apertures 140 and 142 with post/protrusions 152 and 154, locking portions 132 and 134 will be aligned with grooves 156 and 158. Bottom member 150 also includes a plurality of cavities 160 and 162 that are preferably accessible (opened) from an undersurface of bottom member 150.

Bottom member 150 also includes a static peg or protrusion member 166 which comes into play in connection with the second locking section for cover 100. Preferably, bottom member 150 comprises at least two peg members 166 spaced apart from each other.

When securing seal member 170 to the bottom of bottom member 150 during assembly, similarly shaped protrusions 172 and 174 are received within cavities 160 and 162 of bottom member 150. Seal member 170 is provided with an outer periphery edge 176. The underneath central area of bottom member 150 can also be provided with a circular groove 159, which can be provided for receipt of the central upward circular flange 178. Seal member 170 in one embodiment can have a central opening. Preferably, protrusions 172 and 174 extend upward from circular flange 178 and cavities 160 and 162 extend from circular groove 159 in bottom member 150, such that protrusions 172 and 174 are received in cavities 160 and 162 and circular flange 178 is received within circular groove. Preferably, when seal member 170 is properly secured to bottom member 150 during assembly a space is provided between the upper surface of seal member 170 and the bottom edge of bottom member 150.

Figure 82:
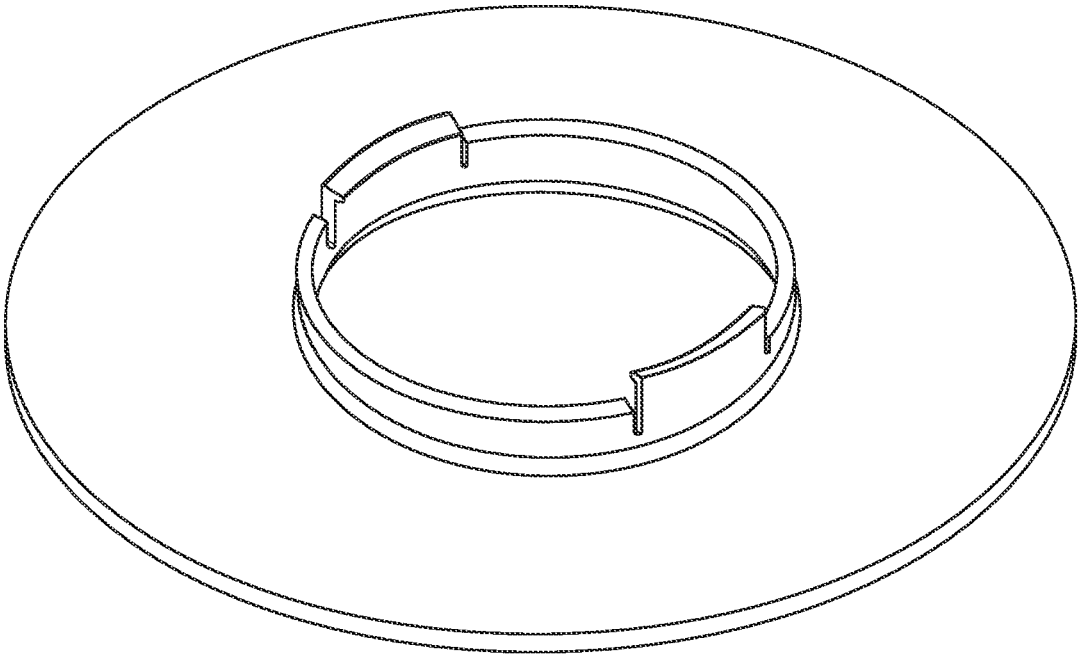
FIGS. 82 through 87 illustrate various views of a preferred another embodiment for the novel Cover in accordance with the present disclosure.
Figure 83:
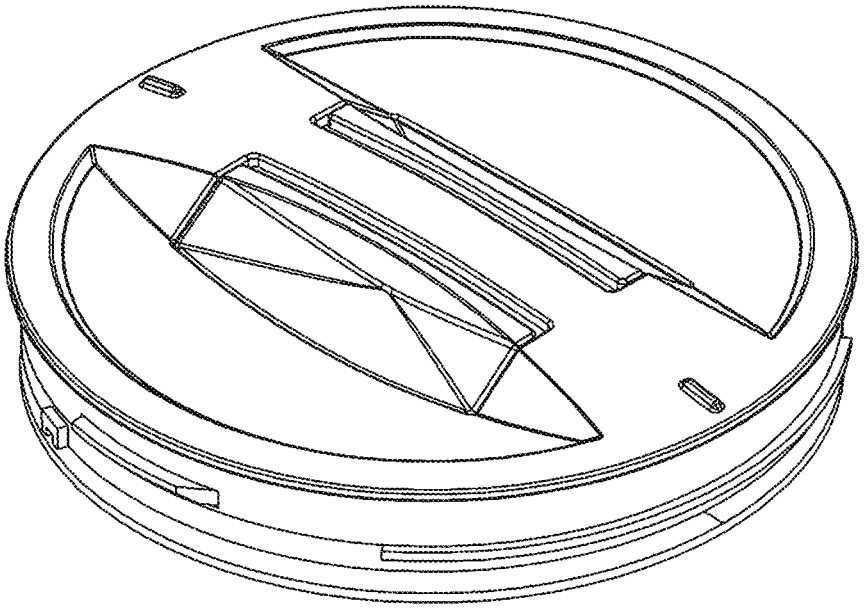
Figure 84:
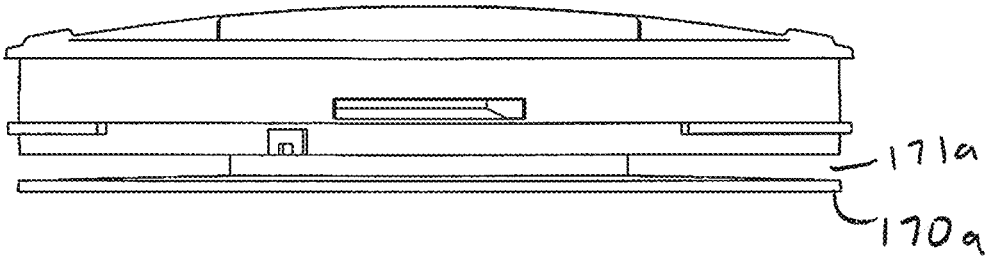
Figure 85:
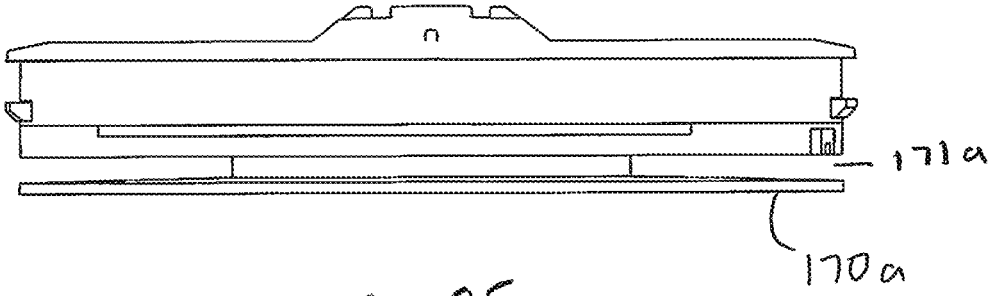
Figure 86:
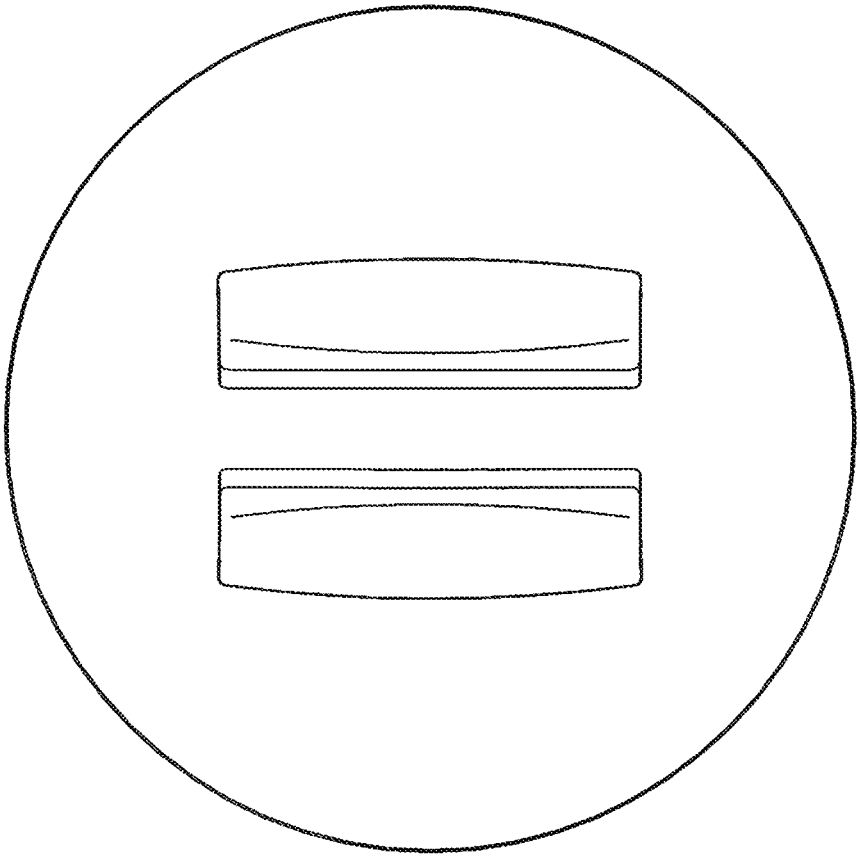
Figure 87:
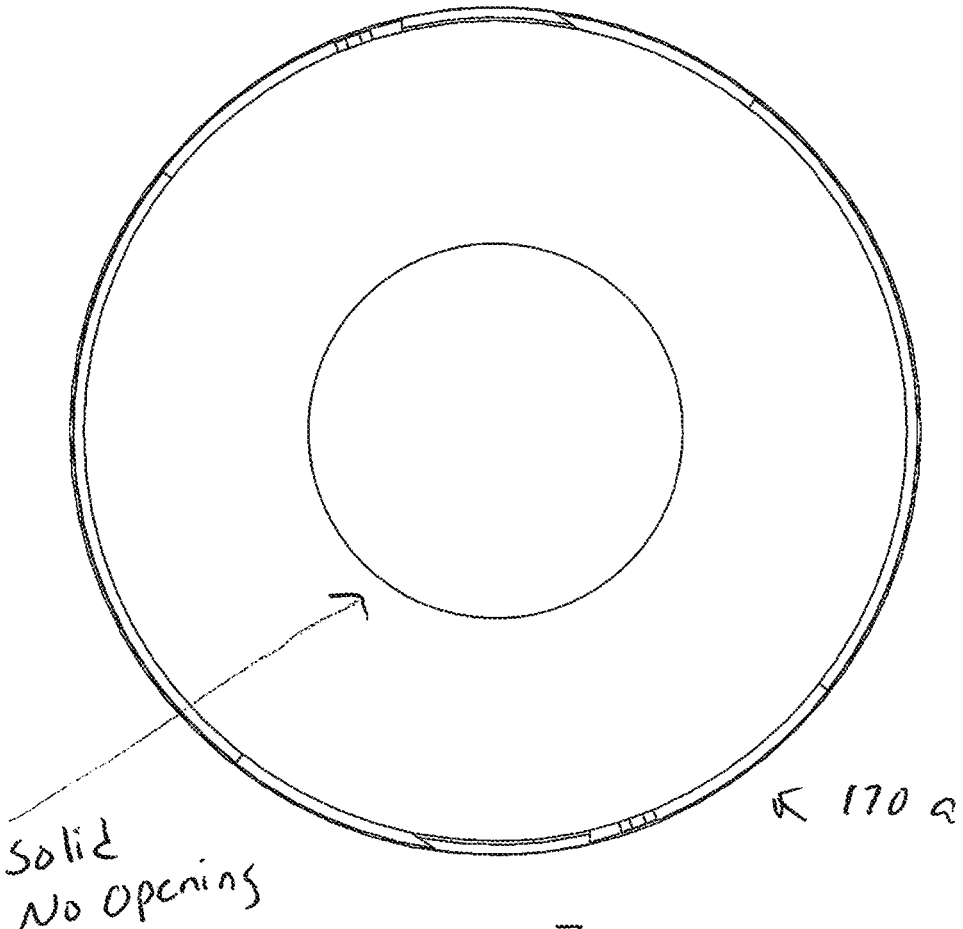
Figure 89:
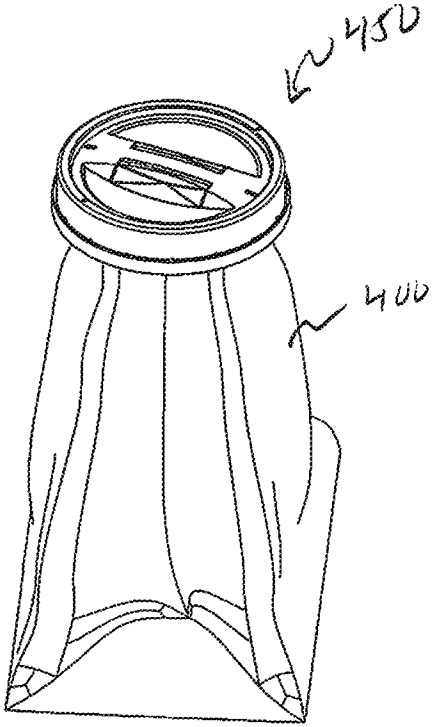
Figure 88:
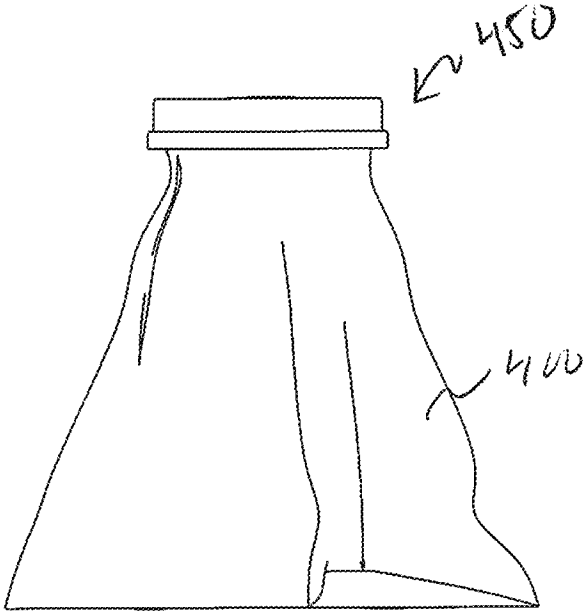
Figure 80:
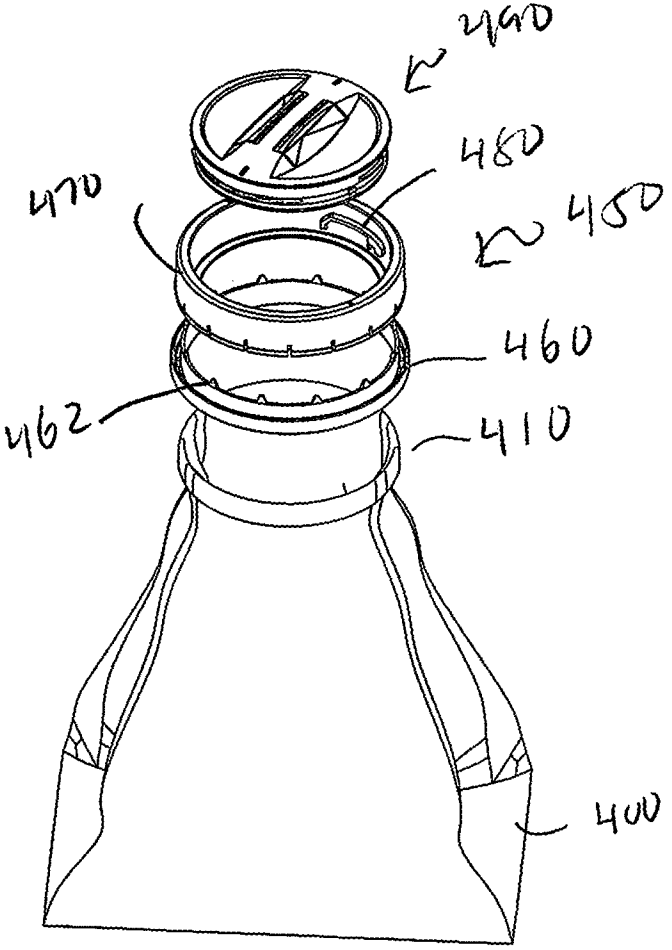
Figure 92:
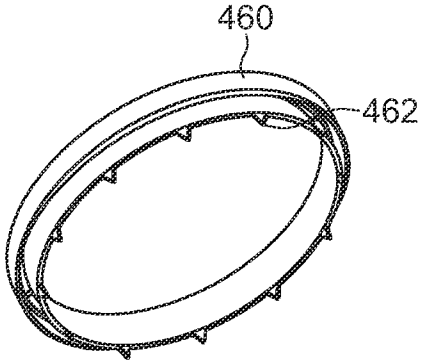
Figure 94:
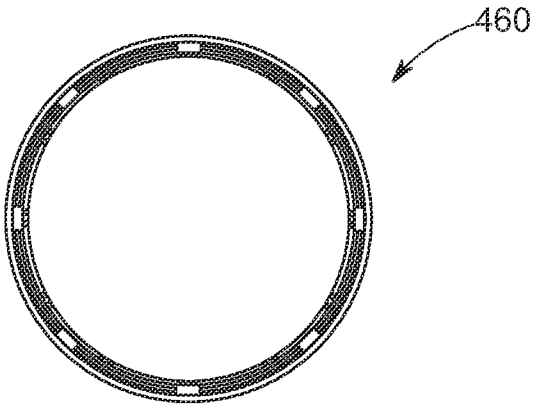
Figure 91:
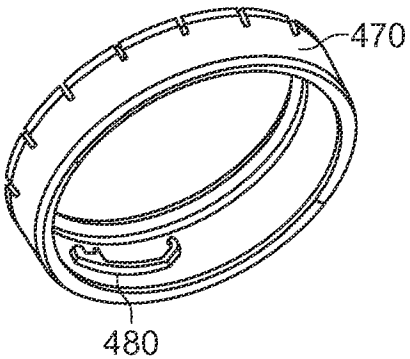
Figure 93:
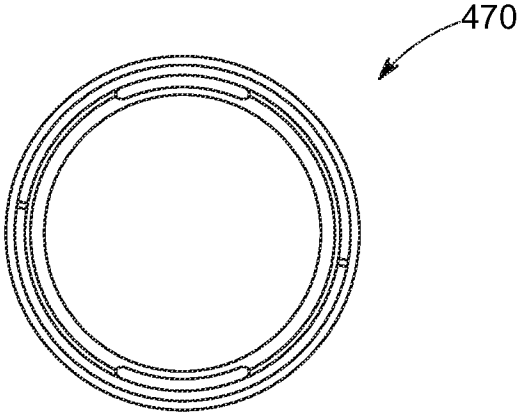
Figure 95:
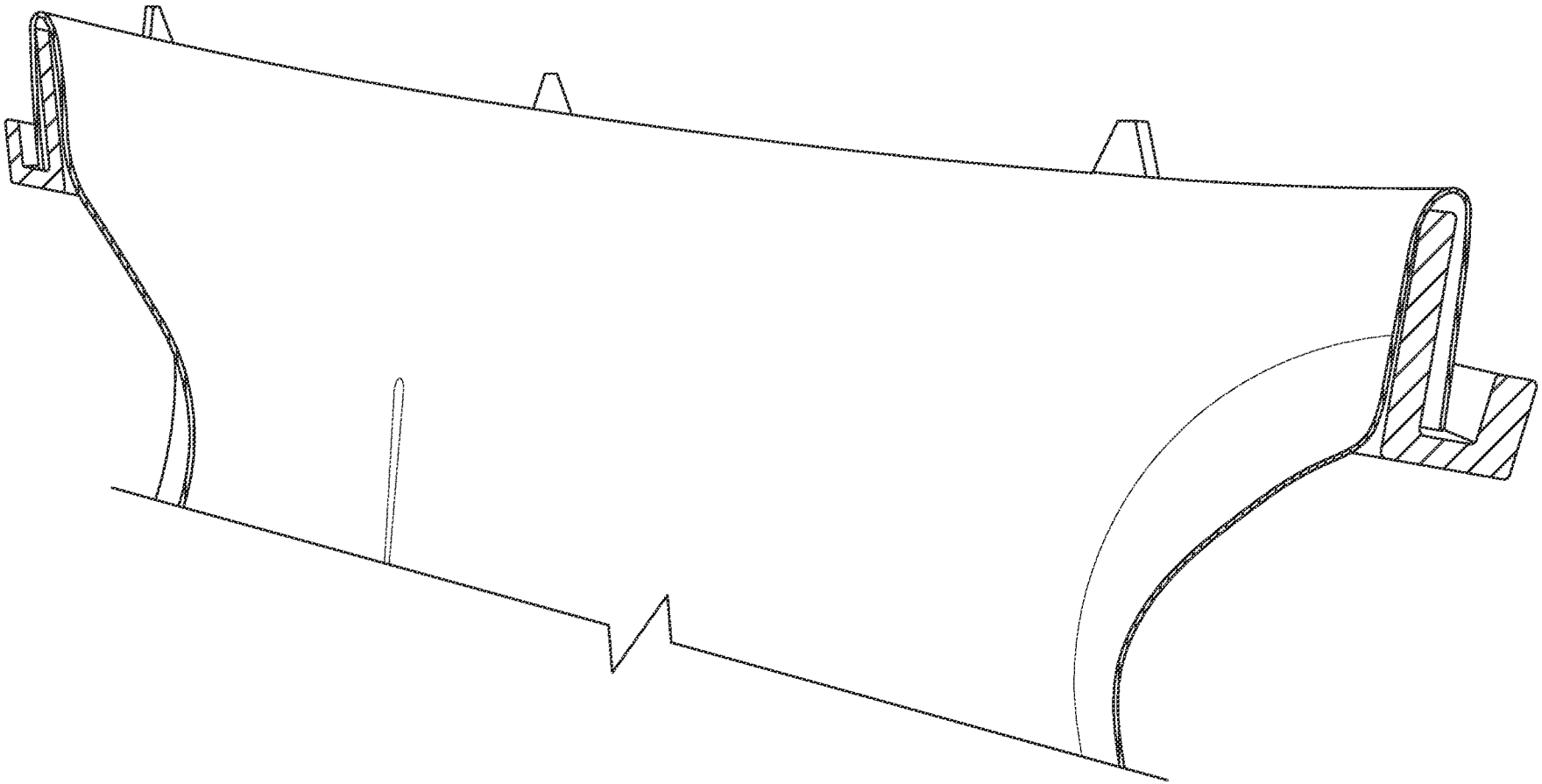
Figure 96:
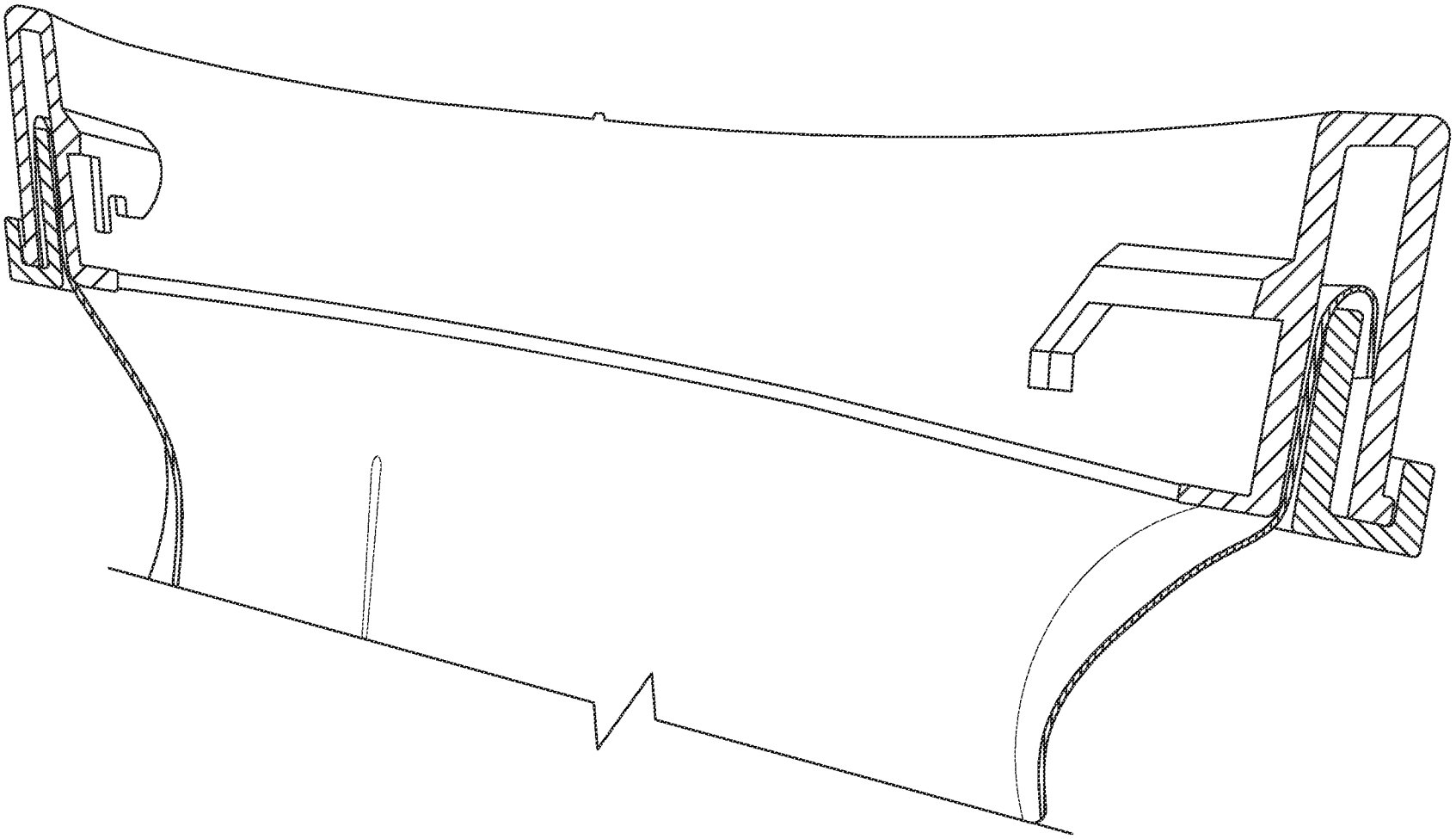

As seen in FIGS. 82, seal member 170*a* can also be provided without a central opening, such that it provides for solid surface. FIGS. 83-87 illustrate the novel locking lid/cover assembly for a container, jar, bag, tub, canister, etc. (collectively herein "container") incorporating seal member 170*a*, as opposed seal member 170 that has the central opening. The central circle in FIG. 87 does not represent an opening but the location of the protruding/locking member of seal member 170*a* on the opposite (not shown) side of seal member. Seal member 170/170*a* (which can also be referred to as a "brushing") helps to the seal the contents of the container within the container and helps to avoid some of the content from getting disposed/lodged within the cover/lid assembly components. As best seen in FIGS. 84 and 85 the gap 171*a* can be slightly larger than the similar gap in other embodiments shown in the Figures. The operation and use of the locking cover/lid assembly (whether with seal member 170 or seal member 170*a*) is the same and the above parts and operation description for other embodiments of the disclosure and such disclosure is incorporated by reference for the embodiment shown in FIGS. 82 through 87.

The internal wall 254 at opening 252 of container is provided with locking sections 270 which mate or otherwise come into contact with locking portions 132 and 134 of locking member 130 and peg members 166 of bottom member 150 when securing cover 100 to container 250 at opening 252. Though not considered limiting preferably two locking sections 270A and 270B are provided on internal wall 254 (for purposes of further discussion the locking section will be referenced as merely locking section 270 and refers to the physical configuration of either locking section 270A or 270B). Locking section 270 extends inward into opening 252 from internal wall 254 to define stop/retaining sections for locking members 132 and 134 and peg members 166 to safely secure cover 100 to container 250. Locking section 270 is provided with a first locking area 272 and a second locking area 284. First locking area 272 is provided with an upper stop ledge 274 and a lower receiving open end 276 and contains walls 278 and 280. Second locking area 284 is providing an upper stop ledge 286 and a lower receiving open end 288 and contains walls 290 and 292.

When cover 100 is properly secured to container 250 at opening 252, the outer end of locking members 132 and 134 are positioned within first locking area 272 such that any significant side to side movement of cover 100 is prevented by locking members 132 and 134 coming into contact with walls 278 and/or 280. Similarly, any significant upward movement of cover 100 is prevented by locking members 132 and 134 coming into contact with upper stop ledge 274. Additionally, while locking members 132 and 134 are positioned within locking section 270, locking peg members 166 are positioned within second locking area 284. Similarly, any significant side to side movement of cover 100 is prevented by peg members 166 coming into contact with walls 290 and/or 292 and any significant upward movement of cover 100 is prevented by peg members 166 coming into contact with upper stop ledge 286.

Figure 39:
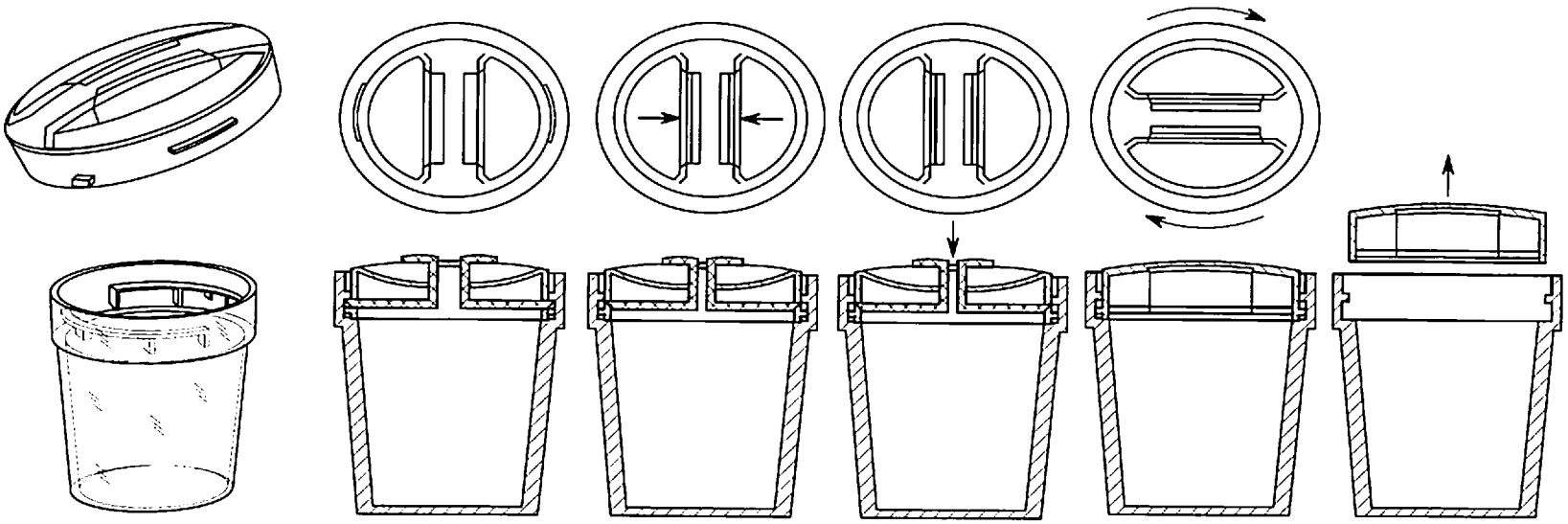
FIG. 39 is a process flow diagram for removing the Cover from a Container (i.e. opening the Container to obtain access to the contents contained therein) in accordance with the present disclosure.
Figure 40:
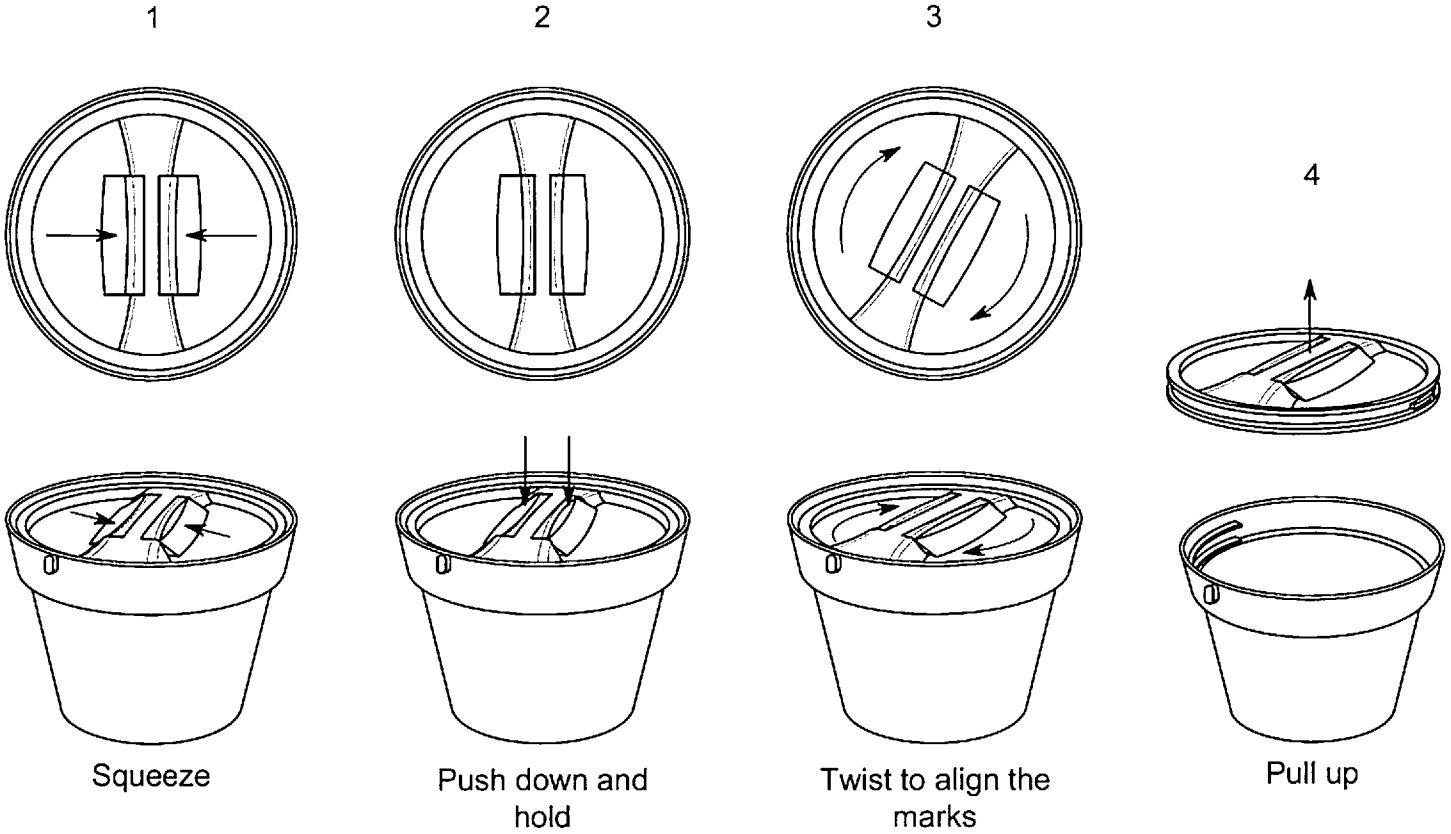
FIG. 40 is another process flow diagram for removing the Cover from a Container (i.e. opening the Container to obtain access to the contents contained therein) in accordance with the present disclosure.
Figure 41:
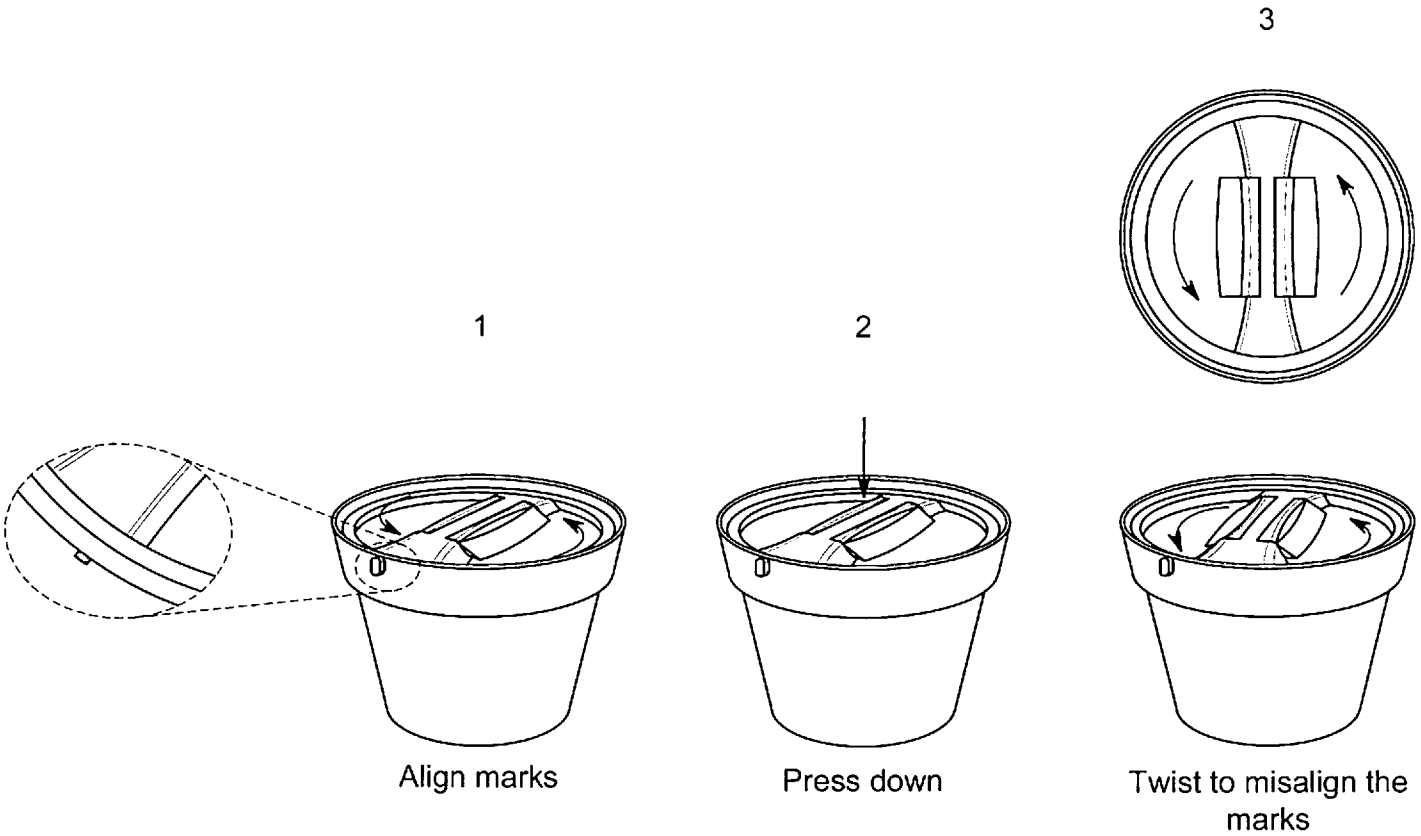
FIG. 41 is a process flow diagram for securing the Cover to a Container (i.e. closing the Container to prevent access to the contents contained therein) in accordance with the present disclosure.
Figure 42:
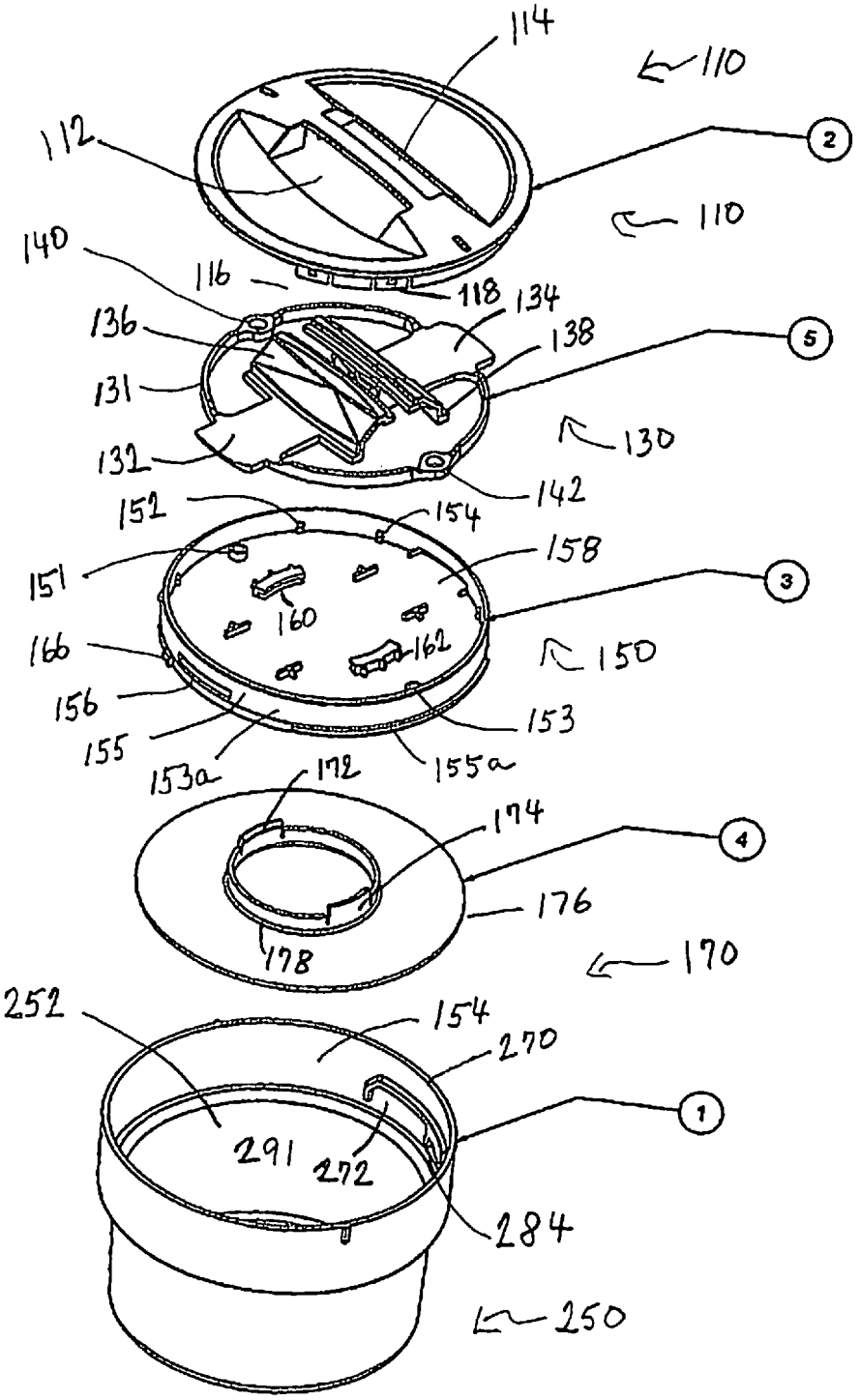
FIGS. 42 through 81 illustrate various view of different components of a first embodiment for the novel Cover in accordance with the present disclosure.
Figures 43, 44:
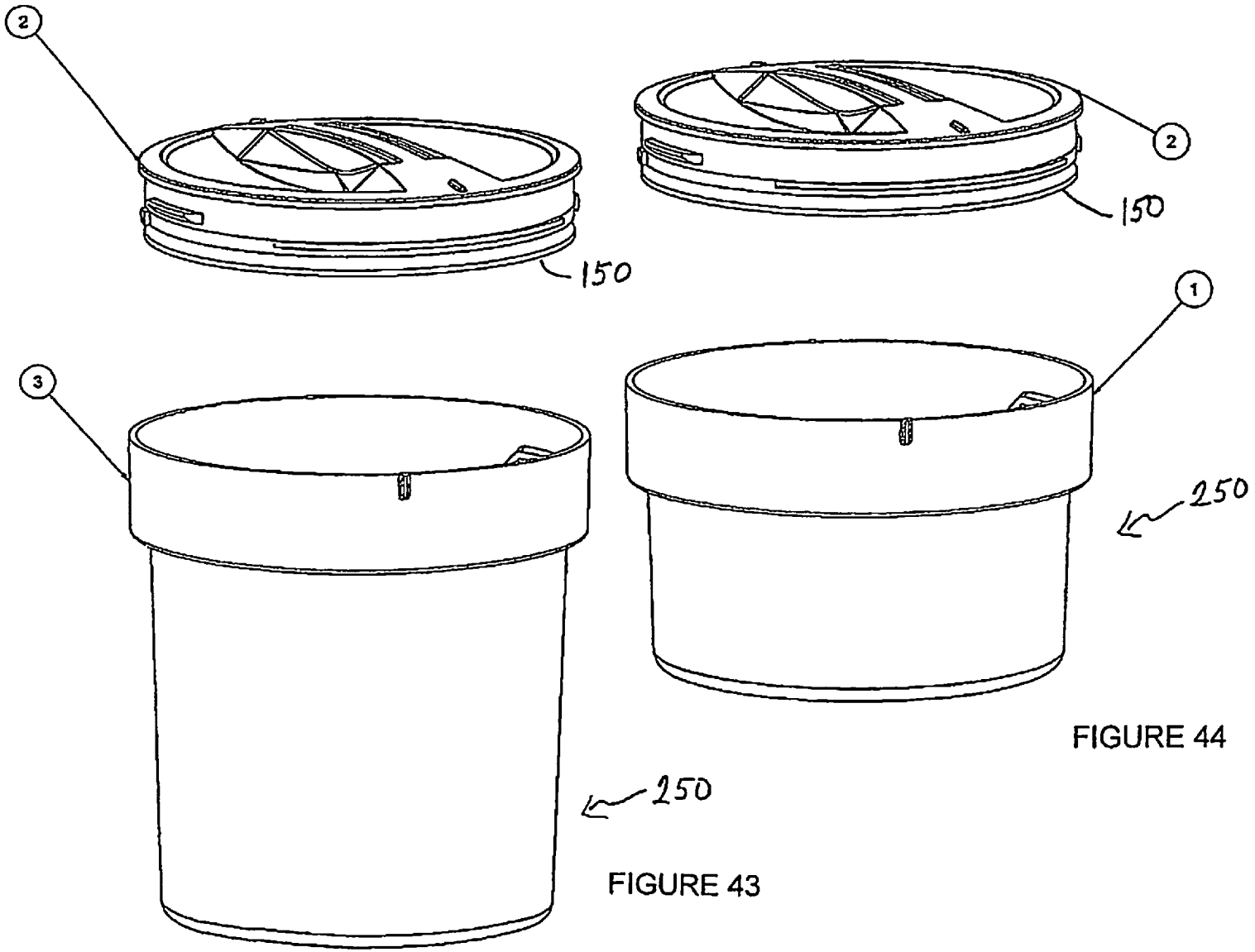
Figure 45:
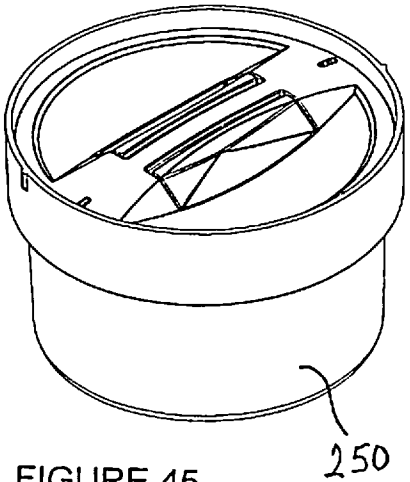
Figure 46:
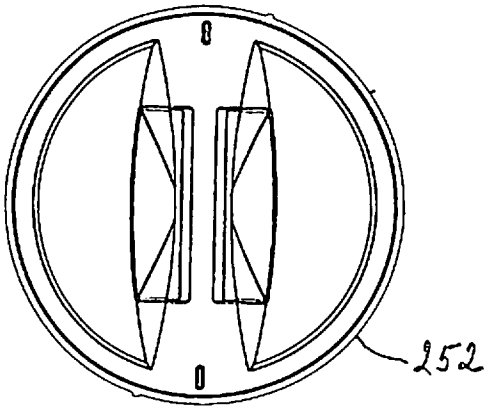
Figure 47:
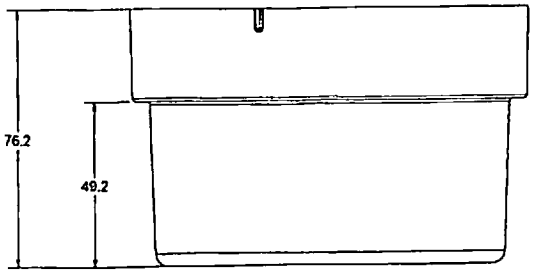
Figure 48:
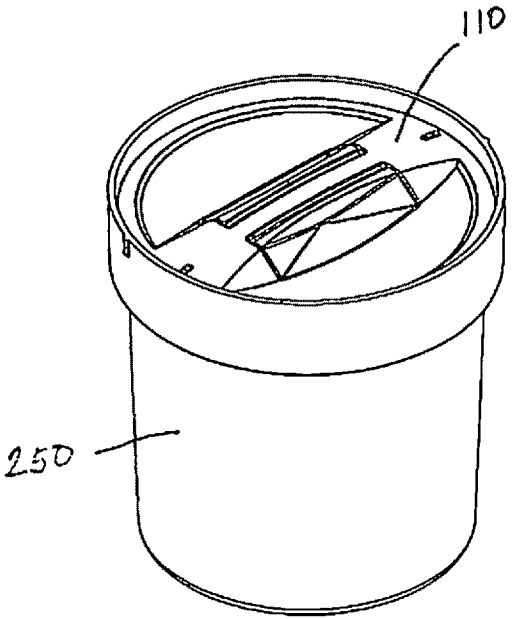
Figure 49:
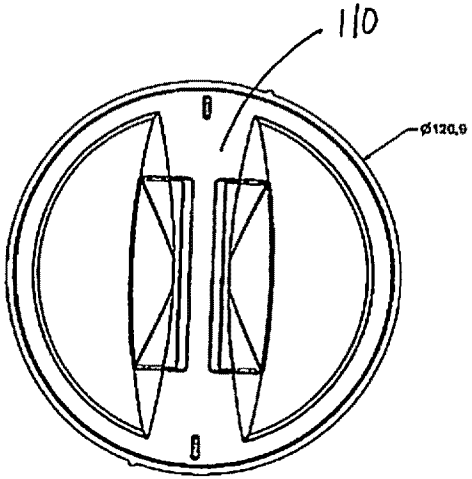
Figure 50:
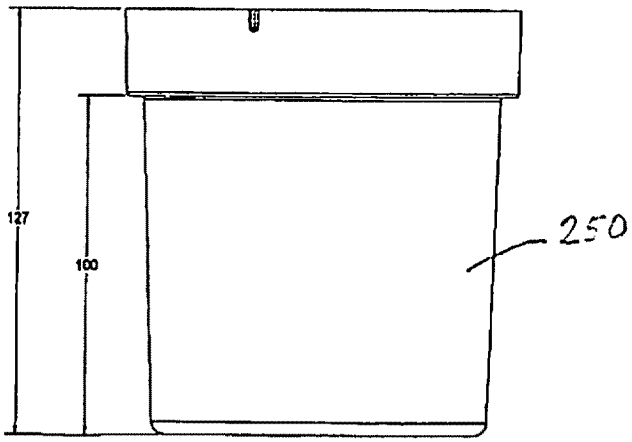
Figure 51:
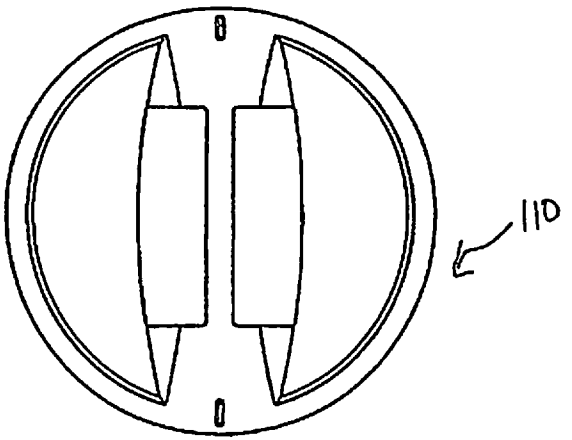
Figure 52:
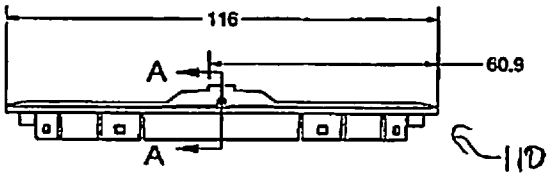
Figure 53:
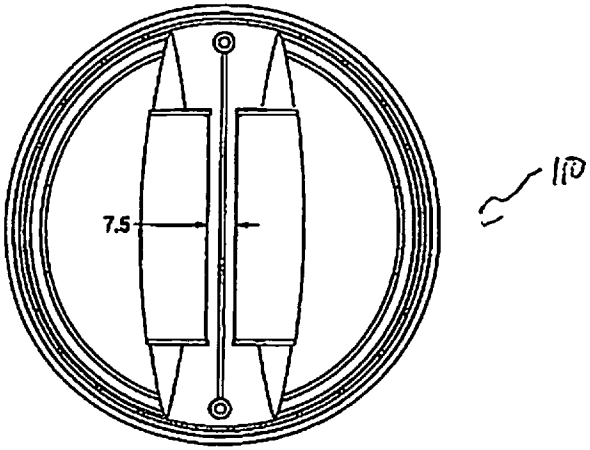
Figure 54:
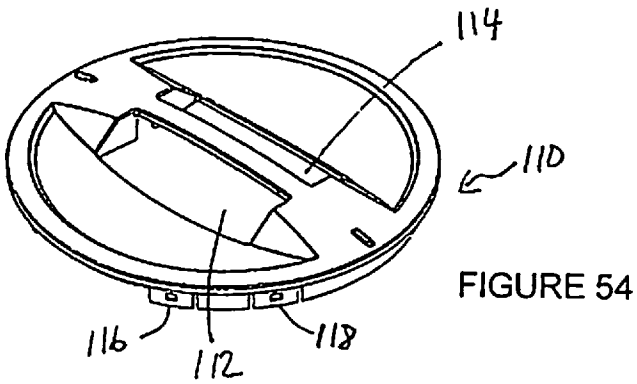
Figure 55:
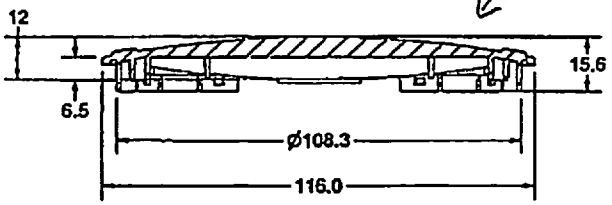
Figure 56:
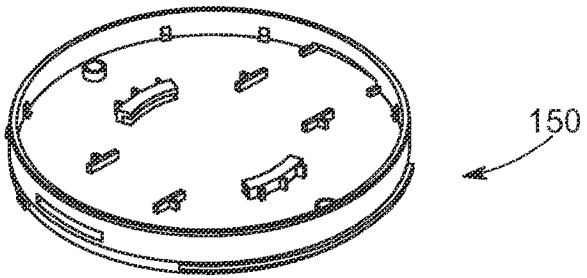
Figure 60:
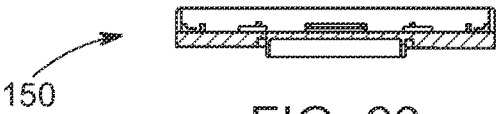
Figure 57:
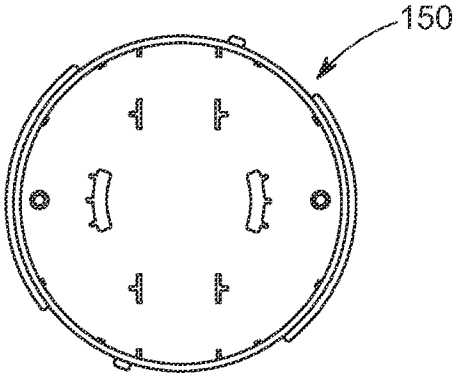
Figure 58:
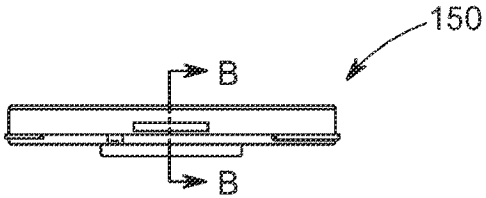
Figure 59:
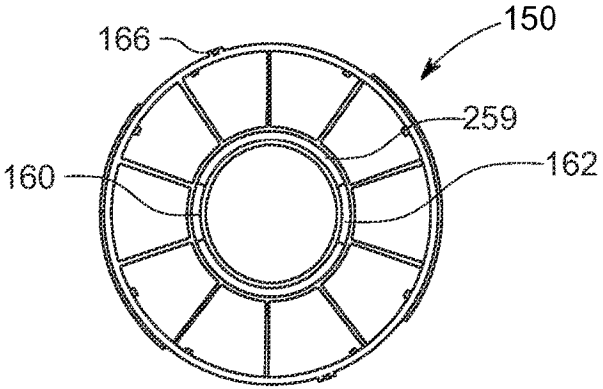
Figure 61:
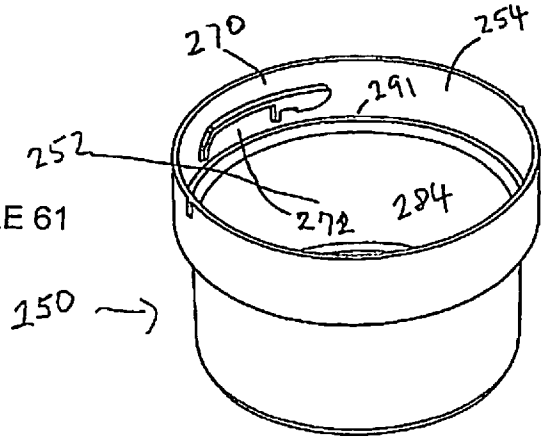
Figure 63:
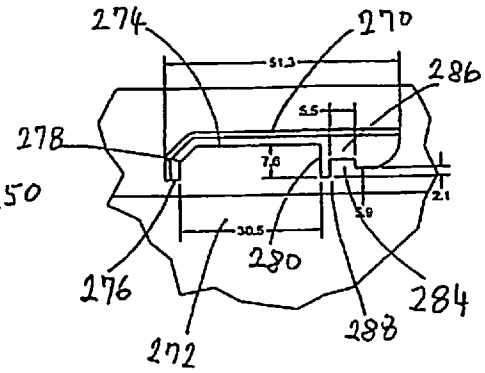
Figure 64:
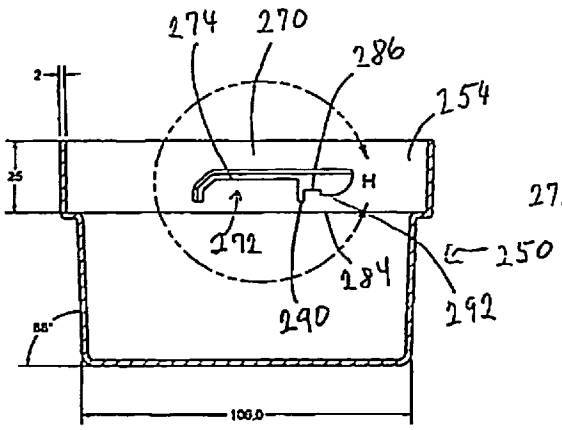
Figure 62:
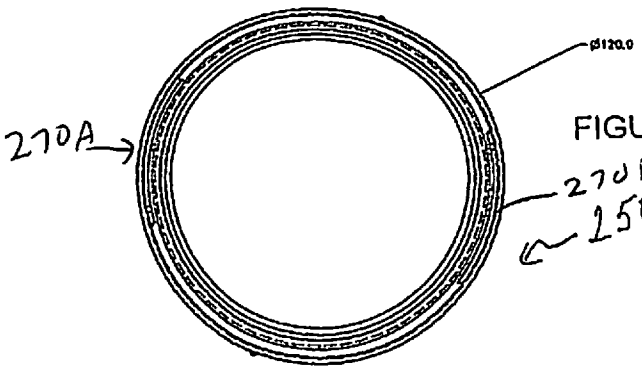
Figure 65:
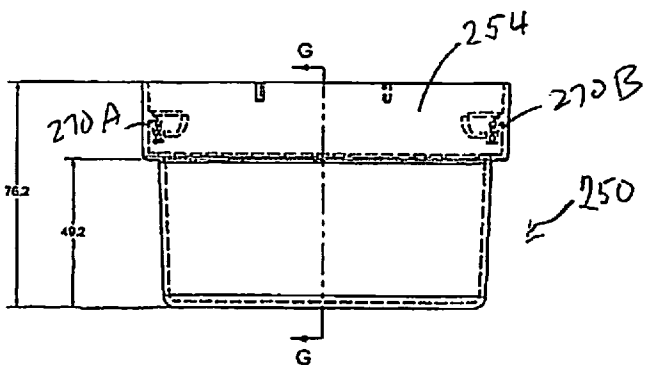
Figure 66:
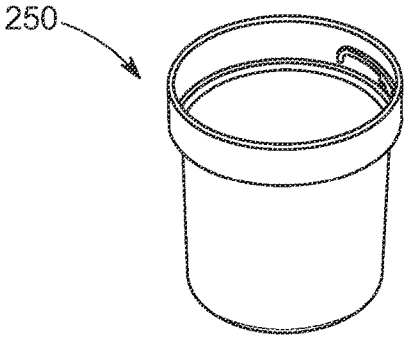
Figure 71:
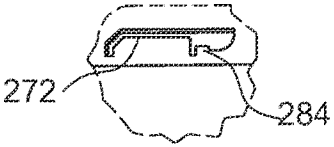
Figure 70:
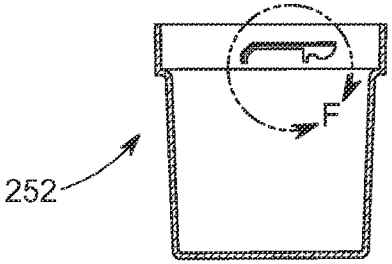
Figure 67:
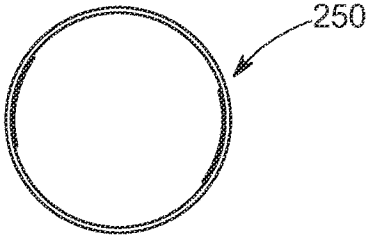
Figure 68:
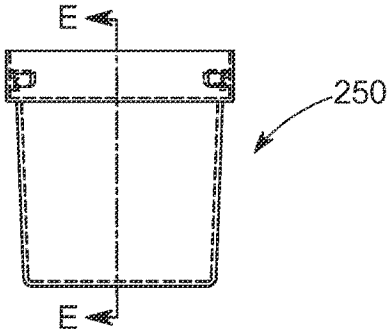
Figure 69:
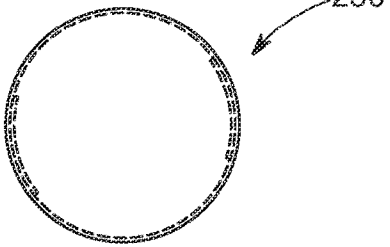
Figure 72:
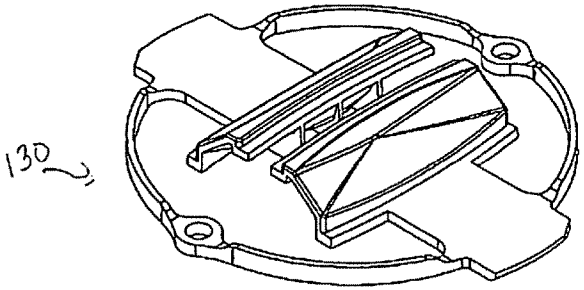
Figure 73:
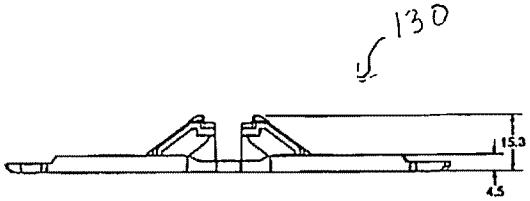
Figure 74:
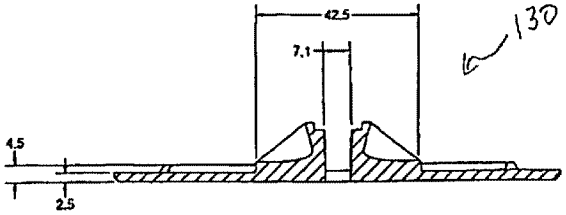
Figure 75:
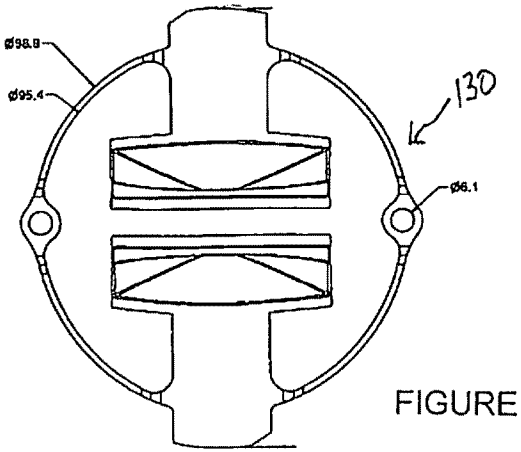
Figure 76:
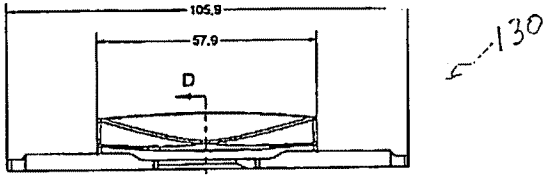
Figure 77:
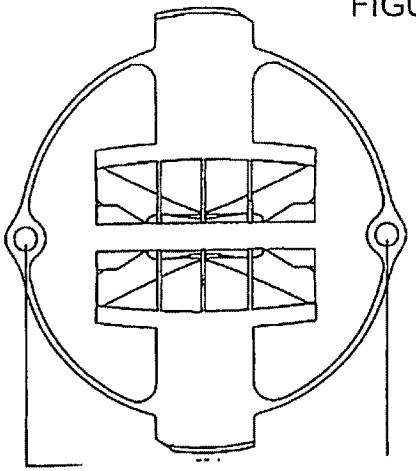
Figure 78:
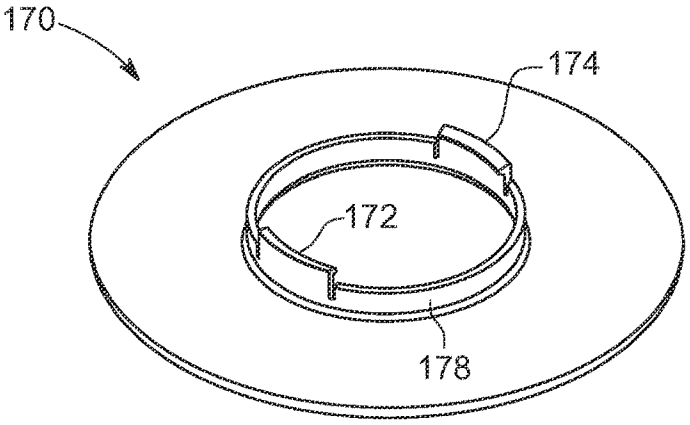
Figure 79:
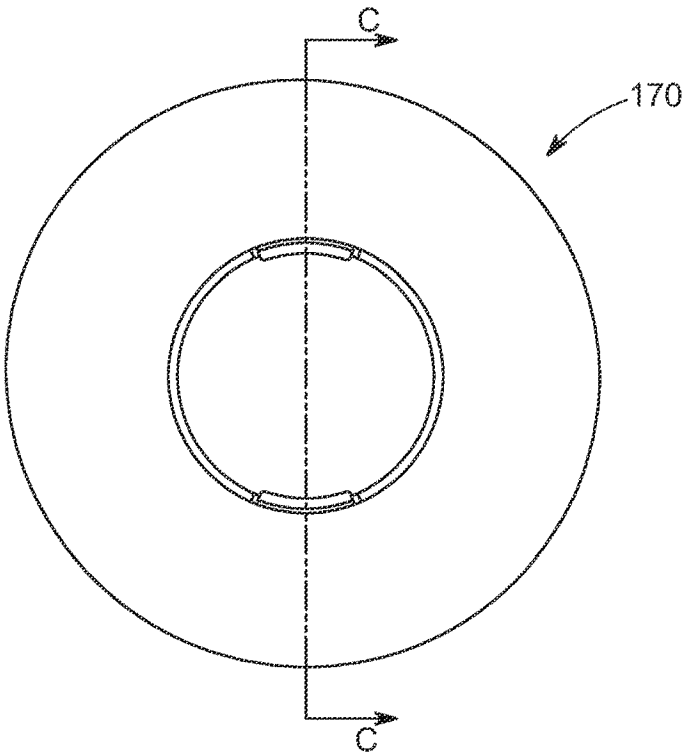
Figure 80:
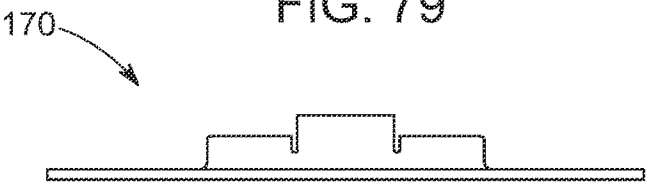

The multiple steps for releasing or removing cover 100 from securement to container 250 at opening 252 is seen in FIGS. 39 and 40. Initially, the user squeezes tabs 136 and 138 inward which causes locking members 132 and 134 to retract a sufficient amount of distance that they are no longer constrained by walls 278 and 280 and upper ledge 274 of locking section 270. However, at this point, cover 100 preferably is still secured to container 250 and cannot be removed, as the inward movement of tabs 136 and 138 does not affect the location of peg members 166 within second locking area 284. Thus, peg members 166 are still constrained by walls 290 and 292 and upper edge 286 of locking section 270. Accordingly, the next step involves moving peg member 166 from its position within second locking area 284.

Initially, the user preferably still squeezes tabs inward 136 and 138 inward otherwise locking members 132 and 134 would return to their original locking position. As peg members 166 are static (i.e. secured in a fixed position to bottom member 150) and do not move separately like locking members 132 and 134, the entire cover 100 (since all components of cover 100 are secured to each other) must be moved in order to move peg members 166 out of second locking area 284 of locking section 270. The diameter of cover 100 (with peg member 166 extending outward from bottom member 150 is slightly less than opening 252, such that cover 100 cannot be moved sideways to position peg member 166 out of second locking area 284. Furthermore, where two peg members 166 and locking sections 270 are provided moving cover 100 to one side to move one peg member 166 out of its second locking area 284, would cause the other peg member 166 to be positioned further within its corresponding second locking area 284, such that cover 100 would still be partially secured to container 250. Thus, the release of peg members 166 preferably releases both (all) peg members 166 at the same time. To accomplish this, with tab 136 and 138 still squeezed inward, the user pushes down on cover 100 which causes all peg members 166 to travel downward and out of their corresponding second locking areas through lower open end 288.

At this point, cover 100 still cannot be removed from container 250, as pulling up on cover 100 would causes peg members 166 to come into contact with locking section 270 and prevent upward movement of cover 100. Accordingly, with tabs 136 and 138 still squeezed inward the final release step requires the user to twist cover 100 in either a clockwise or counterclockwise (depending on how the cover 100 is configured) direction until peg member 166 is no longer under locking section 270 such that when the user pulls up on cover 100 there is no protrusion within opening 252 that comes into contact with peg members 166 allowing cover 100 to be removed. Outer wall 153*a* of bottom member 150 can also be provided positioning protrusion(s) 155*a*. Protrusions 155*a* preferably come into contact with one end of locking section 270 when cover 100 is twisted and upon contact can indicate to the user that cover 100 has been twisted a sufficient distance to ensure that peg members 166 will avoid locking sections 270 when cover 100 is pulled upwards by the user to open container 250. Preferably, cover 100 can only be twisted in one direction (either clockwise or counterclockwise, but preferably not both), as if the user attempts to twist cover 100 in the wrong direction peg member 166 will contact the portion of locking section 270 that defines wall 280 and will not move any farther resulting in peg member still be blocked by locking section 270 if cover 100 is attempted to be pulled upward.

To secure cover 100 to an open container 250, preferably the indicia or marking on top section 110 can be aligned with marking/indicia provided on internal wall 254 of container 250 near or at the open end of opening 252. In one non-limiting embodiment, where the indicia/markings line up can also be the pint where positioning protrusions 155*a* come into contact with one end of locking section 270. Tab 136 and 138 are squeezed inward and cover 100 is pushed downward in opening 252 until seal 170 or bottom member 150 (if no seal is provided) comes into contact with an inner ledge 291 contained within opening 252. At this point of contact, peg member 166 is positioned low enough with respect to locking section 270 such that when the user twists cover 100 counterclockwise (i.e. the direction opposite to the direction twisted or turned to open or remove cover 100) peg member 166 will be positioned underneath second locking area 284 preferably in conjunction with protrusion 155*a* coming into contact with an end of locking section 270. At this point, the user releases the pinch or squeeze on tabs 136 and 138 and cover 100 is safely secured to container 250.

Seal 170 can be a semi pliable layer and not a rigid of a material as the other components of cover 100. The pliable layer can be preferably compressed to release a locking mechanism. A gasket member can also be added to cover 100 and positioned within one of the components of cover 100 or at a point along opening 252, such as, though not limiting, underneath locking section 270. Furthermore, the orientation of the components and sections can be configured to allow for either right-handed operation or left-handed operation.

The materials used for making the various describe components and Containers are not considered limited to any particular material(s). In one non-limiting embodiment, plastic material can be used. In another non-limiting embodiment some or all of the components of cover 100 can be constructed from metal. Additionally, the Containers can be clear, opaque, transparent, etc. and can also come in a variety of colors. The Containers are also not considered limited to any particular color.

All shapes, materials, uses, sizes or dimensions shown in the drawings and/or described herein are by way of non-limiting examples and are not considered limited and the various Containers, Covers, etc. can be provided in other shapes, materials, uses, sizes and dimensions which are also considered to be within the scope of the disclosure.

With the use of cover 100, the Container that cover 100 is secured to becomes reusable while maintaining its child safety or child proof characteristics it had prior to being initially opened.

All components and containers can be made from several different construction/manufacturing methods, such as, but not limited to, molds, injection molding, blow molding, 3D printers, etc Additionally, cover 100 and the concepts of a child safety device can be used with other non-container uses and products and such uses are also considered within the scope of the disclosure.

The various novel locking cover/lid assemblies described herein are not considered limited to any particular amount of pressure being exerted on them.

Accordingly, the disclosed novel cover 100 provides for a child safety cover to help prevent accidental openings of container 250 and avoiding exposing the content of the container to a child, which could be lead to a dangerous situation to the child's safety The use of the word "container" herein is included inclusive and covers containers, jugs, canisters, tubs, jars, buckets, flexible bags, pail, drum, 5-gallon drum, etc. and other items and products that are used for storing or holding one or more solid or liquid items. It is also understood and within the scope of the disclosure, that novel disclosed locking cover/lid assemblies are not limited to any particular size of container and can be used with varying sized, materials and shapes of containers.

FIGS. 88 through 96 show one non-limiting embodiment for incorporating the novel child safety device with a flexible device, such as, without limitation, flexible bag 400 having an upper lip 410 defining the opening for bag 400. The figures also show novel container lid/cover assembly embodiments described above also used for sealing bag 400. Where it is difficult or impractical to include a locking section (similar to locking section 270) in the upper edge wall/surface of the bag a mounting or locking platform 450 can be provided. In a preferred embodiment, platform 450 can having a inner member inner 460 which is secured to bag 400 by preferably hanging the edge of bag 400 over a portion of inner member 460. Inner member 460 preferably is provided with a plurality of mating posts 462. Platform 450 also include ring 470 having an inner wall surface contain locking section 480 (which is preferably similar to locking section 270). Through mating with posts 462 ring 470 is secured to inner member 460 (preferably in a non-removable configuration or relationship) so as to securely lock bag 400 to platform 450. With platform 450 safely secured to bag 400, the novel locking cover/lid described above in other embodiments can be secured to platform 450 and safely secure and prevent bag 400 from unauthorized openings by a small child. Preferably ring 470 contains one or more receiving members for receiving posts 462 of inner member 460 when securing inner member 460 to ring 470. Preferably, the securement of ring 470 to inner member 460 with bag 400 also secured can be a permanent securement, though such is not considered limiting and it is within the scope of the disclosure to also allow the attachment of ring 470 to inner member 460 to also be removable and thus allow bag 400 to also be removed to its securement to inner member 460. Bag 400 can be porous and/or non-porous. In one non-limiting embodiment, posts 462 can be push-in hooks to a female receiving area of outer ring 470 (i.e. snap-in, etc.). Though not required an under edge can be provided to hide the hooks. The bag can also be provided with one or more carrying handles. The bag is not considered limited to any particular material for constructions. However, it is preferred that the material selected for the bag be strong enough and/or ripped proof so that it is not easily ripped open and thus negate the purpose of incorporating the novel locking assemblies disclosed herein.

Figure 97:
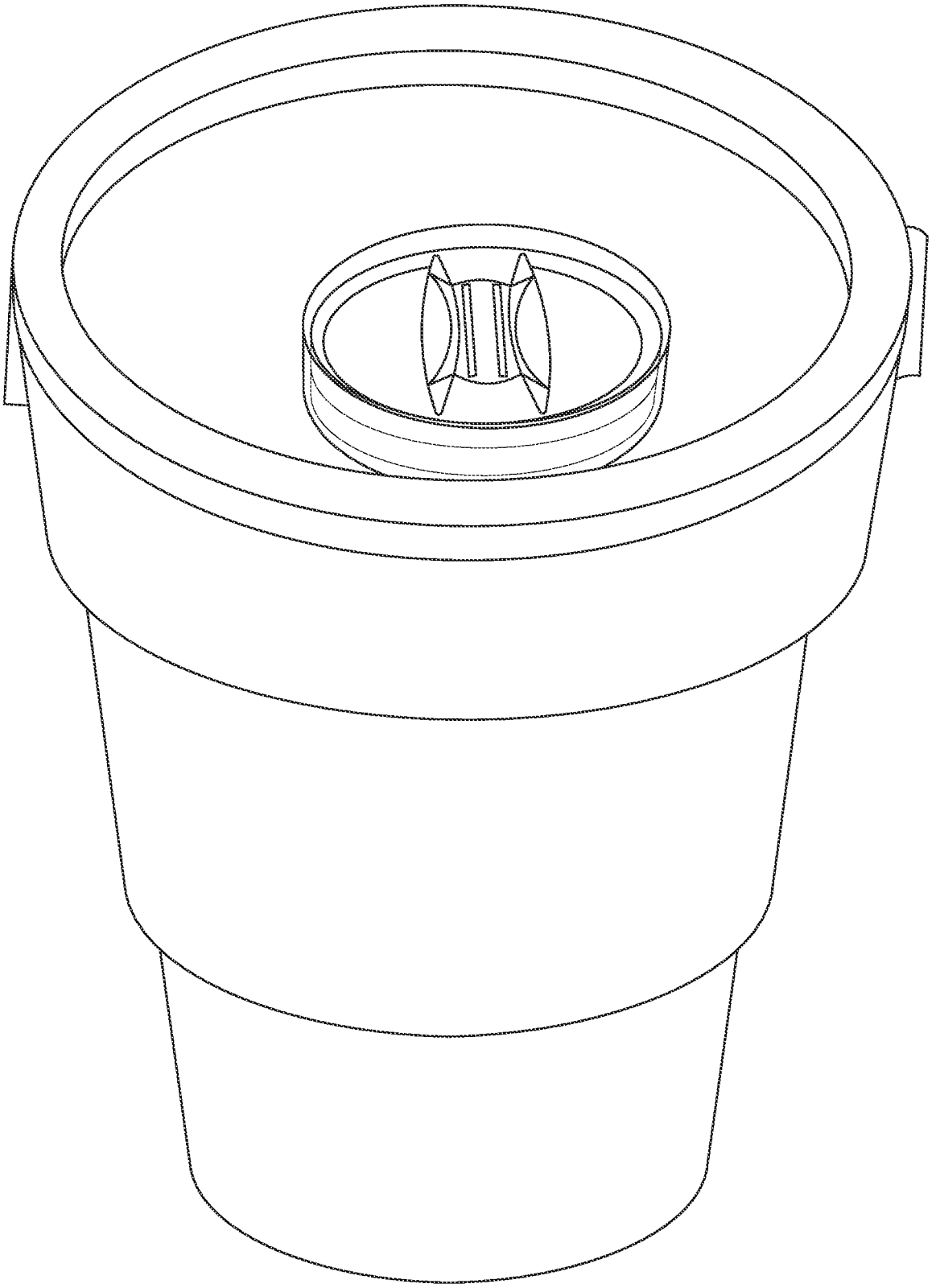
FIGS. 97 and 98 illustrate views of incorporating one or more of the novel Cover/locking assembly described herein into a lid of a larger tub/container/bucket in accordance with the present disclosure.
Figure 98:
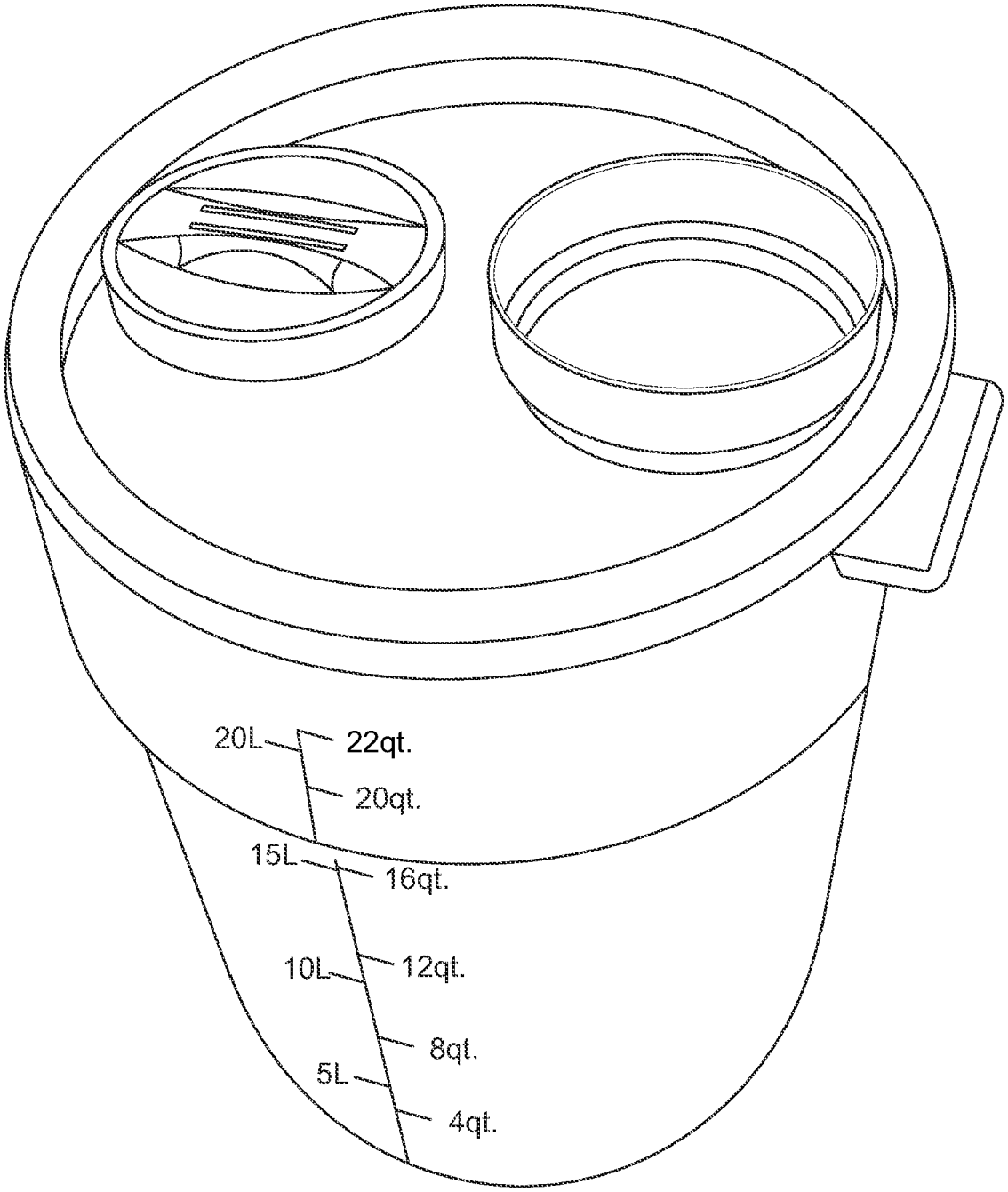

FIGS. 97 and 98 illustrate incorporating one or more of the novel Cover/locking assembly described herein incorporated into a lid of a larger tub/container/bucket. Where the lid doesn't permit a locking section 270 to be incorporated into the lid, an additional member, similar to needing a ring member 470 (shown in one non-limiting embodiment, in an exploded configuration, sitting on top of the lid in FIG. 98), can be secured within an opening of the lid. The additional member includes the locking section 270 or 480 described above for locking securement of one of the above described locking assemblies. Though one locking assembly is shown in the Figures being provided within the larger tub/container lid, it is also within the scope of the disclosure, that a plurality of openings can be provided in the lid and that a plurality of the novel locking assemblies can be attached to the tub lid.

In addition to provide a way of accessing the tub without removing the tub lid, a container or flexible bag can also be disposed within the lid hole and extend into the internal area of the larger tub. Thus, the container/bag provides for a separate and isolated storage area within the tub and can keep the contents of the tub from mixing together until needed (especially where mixing while being stored is undesirable). Additionally, where a plurality of lid openings and locking assemblies are provided, additional isolated compartments can be achieved within the tub.

In certain non-limiting uses or embodiments, at least a portion of the container or bag and/or locking assembly can be preferably made from a clear, transparent or translucent material to allow the content of the bag to be viewed without opening the bag (i.e. removing the locking assembly).

All locations, sizes, shapes, measurements, amounts, angles, component or part locations, configurations, temperatures, weights, locking mechanisms, dimensions, values, percentages, materials, orientations, etc. discussed above or shown in the drawings are merely by way of example and are not considered limiting and other locations, sizes, shapes, measurements, amounts, angles, component or part locations, configurations, temperatures, weights, locking mechanisms, dimensions, values, percentages, materials, orientations etc. can be chosen and used and all are considered within the scope of the disclosure.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed, whether during prosecution of this application or in litigation or similar proceeding. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related or could be attributed to the function of the "means for" language.

While the above novel Containers and Cover disclosure have been described in certain terms and disclosed certain embodiments or modifications, persons skilled in the art who have acquainted themselves with the disclosure will appreciate that it is not necessarily limited by such terms, nor to the specific embodiments and modification disclosed herein. Thus, a wide variety of alternatives, suggested by the teachings herein, can be practiced without departing from the spirit of the disclosed Containers and Covers, and rights to such alternatives are particularly reserved and considered within the scope of the disclosure.

What is claimed is:

1. A cover or lid assembly for closing an access opening of associated with a rigid or flexible container, the container having a storage area for storing a content that is accessed through the opening when the cover or lid is removed, comprising:

a locking member having an outer periphery, the locking member having a first locking portion connected at one end to a first tab member and a second locking portion connected at one end to a second tab member, in a fully extended position an outer end of the first locking portion and an outer end of the second locking portion are both positioned beyond the outer periphery of the locking member, the first locking portion and the second locking portion are retractable by squeezing the first tab member and the second tab member inward towards each other;

a bottom member having an outer periphery, the bottom member having a first peg member attached as at or near a bottom edge of the bottom member and a second peg member attached at or near the bottom edge of the bottom member, the bottom member secured to the locking member such that in the fully extended position the outer end of the first locking portion and the outer end of the second locking portion are both positioned beyond the outer periphery of the bottom member;

a first locking section disposed at or near an access opening for a container, the first locking section having a first receiving area and a second receiving area; and a second locking section disposed at or near the access opening for the container, the second locking section having a third receiving area and fourth receiving area;

wherein in a container closed position the cover or lid assembly is secured to the container at the access opening.

2. The cover or lid assembly of claim 1 wherein in the container closed position, the outer end of the first locking portion is disposed within the first receiving area and the first peg member is disposed within the second receiving area and the outer end of the second locking portion is disposed within the third receiving area and the second peg member is disposed within the fourth receiving area.

3. The cover or lid assembly of claim 1 wherein a diameter of the outer periphery of the locking member and a diameter of the outer periphery of the bottom member are smaller than then an inner diameter of the access opening.

4. The cover or lid assembly of claim 1 further comprising a top member having a first top opening and a second top opening, the top member secured to the locking member such that the first tab member is accessible to a user through the first top opening and the second tab member is accessible to a user through the second top opening and the first tab member and second tab member can be moved inward towards each other by a user when securing or releasing the cover or lid assembly to or from the access opening, the top member having an outer diameter smaller than the inner diameter of the access opening.

5. The cover or lid assembly of claim 1 further comprising a seal member secured to the bottom member such that the seal member is disposed underneath the bottom member, the seal member having an outer diameter smaller than the inner diameter of the access opening.

6. The cover or lid assembly of claim 5 wherein the seal member is constructed from a pliable member and is less rigid than a material used for constructing the bottom member.

7. The cover or lid assembly of claim 2 wherein the bottom member having a sidewall extending along its periphery, the sidewall having a first slot or opening and a second slot or opening.

8. The cover or lid assembly of claim 7 wherein a shape of the first slot or opening corresponds to a shape of the outer end of the first locking portion and a shape of the second slot or opening corresponds to a shape of the outer end of the second locking portion.

9. The cover or lid assembly of 7 wherein in the fully extended position the first locking portion extends through the first slot or opening in the bottom member sidewall and the second locking portion extends through the second slot or opening in the bottom member sidewall.

10. A cover or lid assembly for closing an access opening associated with a rigid or flexible container, the container having a storage area for storing a content that is accessed through the opening when the cover or lid is removed, comprising:

a locking member having an outer periphery, the locking member having a first locking portion connected at one end to a first tab member and a second locking portion connected at one end to a second tab member, in a fully extended position an outer end of the first locking portion and an outer end of the second locking portion are both positioned beyond the outer periphery of the locking member, the first locking portion and the second locking portion are retractable by squeezing the first tab member and the second tab member inward towards each other;

a bottom member having an outer periphery and a sidewall extending along the bottom member outer periphery, the sidewall having a first slot or opening and a second slot or opening, the bottom member having a first peg member attached as at or near a bottom edge of the bottom member and a second peg member attached at or near the bottom edge of the bottom member, the bottom member secured to the locking member such that in the fully extended position the outer end of the first locking portion and the outer end of the second locking portion are both positioned beyond the outer periphery of the bottom member;

a top member having a first top opening and a second top opening, the top member secured to the locking member such that the first tab member is accessible to a user through the first top opening and the second tab member is accessible to a user through the second top opening and the first tab member and second tab member can be moved inward towards each other by a user when securing or releasing the cover or lid assembly to or from an access opening for the container;

a first locking section disposed at or near the access opening, the first locking section having a first receiving area and a second receiving area; and a second locking section disposed at or near the access opening, the second locking section having a third receiving area and fourth receiving area;

wherein in a container closed position the cover or lid assembly is secured to the access opening;

wherein in the container closed position, the first locking portion is fully extended and inserted through the first slot or opening in the bottom member sidewall and the outer end of the first locking portion is disposed within the first receiving area and the first peg member is disposed within the second receiving area and the second locking portion is fully extended and inserted through the second slot or opening in the bottom member sidewall and the outer end of the second locking portion is disposed within the third receiving area and the second peg member is disposed within the fourth receiving area.

11. The cover or lid assembly of claim 10 wherein a diameter of the outer periphery of the locking member and a diameter of the outer periphery of the bottom member are smaller than then an inner diameter of the access opening; wherein an outer diameter of the top member smaller than the inner diameter of the access opening.

12. The cover or lid assembly of claim 10 further comprising a seal member secured to the bottom member such that the seal member is disposed underneath the bottom member, the seal member having an outer diameter smaller than the inner diameter of the access opening; wherein the seal member is constructed from a pliable member and is less rigid than a material used for constructing the bottom member.

13. The cover or lid assembly of claim 10 wherein a shape of the first slot or opening corresponds to a shape of the outer end of the first locking portion and a shape of the second slot or opening corresponds to a shape of the outer end of the second locking portion.

14. The cover or lid assembly of claim 10 wherein the bottom member having at least one elongated positioning protrusion disposed on an outer surface of the bottom member sidewall which comes into contact with one side end of the first locking section or the second locking section when aligning the cover or lid assembly with the access opening for removing or securing the cover or lid assembly to the access opening.

15. The cover or lid assembly of claim 1 wherein the first locking section disposed on an internal wall of the container and the second locking section disposed on the internal wall of the container.

16. The cover or lid assembly of claim 10 wherein the first locking section disposed on an internal wall of the container and the second locking section disposed on the internal wall of the container.

17. The cover or lid assembly of claim 1 wherein the first locking section disposed on an inner surface of a mounting platform and the second locking section disposed on the inner surface of the mounting platform.

18. The cover or lid assembly of claim 17 wherein the container is a flexible container having an outer open end and the mounting platform is secured at the outer open end of the flexible container.

19. The cover or lid assembly of claim 17 wherein the container having a larger cover and the access opening is an opening in the larger cover and the mounting platform is secured within the access opening.

* * * * *